US008950019B2

(12) United States Patent
Loberger et al.

(10) Patent No.: US 8,950,019 B2
(45) Date of Patent: Feb. 10, 2015

(54) LAVATORY SYSTEM

(71) Applicant: Bradley Fixtures Corporation, Menomonee Falls, WI (US)

(72) Inventors: John M. Loberger, Germantown, WI (US); Jason M. Renner, Greenfield, WI (US); Jeffery S. Jaworski, Sussex, WI (US); Mark A. Thielke, Menomonee Falls, WI (US); Mark A. Meyer, Slinger, WI (US); Kevin M. Kohlwey, Port Washington, WI (US); Douglas Carpiaux, Milwaukee, WI (US); Daniel J. De Lay, Muskego, WI (US); Glenn T. Walters, Port Washington, WI (US); Richard Walters, Hugo, MN (US); Jon W. Hauser, II, Geneva, IL (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 13/650,812

(22) Filed: Oct. 12, 2012

(65) Prior Publication Data

US 2013/0067658 A1 Mar. 21, 2013

Related U.S. Application Data

(63) Continuation of application No. 12/233,466, filed on Sep. 18, 2008, now Pat. No. 8,296,875.

(51) Int. Cl.

| | |
|---|---|
| ***E03C 1/05*** | (2006.01) |
| ***E03C 1/01*** | (2006.01) |
| *A47K 5/12* | (2006.01) |

(52) U.S. Cl.

CPC . *E03C 1/057* (2013.01); *E03C 1/01* (2013.01); *A47K 2005/1218* (2013.01)

USPC ..... 4/623; 4/619; 4/626; 4/628

(58) Field of Classification Search

CPC ..... E03C 1/05; E03C 1/057

USPC ..... 4/619, 623, 626, 628

See application file for complete search history.

(56) References Cited

U.S. PATENT DOCUMENTS

| | | | |
|---|---|---|---|
| 540,235 | A | 6/1895 | Clifford et al. |
| D30,136 | S | 2/1899 | Eckerson |

(Continued)

FOREIGN PATENT DOCUMENTS

| | | |
|---|---|---|
| AT | 141398 | 8/1996 |
| AU | 2005203363 | 2/2006 |

(Continued)

OTHER PUBLICATIONS

U.S. Appl. No. 29/306,946, Oct. 2, 2008, Thielke et al.

(Continued)

*Primary Examiner* — Tuan N Nguyen

(74) *Attorney, Agent, or Firm* — Boyle Fredrickson, S.C.

(57) ABSTRACT

A lavatory system is disclosed including one or more integrated hand washing stations. Each hand washing station includes a basin, a faucet, a solenoid valve configured to control water flow to the faucet, and an electric hand dryer located adjacent the basin and the faucet so that the user of the washing station may use the faucet and the electric hand dryer without leaving the washing station. The electric hand dryer preferably includes an outlet to direct air across the associated basin so that any water that drips from the user's hands fall within the basin. A control system may be provided to control activation of the fixtures such as the solenoid valve, the electric hand dryer, and/or soap dispenser. The control system may be configured to inhibit simultaneous activation of the solenoid valve and the hand dryer. A photovoltaic system may be provided to provide power.

9 Claims, 43 Drawing Sheets

(56) References Cited

U.S. PATENT DOCUMENTS

| | | | |
|---|---|---|---|
| D36,574 | S | 2/1899 | Zipp |
| D36,575 | S | 10/1903 | Zipp |
| D36,595 | S | 10/1903 | Peet |
| 937,509 | A | 10/1909 | Carpenter |
| 1,069,972 | A | 8/1913 | Metzaer |
| 1,323,398 | A | 12/1919 | Leland |
| 1,419,712 | A | 6/1922 | Bassette |
| 1,423,800 | A | 7/1922 | Hibbard et al. |
| 1,494,883 | A | 5/1924 | Bassette et al. |
| 1,578,047 | A | 3/1926 | Lum |
| 1,579,705 | A | 4/1926 | Hewitt |
| 1,616,313 | A | 2/1927 | Farmer |
| 1,659,851 | A | 2/1928 | Brewington |
| 1,750,094 | A | 3/1930 | Emmrich |
| 1,765,915 | A | 6/1930 | Haase |
| D81,754 | S | 8/1930 | Mabee |
| 1,816,055 | A | 7/1931 | Pfeifer |
| 2,008,183 | A | 2/1934 | McCord |
| 1,961,179 | A | 6/1934 | Tinkham |
| 2,027,605 | A | 1/1936 | McCord et al. |
| 2,041,352 | A | 5/1936 | Jordan |
| D100,310 | S | 7/1936 | Blu |
| 2,130,196 | A | 9/1938 | Sakier |
| 2,192,383 | A | 3/1940 | Krolop |
| 2,202,107 | A | 5/1940 | Korn |
| 2,281,370 | A | 4/1942 | Morrison et al. |
| 2,328,129 | A | 8/1943 | Earle |
| 2,438,762 | A | 3/1948 | McLeckie |
| 2,470,187 | A | 5/1949 | Price |
| 2,479,571 | A | 8/1949 | Hewitt |
| 2,498,699 | A | 2/1950 | Mullett et al. |
| 2,504,740 | A | 4/1950 | Siegel |
| 2,521,769 | A | 9/1950 | Arcularius |
| 2,537,821 | A | 1/1951 | Fodor |
| 2,591,669 | A | 4/1952 | Bucknell et al. |
| 2,606,274 | A | 8/1952 | Spierer |
| RE23,674 | E | 6/1953 | Spierer et al. |
| 2,641,679 | A | 6/1953 | Brodbeck |
| 2,646,629 | A | 7/1953 | Clemens |
| D170,204 | S | 8/1953 | Long |
| 2,651,705 | A | 9/1953 | Clemens |
| 2,666,837 | A | 1/1954 | Brodbeck |
| 2,677,041 | A | 4/1954 | Oliver et al. |
| 2,698,894 | A | 1/1955 | Stein |
| 2,714,151 | A | 7/1955 | Becker |
| 2,761,222 | A | 9/1956 | Bennett |
| 2,767,407 | A | 10/1956 | Weiss |
| 2,777,934 | A | 1/1957 | Falkenthal |
| 2,826,763 | A | 3/1958 | Bass |
| 2,837,835 | A | 6/1958 | Hewitt et al. |
| 2,853,591 | A | 9/1958 | Pine |
| 2,853,592 | A | 9/1958 | Gravet |
| 2,859,535 | A | 11/1958 | Carlson |
| 2,906,627 | A | 9/1959 | Payton et al. |
| 2,908,019 | A | 10/1959 | Lyon, Jr. |
| 2,965,906 | A | 12/1960 | Mullett et al. |
| 2,977,455 | A | 3/1961 | Murphy |
| 3,059,815 | A | 10/1962 | Parsons, Jr. |
| 3,065,473 | A | 11/1962 | Sporek et al. |
| 3,076,887 | A | 2/1963 | Bulow |
| 3,128,161 | A | 4/1964 | Hudon |
| D201,493 | S | 6/1965 | Sundberg et al. |
| 3,220,424 | A | 11/1965 | Nelson |
| 3,305,938 | A | 2/1967 | Arthur |
| D210,131 | S | 2/1968 | Rourke |
| 3,384,977 | A | 5/1968 | Rosenberg |
| 3,409,995 | A | 11/1968 | Greenwood et al. |
| 3,415,278 | A | 12/1968 | Yamamoto et al. |
| 3,449,838 | A | 6/1969 | Chancellor |
| 3,480,787 | A | 11/1969 | Johansen |
| 3,487,477 | A | 1/1970 | Classen |
| 3,491,381 | A | 1/1970 | Catheart |
| 3,502,384 | A | 3/1970 | Gipson |
| 3,505,692 | A | 4/1970 | Forbes |
| 3,523,305 | A | 8/1970 | Zorn |
| 3,536,294 | A | 10/1970 | Rodriguez |
| 3,551,919 | A | 1/1971 | Forbes |
| 3,556,158 | A | 1/1971 | Schneider |
| 3,575,583 | A | 4/1971 | Brown |
| 3,575,640 | A | 4/1971 | Ishikawa |
| 3,576,277 | A | 4/1971 | Blackmon |
| 3,585,652 | A | 6/1971 | Forbes et al. |
| 3,585,653 | A | 6/1971 | Forbes et al. |
| 3,587,177 | A | 6/1971 | Overly et al. |
| 3,588,038 | A | 6/1971 | Tanaka |
| 3,603,002 | A | 9/1971 | Spierer |
| 3,613,124 | A | 10/1971 | Ichimori et al. |
| 3,621,199 | A | 11/1971 | Goldstein |
| 3,639,920 | A | 2/1972 | Griffin et al. |
| 3,643,346 | A | 2/1972 | Lester |
| 3,699,984 | A | 10/1972 | Davis |
| 3,724,001 | A | 4/1973 | Ichimori et al. |
| 3,744,149 | A | 7/1973 | Helbling |
| 3,746,035 | A | 7/1973 | Singer |
| 3,757,806 | A | 9/1973 | Bhaskar et al. |
| 3,817,651 | A | 6/1974 | Law et al. |
| 3,878,621 | A | 4/1975 | Duerre |
| 3,904,167 | A | 9/1975 | Touch et al. |
| 3,906,795 | A | 9/1975 | Kask |
| 3,918,987 | A | 11/1975 | Kopfer |
| D238,075 | S | 12/1975 | Harris |
| 3,975,781 | A | 8/1976 | Klimboff et al. |
| 3,992,730 | A | 11/1976 | Davis |
| 4,072,157 | A | 2/1978 | Wines, Jr. et al. |
| 4,120,180 | A | 10/1978 | Jedora |
| 4,144,596 | A | 3/1979 | MacFarlane et al. |
| 4,145,602 | A | 3/1979 | Lee |
| 4,145,769 | A | 3/1979 | MacFarlane et al. |
| D251,795 | S | 5/1979 | McCann |
| 4,193,209 | A | 3/1980 | Lovison et al. |
| 4,195,416 | A | 4/1980 | Hall |
| 4,219,367 | A | 8/1980 | Cary, Jr. et al. |
| 4,239,555 | A | 12/1980 | Scharlack et al. |
| 4,256,133 | A | 3/1981 | Coward et al. |
| D260,678 | S | 9/1981 | Hiller |
| 4,295,233 | A | 10/1981 | Hinkel et al. |
| 4,309,781 | A | 1/1982 | Lissau |
| 4,336,619 | A | 6/1982 | Hinkel et al. |
| 4,375,874 | A | 3/1983 | Leotta et al. |
| 4,383,377 | A | 5/1983 | Crafton |
| 4,398,310 | A | 8/1983 | Lienhard |
| 4,402,095 | A | 9/1983 | Pepper |
| 4,402,331 | A | 9/1983 | Taldo et al. |
| D272,263 | S | 1/1984 | Lienhard |
| 4,429,422 | A | 2/1984 | Wareham |
| 4,453,286 | A | 6/1984 | Wieland |
| 4,461,439 | A | 7/1984 | Rose |
| 4,497,999 | A | 2/1985 | Postbeschild |
| 4,509,543 | A | 4/1985 | Livingston et al. |
| D279,404 | S | 6/1985 | Hiller |
| 4,520,516 | A | 6/1985 | Parsons |
| 4,541,563 | A | 9/1985 | Uetsuhara |
| 4,570,823 | A | 2/1986 | Arabian et al. |
| 4,594,797 | A | 6/1986 | Houck, Jr. |
| 4,598,726 | A | 7/1986 | Pepper |
| 4,604,764 | A | 8/1986 | Enzo |
| 4,606,085 | A | 8/1986 | Davies |
| 4,610,165 | A | 9/1986 | Duffy et al. |
| 4,611,768 | A | 9/1986 | Voss et al. |
| 4,624,017 | A | 11/1986 | Foletta |
| 4,637,254 | A | 1/1987 | Dyben et al. |
| 4,642,821 | A | 2/1987 | Zanuso et al. |
| 4,642,909 | A | 2/1987 | Garcial |
| 4,644,256 | A | 2/1987 | Farias et al. |
| 4,651,777 | A | 3/1987 | Hardman |
| 4,653,201 | A | 3/1987 | Seaman |
| 4,670,010 | A | 6/1987 | Dragone |
| 4,671,121 | A | 6/1987 | Schieler |
| 4,681,141 | A | 7/1987 | Wang |
| 4,682,628 | A | 7/1987 | Hill |
| 4,685,222 | A | 8/1987 | Houck, Jr. |
| 4,688,277 | A | 8/1987 | Kakinoki et al. |
| 4,688,585 | A | 8/1987 | Vetter |
| 4,700,049 | A | 10/1987 | Rubin |

(56) References Cited

U.S. PATENT DOCUMENTS 4,702,107 A 10/1987 Guerrini et al.
4,707,867 A 11/1987 Kawabe et al.
4,707,933 A 11/1987 Keck et al.
4,709,728 A 12/1987 Ying-Chung
4,716,605 A 1/1988 Shepherd et al.
4,722,372 A 2/1988 Hoffman et al.
4,735,002 A 4/1988 Rath
4,735,357 A 4/1988 Gregory et al.
4,741,363 A 5/1988 Hu
4,742,583 A 5/1988 Yoshida et al.
4,742,836 A 5/1988 Buehler
4,744,515 A 5/1988 Watanabe
4,746,090 A 5/1988 Hamilton
4,762,273 A 8/1988 Gregory et al.
4,765,003 A 8/1988 Chang
4,767,922 A 8/1988 Stauffer
4,769,863 A 9/1988 Tegg et al.
4,780,595 A 10/1988 Alban
4,785,162 A 11/1988 Kuo
4,823,414 A 4/1989 Piersimoni et al.
4,826,129 A 5/1989 Fong et al.
4,839,039 A 6/1989 Parsons et al.
4,848,599 A 7/1989 Kano et al.
4,852,802 A 8/1989 Iggulden et al.
4,856,122 A 8/1989 Pilolla
4,857,112 A 8/1989 Franninge
4,857,705 A 8/1989 Blevins
4,872,485 A 10/1989 Laverty, Jr.
4,876,435 A 10/1989 Hawkins
4,882,467 A 11/1989 Dimick
4,883,749 A 11/1989 Roberts et al.
4,889,315 A 12/1989 Imanaga
4,894,874 A 1/1990 Wilson
4,909,580 A 3/1990 Mitchell
4,914,758 A 4/1990 Shaw
4,914,833 A 4/1990 Pilolla et al.
4,915,347 A 4/1990 Iqbal et al.
4,916,382 A 4/1990 Kent
4,916,613 A 4/1990 Lange et al.
4,921,129 A 5/1990 Jones et al.
4,921,131 A 5/1990 Binderbauer et al.
4,921,211 A 5/1990 Novak et al.
4,940,298 A 7/1990 Jackson et al.
4,941,219 A 7/1990 Van Marcke
4,942,631 A 7/1990 Rosa
4,948,090 A 8/1990 Chen
4,953,236 A 9/1990 Lee et al.
4,954,179 A 9/1990 Franninge
4,955,535 A 9/1990 Tsutsui et al.
4,959,603 A 9/1990 Yamamoto et al.
4,963,780 A 10/1990 Hochstrasser
4,967,425 A 11/1990 Kawamura et al.
4,971,106 A 11/1990 Tsutsui et al.
4,980,474 A 12/1990 Hayashi et al.
4,980,574 A 12/1990 Cirrito
4,984,314 A 1/1991 Weigert
4,986,221 A 1/1991 Shaw
4,989,755 A 2/1991 Shiau
4,995,585 A 2/1991 Gruber et al.
4,998,673 A 3/1991 Pilolla
5,000,044 A 3/1991 Duffy et al.
5,008,963 A 4/1991 Stein
5,018,550 A 5/1991 Burdorff
5,025,516 A 6/1991 Wilson
5,031,258 A 7/1991 Shaw
5,031,337 A 7/1991 Pilolla et al.
5,033,508 A 7/1991 Laverty, Jr.
5,033,715 A 7/1991 Chiang et al.
5,060,323 A 10/1991 Shaw
5,062,164 A 11/1991 Lee et al.
5,063,622 A 11/1991 Tsutsui et al.
5,063,955 A 11/1991 Sakakibara
5,072,618 A 12/1991 Taylor et al.
5,074,322 A 12/1991 Jaw
5,074,520 A 12/1991 Lee et al.
5,076,424 A 12/1991 Nakamura
5,080,324 A 1/1992 Chi
RE33,810 E 2/1992 Strieter
5,084,984 A 2/1992 Duchoud et al.
5,086,526 A 2/1992 Van Marcke
5,092,560 A 3/1992 Chen
5,095,941 A 3/1992 Betz
5,099,587 A 3/1992 Jarosch
5,111,594 A 5/1992 Allen
D326,711 S 6/1992 Lotito et al.
5,117,693 A 6/1992 Duska
5,133,095 A 7/1992 Shiba et al.
5,144,757 A 9/1992 Sasso
5,146,695 A 9/1992 Yang
5,158,114 A 10/1992 Botsolas
5,163,234 A 11/1992 Tsukamoto et al.
5,169,118 A 12/1992 Whiteside
5,170,944 A 12/1992 Shirai
D332,194 S 1/1993 Hines
D332,195 S 1/1993 Hines
D332,196 S 1/1993 Hines
D332,365 S 1/1993 Hines
D332,366 S 1/1993 Hines
D332,369 S 1/1993 Hanna et al.
D332,370 S 1/1993 Hanna et al.
D332,542 S 1/1993 Hines
D332,679 S 1/1993 Hines
D332,849 S 1/1993 Hines
5,175,892 A 1/1993 Shaw
5,177,879 A 1/1993 Muta
5,181,328 A 1/1993 Bouverie
D332,889 S 2/1993 Hines
5,184,642 A 2/1993 Powell
5,186,360 A 2/1993 Mease et al.
D334,266 S 3/1993 Hines
5,193,563 A 3/1993 Melech
5,199,116 A 4/1993 Fischer
5,199,118 A 4/1993 Cole et al.
5,199,188 A 4/1993 Franz
5,202,666 A 4/1993 Knippscheer
D336,572 S 6/1993 Gunderson et al.
5,216,251 A 6/1993 Matschke
5,217,035 A 6/1993 Van Marcke
5,224,685 A 7/1993 Chiang et al.
5,226,629 A 7/1993 Millman et al.
5,230,109 A 7/1993 Zaccai et al.
D338,361 S 8/1993 Hines
5,239,610 A 8/1993 Shao
5,243,717 A 9/1993 Yasuo
D340,374 S 10/1993 Hines
D340,375 S 10/1993 Hines
5,251,872 A 10/1993 Kodaira
5,253,376 A 10/1993 Fait
5,255,822 A 10/1993 Mease et al.
D341,724 S 11/1993 Hines
5,257,423 A 11/1993 Jacobsen et al.
5,259,410 A 11/1993 Trueb et al.
5,265,288 A 11/1993 Allison
5,265,628 A 11/1993 Sage et al.
D342,175 S 12/1993 Hines
D342,177 S 12/1993 Hanna et al.
5,267,475 A 12/1993 Gaston
5,269,071 A 12/1993 Hamabe et al.
5,272,918 A 12/1993 Gaston et al.
D342,992 S 1/1994 Robertson
5,280,679 A 1/1994 Edelman
5,282,812 A 2/1994 Suarez, Jr.
D344,830 S 3/1994 Carter et al.
5,341,839 A 8/1994 Kobayashi et al.
5,347,864 A 9/1994 Senghaas et al.
5,351,347 A 10/1994 Kunkel
5,351,417 A 10/1994 Rubin
5,362,026 A 11/1994 Kobayashi et al.
5,363,517 A 11/1994 Botsolas
5,367,442 A 11/1994 Frost et al.
5,369,818 A 12/1994 Barnum et al.
5,377,424 A 1/1995 Albanes
5,377,427 A 1/1995 Mashata
D355,949 S 2/1995 Laughton

(56) References Cited

U.S. PATENT DOCUMENTS 5,397,099 A 3/1995 Pilolla
5,404,419 A 4/1995 Artis, Jr.
5,412,816 A 5/1995 Paterson et al.
5,412,818 A 5/1995 Chen
5,426,271 A 6/1995 Clark et al.
D361,372 S 8/1995 Enthoven
5,438,714 A 8/1995 Shaw
5,438,763 A 8/1995 Yang
5,442,867 A 8/1995 Robinson
D362,901 S 10/1995 Dannenberg et al.
5,459,944 A 10/1995 Tatsutani et al.
D364,675 S 11/1995 Tebbe
5,477,984 A 12/1995 Sayama et al.
5,482,250 A 1/1996 Kodaira
5,497,135 A 3/1996 Wisskirchen et al.
5,504,950 A 4/1996 Natalizia et al.
5,514,346 A 5/1996 Fujita
5,522,411 A 6/1996 Johnson
5,548,119 A 8/1996 Nortier
5,555,912 A 9/1996 Saadi et al.
5,561,871 A 10/1996 Laughton
5,566,404 A 10/1996 Laughton
5,570,869 A 11/1996 Diaz et al.
5,586,746 A 12/1996 Humpert et al.
5,588,636 A 12/1996 Eichholz et al.
5,595,216 A 1/1997 Pilolla
5,610,591 A 3/1997 Gallagher
5,611,093 A 3/1997 Barnum et al.
5,611,517 A 3/1997 Saadi et al.
5,625,908 A 5/1997 Shaw
5,627,375 A 5/1997 Hsieh
5,640,781 A 6/1997 Carson
5,642,462 A 6/1997 Huff
D380,529 S 7/1997 Laughton
5,651,189 A 7/1997 Coykendall et al.
5,651,384 A 7/1997 Rudrich
5,670,945 A 9/1997 Applonie
D387,144 S 12/1997 Flaherty
5,694,653 A 12/1997 Harald
5,699,833 A 12/1997 Tsataros
5,701,929 A 12/1997 Helmsderfer
5,727,579 A 3/1998 Chardack
5,730,165 A 3/1998 Philipp
D393,700 S 4/1998 Trueb et al.
5,743,511 A 4/1998 Eichholz et al.
D394,495 S 5/1998 Hauser
5,758,688 A 6/1998 Hamanaka et al.
5,765,242 A 6/1998 Marciano
5,769,120 A 6/1998 Laverty, Jr. et al.
5,781,942 A 7/1998 Allen et al.
5,782,382 A 7/1998 Van Marcke
D398,969 S 9/1998 Barnum et al.
5,813,047 A 9/1998 Teichroeb
5,819,335 A 10/1998 Hennessy
5,819,336 A 10/1998 Gilliam et al.
5,829,072 A 11/1998 Hirsch et al.
D402,358 S 12/1998 Bonnell
5,855,356 A 1/1999 Fait
5,868,311 A 2/1999 Cretu-Petra
5,873,178 A 2/1999 Johnson
5,873,179 A 2/1999 Gregory et al.
5,875,562 A 3/1999 Fogarty
5,893,387 A 4/1999 Paterson et al.
5,915,417 A 6/1999 Diaz et al.
5,915,851 A 6/1999 Wattrick et al.
D411,876 S 7/1999 Hafner et al.
5,918,855 A 7/1999 Hamanaka et al.
5,924,148 A 7/1999 Flowers, Sr.
5,943,712 A 8/1999 Van Marcke
5,943,713 A 8/1999 Paterson et al.
5,945,068 A 8/1999 Ferone
5,945,913 A 8/1999 Gallagher
5,950,983 A 9/1999 Jahrling
5,954,069 A 9/1999 Foster
5,961,095 A 10/1999 Schrott
5,966,753 A 10/1999 Gauthier et al.
5,972,126 A 10/1999 Fernie
5,974,685 A 11/1999 Hironaka
5,979,500 A 11/1999 Jahrling et al.
5,984,262 A 11/1999 Parsons et al.
5,988,588 A 11/1999 Allen et al.
5,992,430 A 11/1999 Chardack et al.
6,000,429 A 12/1999 Van Marcke
6,003,170 A 12/1999 Humpert et al.
6,006,388 A 12/1999 Young
6,006,784 A 12/1999 Tsutsui et al.
D420,727 S 2/2000 Hundley
6,018,885 A 2/2000 Hill
6,029,292 A 2/2000 Leiferman et al.
6,029,293 A 2/2000 Paterson et al.
6,038,786 A 3/2000 Aisenberg et al.
D422,346 S 4/2000 Svendsen
6,056,261 A 5/2000 Aparicio et al.
6,059,192 A 5/2000 Zosimadis
6,067,673 A 5/2000 Paese et al.
D428,477 S 7/2000 O'Connell et al.
6,082,407 A 7/2000 Paterson et al.
6,089,086 A 7/2000 Swindler et al.
6,110,292 A 8/2000 Jewett et al.
D431,288 S 9/2000 Helmsderfer
6,119,285 A 9/2000 Kim
D433,109 S 10/2000 Wilke et al.
6,125,482 A 10/2000 Foster
6,127,671 A 10/2000 Parsons et al.
6,128,826 A 10/2000 Robinson
6,131,587 A 10/2000 Chardack et al.
6,142,342 A 11/2000 Lewis
6,161,227 A 12/2000 Bargenquast
6,161,814 A 12/2000 Jahrling
D435,893 S 1/2001 Helmsderfer
6,178,572 B1 1/2001 Van Marcke
6,185,838 B1 2/2001 Moore
6,189,163 B1 2/2001 Van Marcke
6,189,230 B1 2/2001 Huen
6,192,530 B1 2/2001 Dai
6,199,428 B1 3/2001 Estevez-Garcia et al.
6,202,980 B1 3/2001 Vincent et al.
6,206,340 B1 3/2001 Paese et al.
6,209,392 B1 4/2001 Rapala
6,212,707 B1 4/2001 Thompson et al.
6,216,534 B1 4/2001 Ross, Jr. et al.
6,219,857 B1 4/2001 Wu
6,219,859 B1 4/2001 Derakhshan
6,236,317 B1 5/2001 Cohen et al.
6,250,601 B1 6/2001 Kolar et al.
6,253,609 B1 7/2001 Ross, Jr. et al.
6,253,611 B1 7/2001 Varga et al.
6,257,264 B1 7/2001 Sturman et al.
6,267,007 B1 7/2001 Gunther
D446,664 S 8/2001 Petri
D447,224 S 8/2001 Barnum et al.
6,269,695 B1 8/2001 Cesternino et al.
6,273,394 B1 8/2001 Vincent et al.
6,279,179 B1 8/2001 Register
6,279,587 B1 8/2001 Yamamoto
6,282,812 B1 9/2001 Wee et al.
6,286,153 B1 9/2001 Keller
6,289,728 B1 9/2001 Wilkins
6,294,786 B1 9/2001 Maricichow et al.
6,295,410 B1 9/2001 Helms et al.
D448,585 S 10/2001 Petri
6,298,502 B1 10/2001 Brown
6,317,717 B1 11/2001 Lindsey et al.
6,321,785 B1 11/2001 Bergmann
6,322,005 B1 11/2001 Kern et al.
6,340,032 B1 1/2002 Zosimadis
6,341,389 B2 1/2002 Philipps-Libeich et al.
D453,882 S 2/2002 Petri
6,349,484 B1 2/2002 Cohen
6,351,866 B1 3/2002 Bragulla
6,363,549 B2 4/2002 Humpert et al.
6,370,951 B1 4/2002 Kerchaert et al.
6,386,390 B1 5/2002 Tinker
6,390,125 B2 5/2002 Pawelzik et al.

(56) References Cited

U.S. PATENT DOCUMENTS

| | | | |
|---|---|---|---|
| 6,393,634 | B1 | 5/2002 | Kodaira et al. |
| 6,401,274 | B1 | 6/2002 | Brown |
| 6,408,881 | B2 | 6/2002 | Lorenzelli et al. |
| 6,418,788 | B2 | 7/2002 | Articolo |
| 6,426,701 | B1 | 7/2002 | Levy et al. |
| 6,431,189 | B1 | 8/2002 | Deibert |
| D462,195 | S | 9/2002 | Wang |
| RE37,888 | E | 10/2002 | Cretu-Petra |
| 6,467,514 | B1 | 10/2002 | Korst et al. |
| 6,467,651 | B1 | 10/2002 | Muderlak et al. |
| 6,481,040 | B1 | 11/2002 | McIntyre |
| 6,481,634 | B1 | 11/2002 | Zosimadis |
| 6,484,965 | B1 | 11/2002 | Reaves |
| 6,508,121 | B2 | 1/2003 | Eck |
| 6,523,193 | B2 | 2/2003 | Saraya |
| 6,523,404 | B1 | 2/2003 | Murphy et al. |
| 6,568,655 | B2 | 5/2003 | Paese et al. |
| 6,572,207 | B2 | 6/2003 | Hase et al. |
| D477,060 | S | 7/2003 | Loberger et al. |
| 6,598,245 | B2 | 7/2003 | Nishioka |
| 6,619,320 | B2 | 9/2003 | Parsons |
| 6,624,606 | B2 | 9/2003 | Kushida et al. |
| 6,639,209 | B1 | 10/2003 | Patterson et al. |
| D481,826 | S | 11/2003 | Martinuzzo et al. |
| 6,641,002 | B2 | 11/2003 | Gerenraich et al. |
| 6,643,865 | B2 | 11/2003 | Bork et al. |
| 6,651,851 | B2 | 11/2003 | Muderlak et al. |
| D483,152 | S | 12/2003 | Martinuzzo et al. |
| 6,658,934 | B1 | 12/2003 | Housey et al. |
| D484,958 | S | 1/2004 | Loberger et al. |
| 6,671,890 | B2 | 1/2004 | Nishioka |
| 6,671,898 | B1 | 1/2004 | Eggenberger et al. |
| 6,679,285 | B2 | 1/2004 | Pablo |
| 6,691,340 | B2 | 2/2004 | Honda et al. |
| 6,691,724 | B2 | 2/2004 | Ford |
| 6,711,949 | B1 | 3/2004 | Sorenson |
| 6,711,950 | B1 | 3/2004 | Yamaura et al. |
| 6,715,730 | B2 | 4/2004 | Ehr |
| 6,766,589 | B1 | 7/2004 | Bory et al. |
| 6,769,197 | B1 | 8/2004 | Tai |
| 6,769,443 | B2 | 8/2004 | Bush |
| 6,770,869 | B2 | 8/2004 | Patterson et al. |
| D496,450 | S | 9/2004 | Loberger et al. |
| 6,789,197 | B1 | 9/2004 | Saito |
| 6,812,657 | B2 | 11/2004 | Raimondi |
| 6,827,294 | B1 | 12/2004 | Fan et al. |
| 6,843,079 | B2 | 1/2005 | Hird |
| 6,857,314 | B2 | 2/2005 | Ohhashi et al. |
| 6,871,541 | B2 | 3/2005 | Weisse |
| 6,882,278 | B2 | 4/2005 | Winings et al. |
| 6,883,563 | B2 | 4/2005 | Smith |
| D507,634 | S | 7/2005 | Loberger et al. |
| 6,912,864 | B2 | 7/2005 | Roche et al. |
| 6,915,690 | B2 | 7/2005 | Okada et al. |
| 6,922,144 | B2 | 7/2005 | Bulin et al. |
| D508,117 | S | 8/2005 | Loberger et al. |
| 6,922,912 | B2 | 8/2005 | Phillips |
| 6,928,235 | B2 | 8/2005 | Pollack |
| 6,929,150 | B2 | 8/2005 | Muderlak et al. |
| D509,577 | S | 9/2005 | Loberger et al. |
| 6,950,606 | B2 | 9/2005 | Logan et al. |
| D511,205 | S | 11/2005 | Loberger et al. |
| D511,821 | S | 11/2005 | Loberger et al. |
| 6,962,005 | B1 | 11/2005 | Khosropour et al. |
| 6,962,168 | B2 | 11/2005 | McDaniel et al. |
| 6,964,405 | B2 | 11/2005 | Marcichow et al. |
| 6,966,334 | B2 | 11/2005 | Bolster |
| 6,968,860 | B1 | 11/2005 | Haenlein et al. |
| D512,648 | S | 12/2005 | Smith et al. |
| 6,980,126 | B2 | 12/2005 | Fournier |
| 6,986,171 | B1 | 1/2006 | Perrin |
| 6,993,968 | B2 | 2/2006 | Kogure |
| 6,996,863 | B2 | 2/2006 | Kaneko |
| 7,007,318 | B1 | 3/2006 | Bork et al. |
| 7,014,166 | B1 | 3/2006 | Wang |
| 7,018,473 | B2 | 3/2006 | Shadrach, III |
| 7,025,227 | B2 | 4/2006 | Oliver et al. |
| 7,039,301 | B1 | 5/2006 | Aisenberg et al. |
| 7,039,963 | B2 | 5/2006 | Loberger et al. |
| 7,079,037 | B2 | 7/2006 | Ross, Jr. et al. |
| D526,394 | S | 8/2006 | Loberger et al. |
| D527,085 | S | 8/2006 | Loberger et al. |
| 7,082,828 | B1 | 8/2006 | Wilkins |
| 7,093,485 | B2 | 8/2006 | Newman et al. |
| D527,809 | S | 9/2006 | Loberger et al. |
| 7,104,519 | B2 | 9/2006 | O'Maley et al. |
| 7,107,631 | B2 | 9/2006 | Lang et al. |
| 7,114,510 | B2 | 10/2006 | Peters et al. |
| 7,150,293 | B2 | 12/2006 | Jonte |
| 7,165,450 | B2 | 1/2007 | Jamnia et al. |
| 7,174,577 | B2 | 2/2007 | Jost et al. |
| D537,927 | S | 3/2007 | Loberger et al. |
| D538,898 | S | 3/2007 | Trepanier |
| D539,400 | S | 3/2007 | Loberger et al. |
| 7,191,484 | B2 | 3/2007 | Dawe |
| 7,191,920 | B2 | 3/2007 | Boll et al. |
| 7,198,175 | B2 | 4/2007 | Ophardt |
| 7,201,052 | B2 | 4/2007 | Lee |
| D542,474 | S | 5/2007 | Churchill et al. |
| 7,219,686 | B2 | 5/2007 | Schmitz et al. |
| 7,228,874 | B2 | 6/2007 | Bolderheij et al. |
| 7,228,984 | B2 | 6/2007 | Tack et al. |
| 7,232,111 | B2 | 6/2007 | McDaniel et al. |
| 7,242,307 | B1 | 7/2007 | LeBlond et al. |
| 7,271,728 | B2 | 9/2007 | Taylor et al. |
| 7,278,624 | B2 | 10/2007 | Iott et al. |
| 7,296,765 | B2 | 11/2007 | Rodrain |
| 7,305,722 | B2 | 12/2007 | Sha et al. |
| 7,315,165 | B2 | 1/2008 | Kleinen et al. |
| 7,318,949 | B2 | 1/2008 | Shadrach, III |
| 7,320,146 | B2 | 1/2008 | Nortier et al. |
| D561,315 | S | 2/2008 | Loberger et al. |
| 7,343,799 | B2 | 3/2008 | Nagakura et al. |
| 7,350,245 | B2 | 4/2008 | Giagni |
| 7,350,413 | B2 | 4/2008 | Nagakura et al. |
| 7,364,053 | B2 | 4/2008 | Ophardt |
| 7,377,163 | B2 | 5/2008 | Miyagawa |
| 7,396,000 | B2 | 7/2008 | Parsons et al. |
| 7,406,722 | B2 | 8/2008 | Fukuizumi et al. |
| 7,409,860 | B2 | 8/2008 | Ferreira et al. |
| 7,437,833 | B2 | 10/2008 | Sato et al. |
| 7,443,305 | B2 | 10/2008 | Verdiramo |
| 7,451,894 | B2 | 11/2008 | Ophardt |
| 7,455,197 | B2 | 11/2008 | Ophardt |
| 7,458,261 | B2 | 12/2008 | Miyagawa |
| 7,464,418 | B2 | 12/2008 | Seggio et al. |
| 7,467,550 | B2 | 12/2008 | Betz, II et al. |
| 7,471,883 | B2 | 12/2008 | Seutter et al. |
| 7,472,433 | B2 | 1/2009 | Rodenbeck et al. |
| 7,477,148 | B2 | 1/2009 | Lynn et al. |
| 7,484,409 | B2 | 2/2009 | Dykstra et al. |
| D588,676 | S | 3/2009 | Loberger et al. |
| 7,516,939 | B2 | 4/2009 | Bailey |
| D591,839 | S | 5/2009 | Loberger et al. |
| 7,527,174 | B2 | 5/2009 | Meehan et al. |
| 7,530,269 | B2 | 5/2009 | Newman et al. |
| 7,533,787 | B2 | 5/2009 | Muderlak et al. |
| 7,537,195 | B2 | 5/2009 | McDaniel et al. |
| 7,555,209 | B2 | 6/2009 | Pradas Diez et al. |
| 7,588,168 | B2 | 9/2009 | Bagwell et al. |
| 7,596,883 | B2 | 10/2009 | Kameishi |
| 7,597,122 | B1 | 10/2009 | Smith |
| 7,607,442 | B2 | 10/2009 | Barnhill et al. |
| 7,607,443 | B2 | 10/2009 | Barnhill et al. |
| 7,614,096 | B2 | 11/2009 | Vincent |
| 7,614,160 | B2 | 11/2009 | Kameishi et al. |
| 7,617,830 | B2 | 11/2009 | Barnhill et al. |
| 7,627,909 | B2 | 12/2009 | Esche |
| 7,631,372 | B2 | 12/2009 | Marty et al. |
| 7,641,173 | B2 | 1/2010 | Goodman |
| 7,641,740 | B2 | 1/2010 | Barnhill et al. |
| 7,650,653 | B2 | 1/2010 | Johnson et al. |
| 7,651,068 | B2 | 1/2010 | Bailey |
| D610,242 | S | 2/2010 | Loberger et al. |

(56) References Cited

U.S. PATENT DOCUMENTS 7,657,162 B2 2/2010 Itoigawa et al.
7,659,824 B2 2/2010 Prodanovich et al.
7,681,447 B2 3/2010 Nagakura et al.
7,682,464 B2 3/2010 Glenn et al.
D614,273 S 4/2010 Loberger et al.
7,690,395 B2 4/2010 Jonte et al.
7,690,623 B2 4/2010 Parsons et al.
7,698,770 B2 4/2010 Barnhill et al.
7,701,164 B2 4/2010 Clothier et al.
7,721,602 B2 5/2010 Benner et al.
7,726,334 B2 6/2010 Ross, Jr. et al.
7,731,154 B2 6/2010 Parsons et al.
7,743,438 B2 6/2010 Chen
7,743,782 B2 6/2010 Jost
7,750,594 B2 7/2010 Clothier et al.
7,754,021 B2 7/2010 Barnhill et al.
7,754,022 B2 7/2010 Barnhill et al.
7,757,700 B2 7/2010 Barnhill et al.
7,758,701 B2 7/2010 Barnhill et al.
7,766,026 B2 8/2010 Boey
7,766,194 B2 8/2010 Boll et al.
7,774,953 B1 8/2010 Duran
7,784,481 B2 8/2010 Kunkel
7,786,628 B2 8/2010 Childe et al.
7,789,095 B2 9/2010 Barnhill et al.
7,797,769 B2 9/2010 Ozenick
7,804,409 B2 9/2010 Munro et al.
D625,792 S 10/2010 Rundberg et al.
7,812,598 B2 10/2010 Yasuda et al.
7,814,582 B2 10/2010 Reddy et al.
7,815,134 B2 10/2010 Hohl
7,818,083 B2 10/2010 Glenn et al.
7,819,136 B1 10/2010 Eddy
D628,280 S 11/2010 Loberger et al.
7,825,564 B2 11/2010 Croft et al.
7,834,501 B2 11/2010 Childe et al.
RE42,005 E 12/2010 Jost et al.
7,856,736 B2 12/2010 Churchill et al.
D637,350 S 5/2011 Kato et al.
7,944,116 B2 5/2011 Causier
7,946,055 B2 5/2011 Churchill et al.
7,971,368 B2 7/2011 Fukaya et al.
8,037,619 B2 10/2011 Liu
8,128,465 B2 3/2012 Collins
8,155,508 B2 4/2012 Caine et al.
8,201,344 B2 6/2012 Sawabe et al.
2001/0011389 A1 8/2001 Philipps-Liebich et al.
2001/0011390 A1 8/2001 Humpert et al.
2001/0020619 A1 9/2001 Pfeifer et al.
2002/0006275 A1 1/2002 Pollack
2002/0019709 A1 2/2002 Segal
2002/0104159 A1 8/2002 Nishioka
2002/0157176 A1 10/2002 Wawrla et al.
2002/0171056 A1 11/2002 Paese et al.
2003/0037612 A1 2/2003 Nagakura et al.
2003/0172547 A1 9/2003 Shephard
2003/0188380 A1 10/2003 Loberger et al.
2003/0210140 A1 11/2003 Menard et al.
2003/0213062 A1 11/2003 Honda et al.
2004/0016296 A1 1/2004 Weisse
2004/0025248 A1 2/2004 Lang et al.
2004/0083547 A1 5/2004 Mercier
2004/0128755 A1 7/2004 Loberger et al.
2004/0129075 A1 7/2004 Sorenson
2004/0143898 A1 7/2004 Jost et al.
2004/0149779 A1 8/2004 Boll et al.
2004/0182151 A1 9/2004 Meure
2004/0221645 A1 11/2004 Brzozowski et al.
2004/0221646 A1 11/2004 Ohhashi et al.
2004/0221647 A1 11/2004 Sabatino
2004/0238660 A1 12/2004 Fan et al.
2005/0000015 A1 1/2005 Kaneko
2005/0087557 A1 4/2005 Oliver et al.
2005/0098968 A1 5/2005 Dyson et al.
2005/0199843 A1 9/2005 Jost et al.
2005/0205818 A1 9/2005 Bayley et al.
2006/0098961 A1 5/2006 Seutter et al.
2006/0101575 A1 5/2006 Louis
2006/0102642 A1 5/2006 Muntzing et al.
2006/0150316 A1 7/2006 Fukuizumi et al.
2006/0151513 A1 7/2006 Shadrach, III
2006/0185074 A1 8/2006 Loberger et al.
2006/0200903 A1 9/2006 Rodenbeck et al.
2006/0207019 A1 9/2006 Vincent
2006/0225200 A1 10/2006 Wierenga
2007/0023565 A1 2/2007 Babikian
2007/0079524 A1 4/2007 Sato et al.
2007/0094787 A1 5/2007 Hwang
2007/0144034 A1 6/2007 Kameishi
2007/0151338 A1 7/2007 Benner et al.
2007/0194637 A1 8/2007 Childe et al.
2007/0230839 A1 10/2007 Childe et al.
2007/0252551 A1 11/2007 Clothier et al.
2007/0261162 A1 11/2007 Atkinson
2007/0263994 A1 11/2007 Diez et al.
2007/0278983 A1 12/2007 Clothier et al.
2008/0005833 A1 1/2008 Bayley et al.
2008/0018995 A1 1/2008 Baun
2008/0072668 A1 3/2008 Miyagawa
2008/0078019 A1 4/2008 Allen, Jr. et al.
2008/0083786 A1 4/2008 Marin
2008/0098950 A1 5/2008 Gudjohnsen et al.
2008/0099088 A1 5/2008 Boey
2008/0109956 A1 5/2008 Bayley et al.
2008/0127410 A1 6/2008 Schmitt et al.
2008/0185396 A1 8/2008 Yang et al.
2008/0185398 A1 8/2008 Yang et al.
2008/0185399 A1 8/2008 Yang et al.
2008/0189850 A1 8/2008 Seggio et al.
2008/0193111 A1 8/2008 Seutter et al.
2008/0209760 A1 9/2008 French et al.
2008/0213644 A1 9/2008 Shindoh et al.
2008/0216343 A1 9/2008 Churchill et al.
2008/0216344 A1 9/2008 Churchill et al.
2008/0222910 A1 9/2008 Churchill et al.
2008/0253754 A1 10/2008 Rubin
2008/0256825 A1 10/2008 Hsu
2008/0271527 A1 11/2008 Hewitt
2008/0285134 A1 11/2008 Closset et al.
2008/0289098 A1 11/2008 Kunkel
2008/0301970 A1 12/2008 Hackwell et al.
2008/0313918 A1 12/2008 Dyson et al.
2008/0313919 A1 12/2008 Churchill et al.
2008/0317448 A1 12/2008 Brown et al.
2009/0000023 A1 1/2009 Wegelin et al.
2009/0000024 A1 1/2009 Louis et al.
2009/0000142 A1 1/2009 Churchill et al.
2009/0000147 A1 1/2009 Collins
2009/0031493 A1 2/2009 Tsujita et al.
2009/0034946 A1 2/2009 Caine et al.
2009/0049599 A1 2/2009 Parsons et al.
2009/0056011 A1 3/2009 Wolf et al.
2009/0058666 A1 3/2009 Clabaugh
2009/0069870 A1 3/2009 Haase et al.
2009/0077736 A1 3/2009 Loberger et al.
2009/0094740 A1 4/2009 Ji
2009/0100593 A1 4/2009 Lincoln et al.
2009/0113746 A1 5/2009 Churchill et al.
2009/0113748 A1 5/2009 Dyson et al.
2009/0119832 A1 5/2009 Conroy
2009/0119942 A1 5/2009 Aisenberg et al.
2009/0126103 A1 5/2009 Dietrich et al.
2009/0159612 A1 6/2009 Beavis et al.
2009/0236358 A1 9/2009 Rippl et al.
2009/0243243 A1 10/2009 Watson
2009/0266157 A1 10/2009 Maruo et al.
2009/0293190 A1 12/2009 Ringelstetter et al.
2009/0293192 A1 12/2009 Pons
2010/0014844 A1 1/2010 Dannenberg et al.
2010/0132112 A1 6/2010 Bayley et al.
2010/0139394 A1 6/2010 Pauer et al.
2010/0154239 A1 6/2010 Hutchinson
2010/0192399 A1 8/2010 Sawabe et al.
2010/0199759 A1 8/2010 Prasad

(56) References Cited

U.S. PATENT DOCUMENTS

| | | | |
|---|---|---|---|
| 2010/0236092 | A1 | 9/2010 | Causier |
| 2010/0276529 | A1 | 11/2010 | Nguyen |
| 2011/0023319 | A1 | 2/2011 | Fukaya et al. |

FOREIGN PATENT DOCUMENTS

| | | | |
|---|---|---|---|
| AU | 2006274708 | | 2/2007 |
| AU | 2006274715 | | 2/2007 |
| DE | 504089 | | 7/1930 |
| DE | 2018695 | | 10/1971 |
| DE | 2304815 | | 8/1974 |
| DE | 2657164 | A1 | 6/1978 |
| DE | 3036623 | | 2/1982 |
| DE | 4218658 | | 12/1992 |
| DE | 9304270 | | 9/1993 |
| DE | 9304160 | | 7/1994 |
| DE | 19608157 | | 7/1997 |
| DE | 10210474 | | 9/2002 |
| DE | 69821140 | | 11/2004 |
| DE | 202004012352 | U1 | 12/2004 |
| EP | 0274785 | | 7/1988 |
| EP | 1057942 | | 12/2000 |
| EP | 1241301 | | 9/2002 |
| EP | 1250878 | | 10/2002 |
| EP | 1258568 | | 11/2002 |
| EP | 1057441 | | 9/2006 |
| EP | 1912549 | | 3/2010 |
| EP | 2177142 | | 4/2010 |
| EP | 2277424 | | 1/2011 |
| GB | 737054 | | 9/1955 |
| GB | 909069 | | 10/1962 |
| GB | 2249026 | | 4/1992 |
| GB | 2428569 | | 2/2007 |
| JP | 49-037685 | | 7/1947 |
| JP | 1256632 | | 10/1989 |
| JP | 04-136195 | | 12/1992 |
| JP | 5163748 | A | 6/1993 |
| JP | 05-055988 | | 7/1993 |
| JP | 06-062977 | | 3/1994 |
| JP | 8-140891 | | 6/1996 |
| JP | 08164088 | | 6/1996 |
| JP | 08-196470 | | 8/1996 |
| JP | 9-056640 | | 3/1997 |
| JP | 9-135788 | | 5/1997 |
| JP | 9242155 | | 9/1997 |
| JP | 10-113304 | | 5/1998 |
| JP | 10-113305 | | 5/1998 |
| JP | 10-257992 | | 9/1998 |
| JP | 10248748 | A | 9/1998 |
| JP | 11-000283 | | 1/1999 |
| JP | 2000-157448 | | 6/2000 |
| JP | 2000-300461 | | 10/2000 |
| JP | 2000271039 | | 10/2000 |
| JP | 2000282528 | | 10/2000 |
| JP | 2001-104213 | | 4/2001 |
| JP | 2001140305 | A | 5/2001 |
| JP | 2002-136448 | | 5/2002 |
| JP | 2002-345682 | | 12/2002 |
| JP | 2003153823 | | 5/2003 |
| JP | 2004-261510 | | 9/2004 |
| JP | 2006-081925 | | 3/2006 |
| JP | 2006101987 | | 4/2006 |
| JP | 2006-192250 | | 7/2006 |
| JP | 2006-204738 | | 8/2006 |
| JP | 2006-304926 | | 11/2006 |
| JP | 2007054670 | | 3/2007 |
| JP | 2007-082904 | | 4/2007 |
| JP | 2007-098106 | | 4/2007 |
| JP | 2007082904 | A | 4/2007 |
| JP | 2008-005883 | | 1/2008 |
| JP | 2008-110240 | | 5/2008 |
| JP | 200899797 | A | 5/2008 |
| JP | 2008272086 | | 11/2008 |
| JP | 2010046238 | | 3/2010 |
| JP | 2010110450 | | 5/2010 |
| JP | 2011055859 | | 3/2011 |
| KR | 100711544 | | 4/2007 |
| WO | 9626795 | | 9/1996 |
| WO | WO 01/16436 | | 3/2001 |
| WO | WO 2006/055681 | | 5/2006 |
| WO | WO 2007/011747 | | 1/2007 |
| WO | WO 2007/015046 | | 2/2007 |
| WO | WO 2009/039290 | | 3/2009 |
| WO | WO 2009/062546 | | 5/2009 |
| WO | WO 2010/088975 | | 8/2010 |
| WO | WO 2010/089927 | | 8/2010 |
| WO | WO 2010/095250 | | 8/2010 |
| WO | WO 2010/095251 | | 8/2010 |
| WO | WO 2010/119536 | | 10/2010 |
| WO | WO 2011/009156 | | 1/2011 |
| WO | WO 2011/044247 | | 4/2011 |
| WO | WO 2011/077625 | | 6/2011 |

OTHER PUBLICATIONS

International Search Report and Written Opinion for International Application No. PCT/US2004/07675; date of mailing Aug. 6, 2004—(7 pages).

International Search Report and Written Opinion for International Application No. PCT/US2005/002194; date of mailing May 12, 2005—(9 pages).

International Search Report and Written Opinion for International Application No. PCT/US2008/076875; mailed on Jul. 6, 2009—(21 pages).

International Search Report and Written Opinion for International Application No. PCT/US2010/051647; mailed on Nov. 30, 2010—(11 pages).

LAVATORY SYSTEM

CROSS REFERENCE TO RELATED APPLICATIONS

This application claims the benefit of U.S. Provisional Application No. 60/994,580, filed Sep. 20, 2007, U.S. Provisional Application No. 61/028,852, filed Feb. 14, 2008, U.S. Provisional Application No. 61/046,319, filed Apr. 18, 2008, and U.S. NonProvisional patent application Ser. No. 12/223,466, filed on Sep. 18, 2008, all four of which are expressly incorporated herein by reference in their entireties.

FIELD OF THE INVENTION

The present invention relates to a lavatory system. More particularly, the present invention relates to a lavatory system with hand washing stations that can be positioned at a variety of heights relative to the floor.

BACKGROUND OF THE INVENTION

It is known to install a plurality of fixtures in a public, commercial or industrial, residential or non-residential environment such as a restroom. Such known fixtures include a lavatory system, towel dispensers, waste receptacles, hand-dryers, and the like. Lavatory systems typically include one or more stations that provide lavatory services to one or more users. Such known lavatory systems also typically include a countertop, a backsplash, one or more wash basins (with drains), accommodating one or more faucets, and are adopted for plumbing to be coupled to the faucets (and drains). In such known systems, the countertop is typically mounted to comply with the applicable accessibility regulations, such as Americans with Disabilities Act (ADA) Accessibility Guidelines for Buildings and Facilities and Uniform Accessibility Standards for Lavatories, or other standards (e.g., Texas Accessibility Standards or TAS).

However, such known lavatory systems typically require multiple custom designed and manufactured components, such as multiple lavatory systems for placement at the various heights.

BRIEF SUMMARY OF THE INVENTION

The present invention relates to a control system for a lavatory system including one or more integrated hand washing stations. Each hand washing station includes a basin, a faucet, a solenoid valve configured to control water flow to the faucet, and a electric hand dryer located adjacent the basin and the faucet so that the user of the washing station may use the faucet and the electric hand dryer without leaving the washing station. The electric hand dryers include an outlet to direct air across the associated basin so that any water that drips from the user's hands will fall within the basin. The control system configured to control activation of the solenoid valve and the electric hand dryer, wherein the control system is configured to inhibit simultaneous activation of the solenoid valve and the hand dryer. For example, the control system may be configured to prevent activation of the electric hand dryer when the solenoid valve has been activated; prevent activation of a soap dispenser when the solenoid valve and/or the hand dryer has been activated. The activation of the various fixtures may be according to a predetermined timing and sequence (e.g., an algorithm that activates fixtures based on sensed conditions or other factors). The control system may be in communication with a single sensor dedicated (directed) to each wash station that is configured to sense the presence of the user's hands near the hand washing station. Alternatively, each wash station may include a sensor to detect the presence of a hand of the user proximate that station's faucet, another sensor to detect the user's hand proximate that station's soap dispenser, and/or another sensor to detect the presence of a hand of the user proximate that station's electric hand dryer, wherein the control system activates the solenoid valve and the hand dryer based on signals received from the first sensor and second sensor according to a predetermined timing and sequence.

Another embodiment of the present invention relates to a lavatory system powered by renewable energy to provide hand washing functionality to a plurality of users. The lavatory system includes a base configured to at least partially enclose plumbing and a panel configured to articulate coupled to the base and movable between a closed position and an opened position. The panel prevents access to the interior portion of the base in the closed position and permits access to the interior portion of the base in the opened position. The lavatory system further includes a photovoltaic system having an energy storage element and an array of photovoltaic cells coupled to the panel and coupled to the energy storage element. The lavatory system includes a first hand washing station. The first hand washing station includes a first basin positioned at a first height, a first faucet, a first solenoid valve configured to control water flow to the first faucet, and a first electric hand dryer located adjacent the first basin and the first faucet so that the user of the first washing station may use the first faucet and the first electric hand dryer without leaving the first washing station. The lavatory system also includes a second hand washing station. The second hand washing station includes a second basin positioned at a second height different from the first height of the first basin, a second faucet, a second solenoid valve configured to control water flow to the second faucet, and a second electric hand dryer located adjacent the second basin and the second faucet so that the user of the second hand washing station may use the second faucet the second electric hand dryer without leaving the second washing station. The photovoltaic system provides power to the first valve and the second valve.

Another embodiment of the present invention relates to a lavatory system capable of providing simultaneous hand washing functionality to a plurality of users. The lavatory system includes a base at least partially enclosing plumbing and configured to be coupled to a wall when installed. The lavatory system also includes a first integrated hand washing station coupled to the base. The first integrated hand washing station includes a first basin having a front top edge located at a first height above the floor, a first faucet configured to direct water into the first basin, a first soap dispenser, and a first electric hand dryer. The first faucet, the first soap dispenser, and the first electric hand dryer are located adjacent the first basin so that a user of the first washing station may use the first faucet, the first soap dispenser, and/or the first electric hand dryer without leaving the first washing station. The lavatory system also includes a second integrated hand washing station coupled to the base and spaced apart from the first integrated hand washing station. The second integrated hand washing station includes a second basin having a front top edge located at a second height above the floor, the second height of the second basin being different from the first height of the first basin, a second faucet configured to direct water into the second basin, a second soap dispenser, and a second electric hand dryer. The second faucet, the second soap dispenser, and the second electric hand dryer are located adjacent the second basin so that a user of the second washing station may use the second faucet, the second soap dispenser, and/or the second electric hand dryer without leaving the second washing station.

Another embodiment of the present invention relates to a modular lavatory system configured to be coupled to a wall. The lavatory system includes a first hand washing station, a second hand washing station, and a mounting system configured to couple the first hand washing station and the second hand washing station to the wall. The mounting system includes a first track mountable to the wall, a first mounting frame coupled to the first hand washing station and configured to engage the first track to mount the first hand washing station at a first height, and a second mounting frame coupled to the second hand washing station and configured to engage the first track to mount the second hand washing station at a second height different than the first height.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the invention described herein.

BRIEF DESCRIPTION OF THE DRAWINGS

The drawings illustrate the best mode currently contemplated of practicing the present invention.

In the drawings:

FIG. 31 is a front perspective view of a lavatory system including two hand washing stations according to an exemplary embodiment.

DETAILED DESCRIPTION

Figure 1:
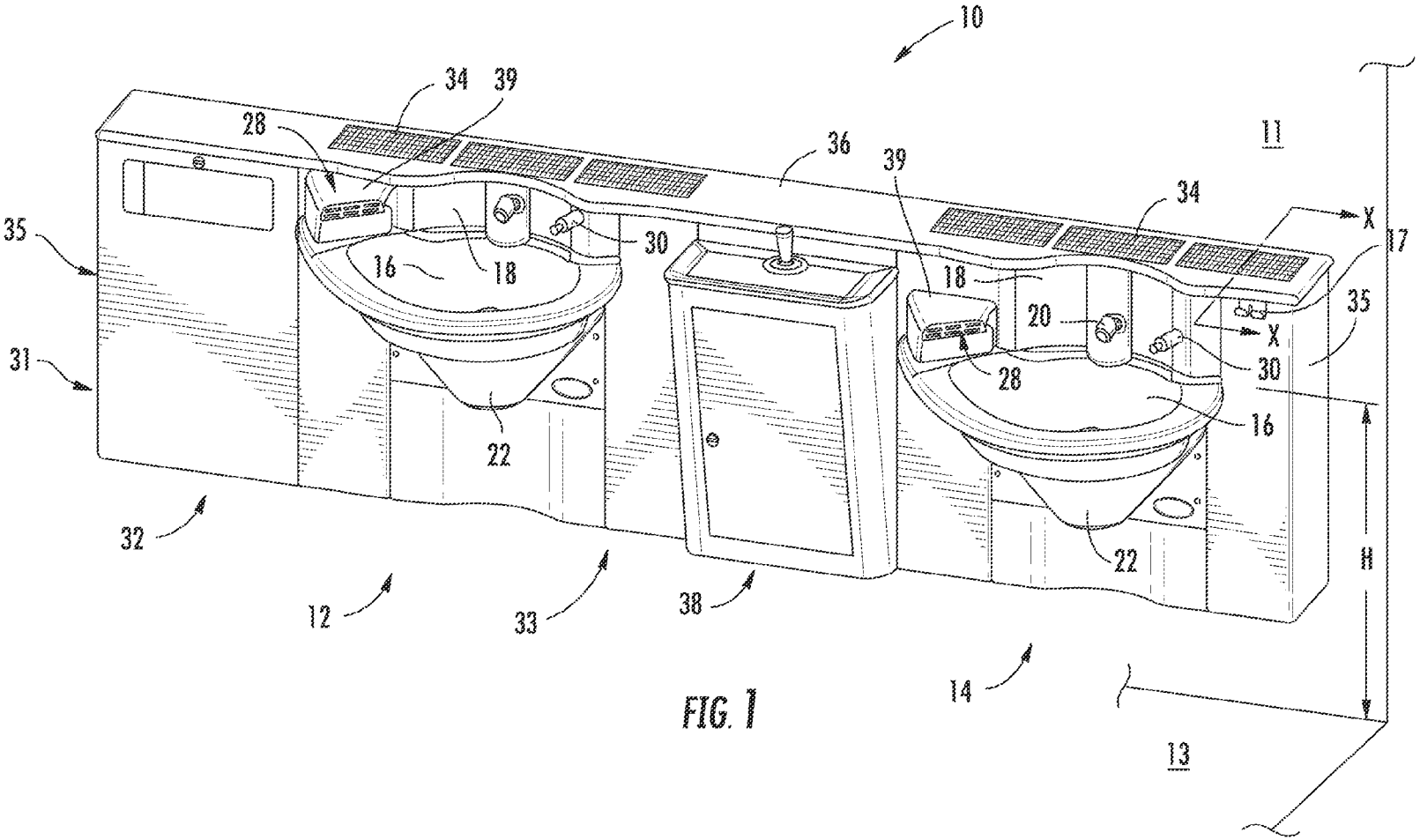
FIG. 1 is a front perspective view of a lavatory system according to an exemplary embodiment.

With reference now to the drawing figures in which like reference numerals designate like parts throughout the disclosure.

FIGS. 1 through 12 show a lavatory system 10 according to another exemplary embodiment. The embodiments illustrated in FIGS. 1 through 12 may be configured to be supported by an adjacent wall 11 (as shown) or may be a free-standing structure configured to be supported by a base (e.g., legs, pedestal, vanity, etc.).

Figure 9:
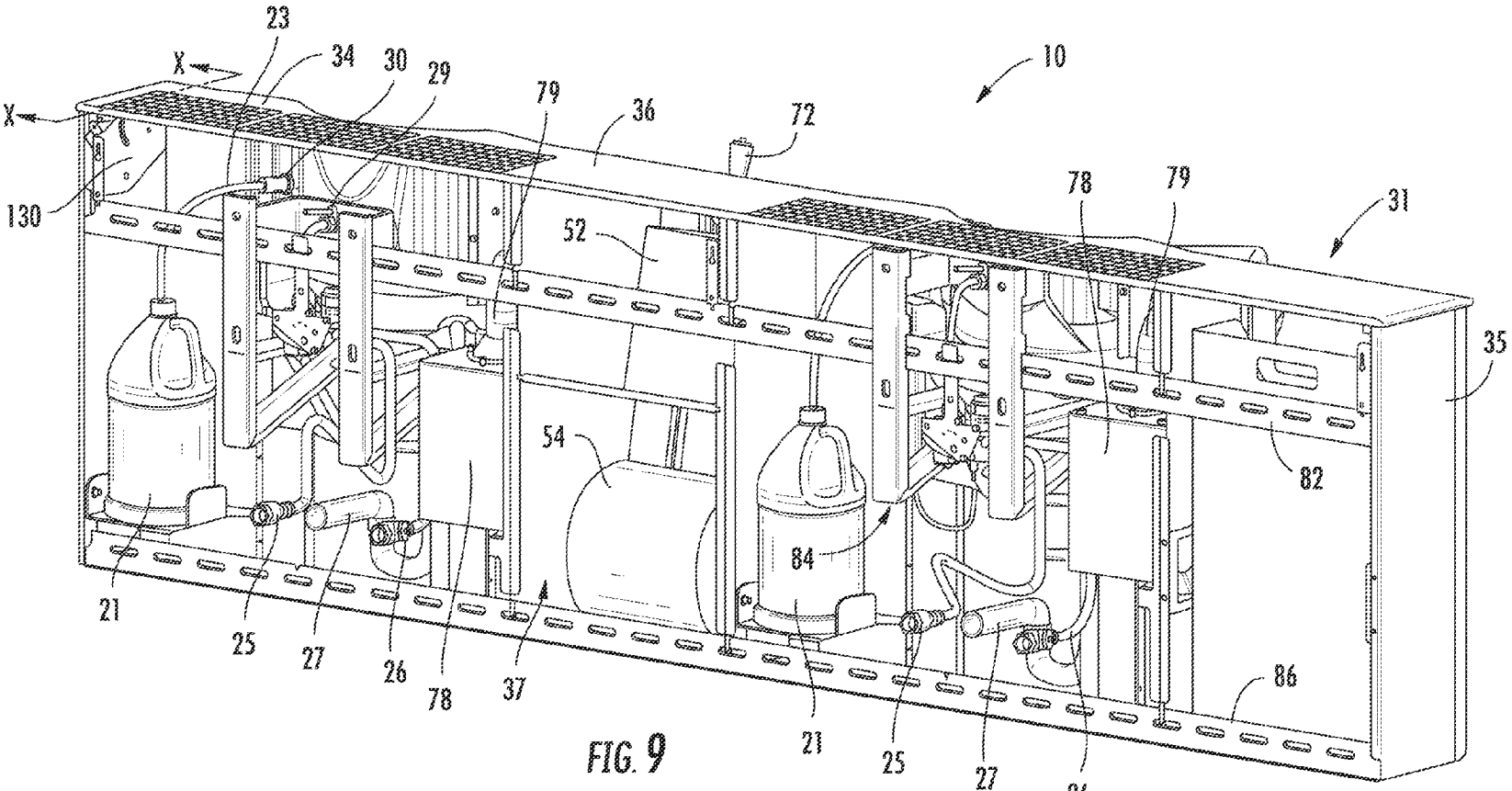
FIG. 9 is a rear perspective view of the lavatory system of FIG. 1 according to an exemplary embodiment.
Figure 39:
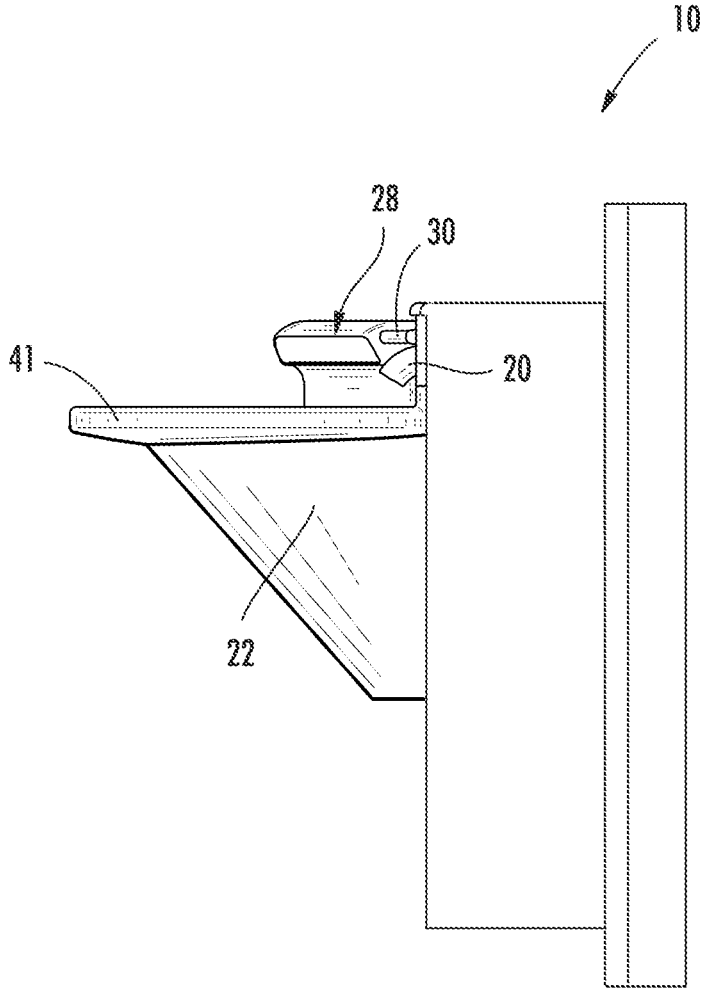
FIG. 39 is a right side view of the lavatory system of FIG. 36.
Figure 40:
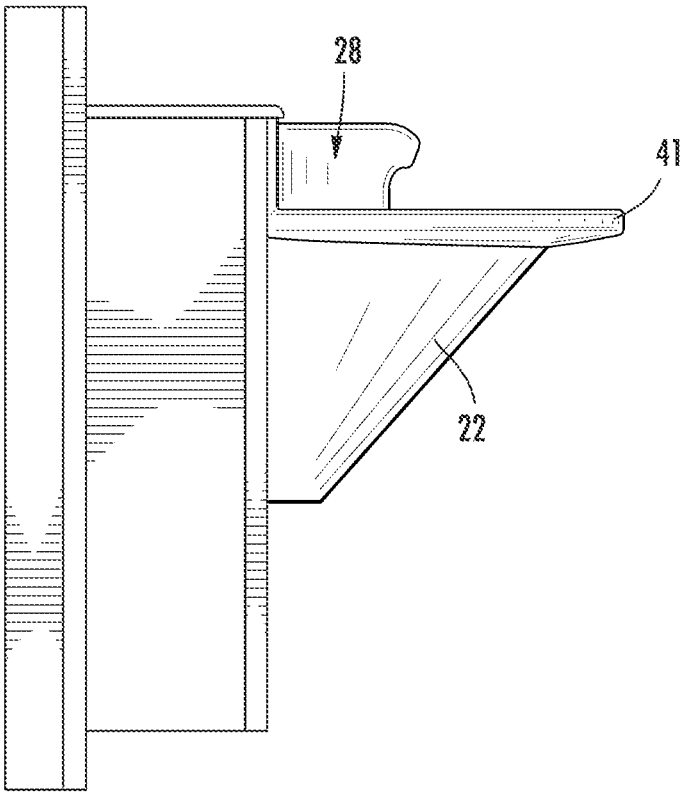
FIG. 40 is a left side view of the lavatory system of FIG. 36.
Figure 41:
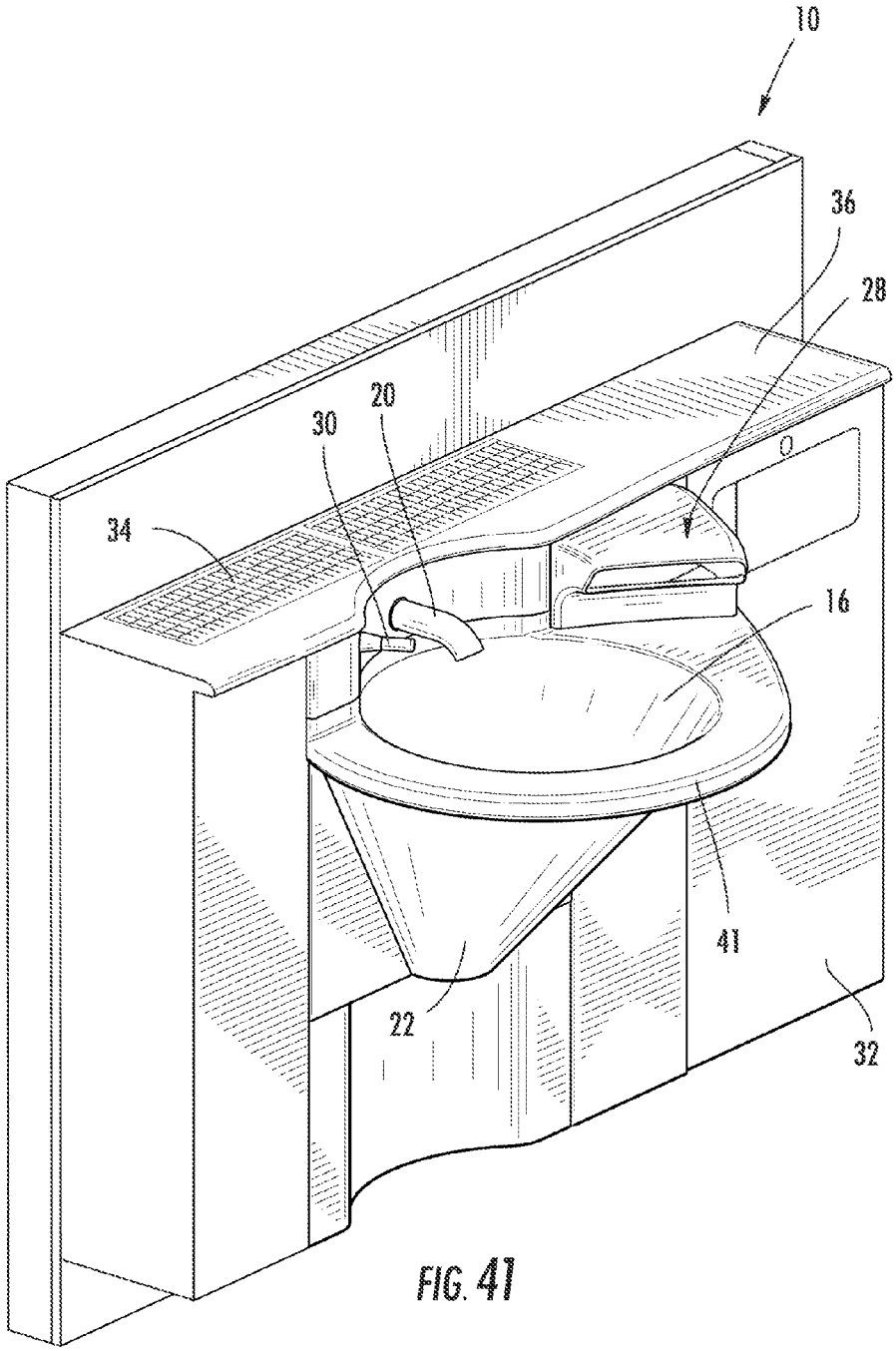
FIG. 41 is a front perspective view of a lavatory system according to an exemplary embodiment.
Figure 42:
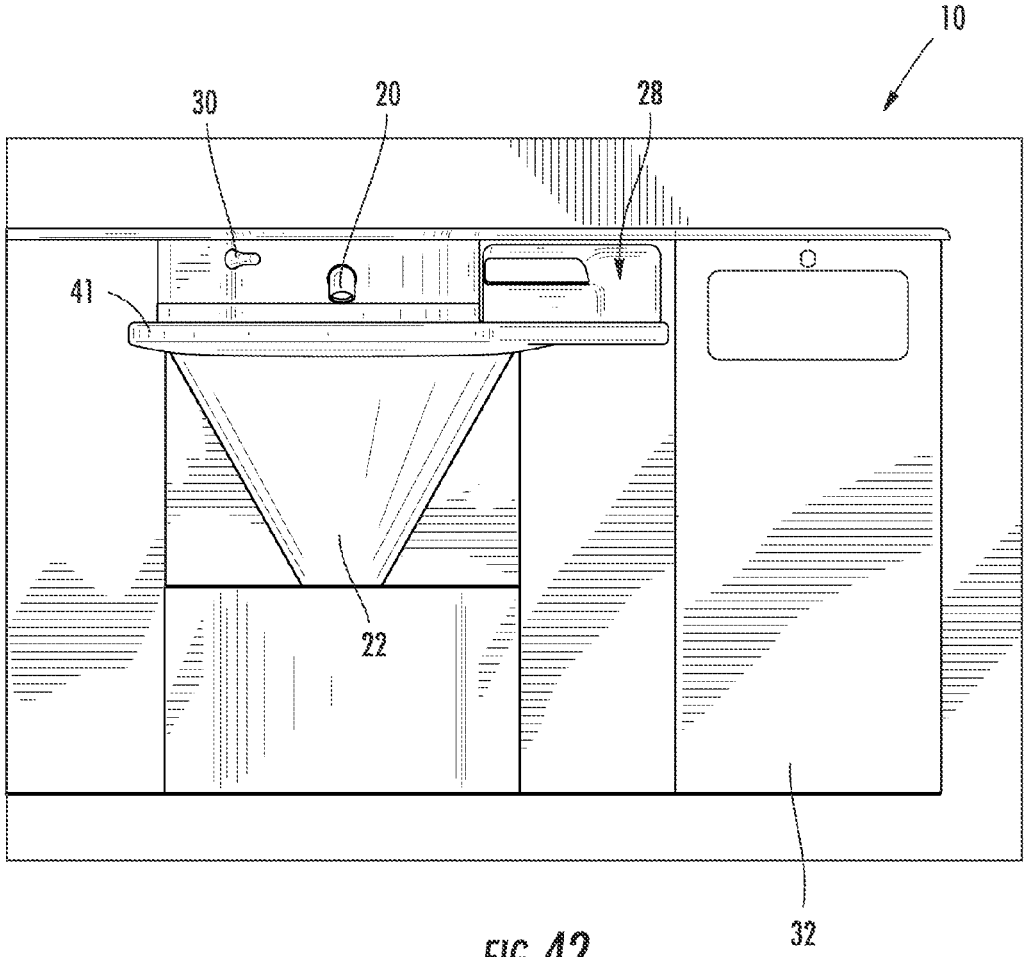
FIG. 42 is a front side view of the lavatory system of FIG. 41
Figure 43:
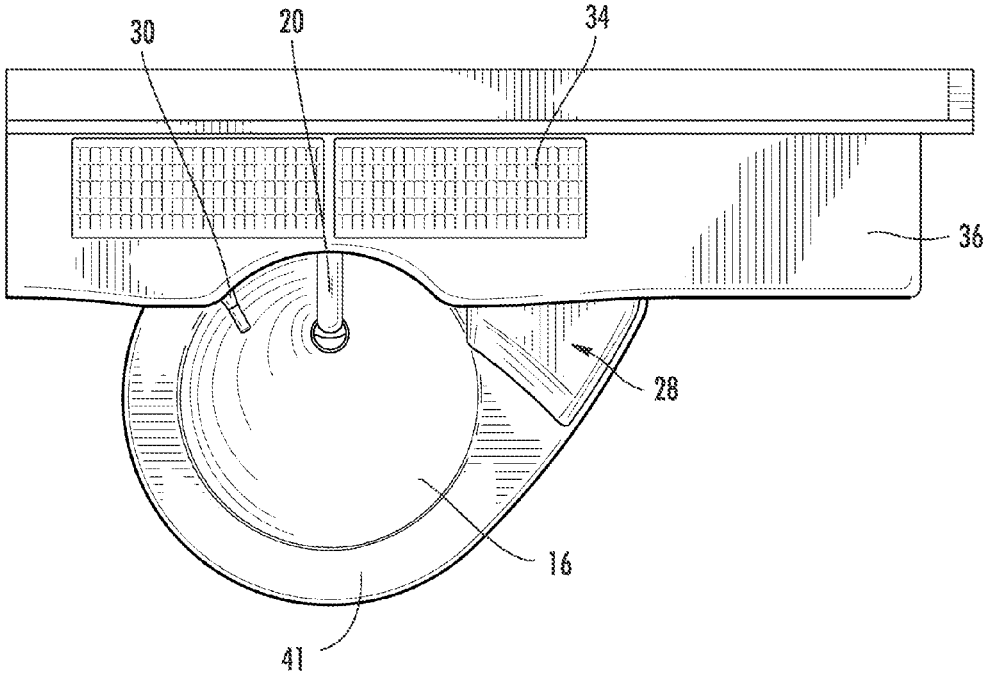
FIG. 43 is a top view of the lavatory system of FIG. 41.
Figure 44:
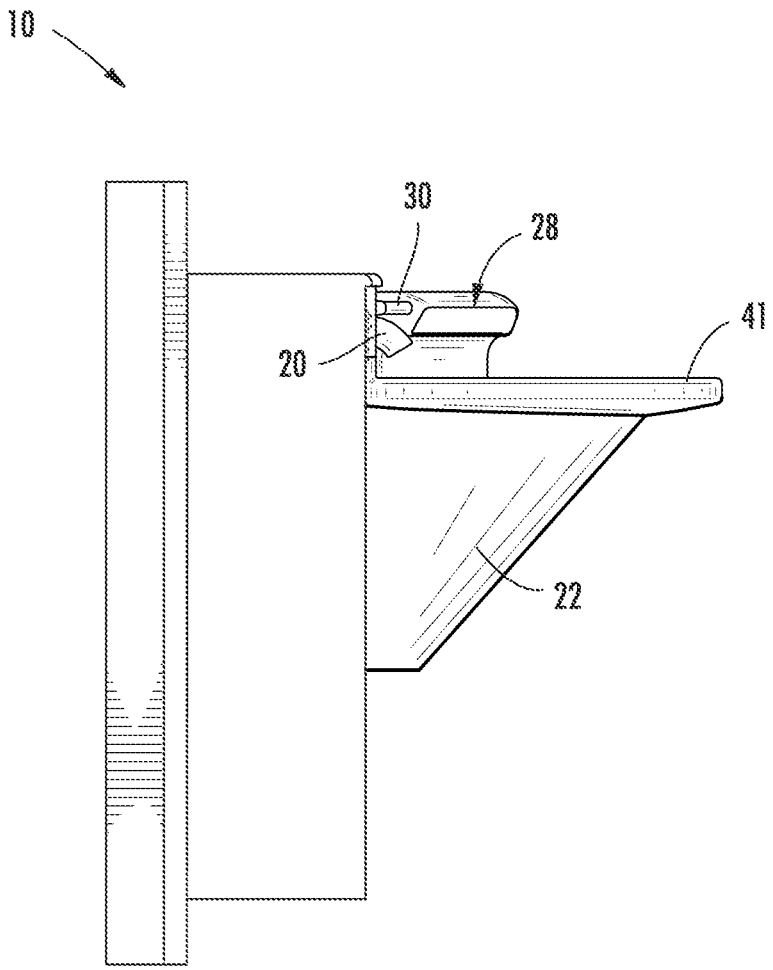
FIG. 44 is a left side view of the lavatory system of FIG. 41.
Figure 45:
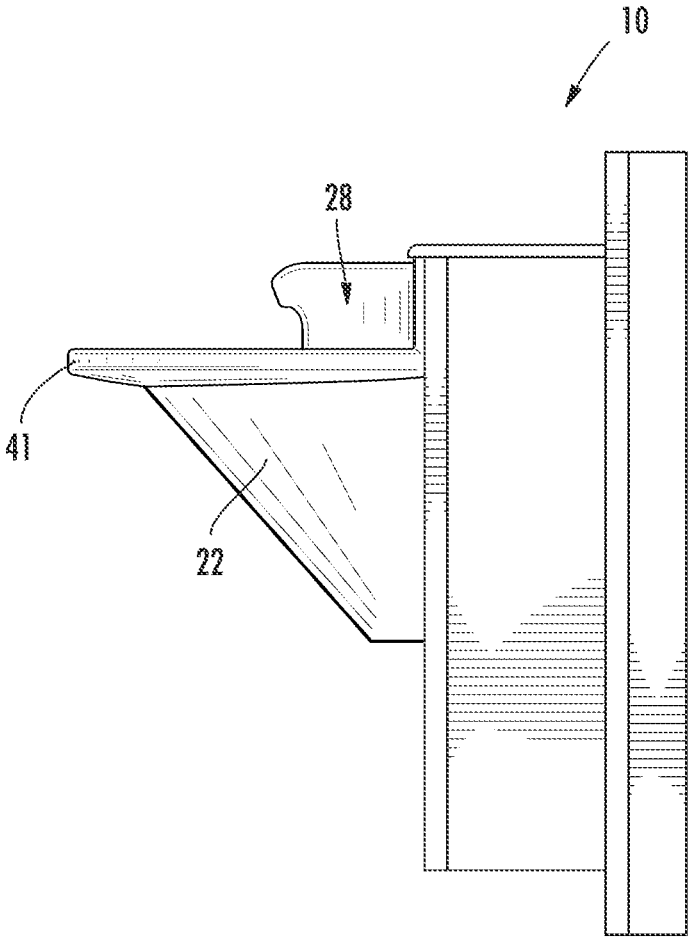
FIG. 45 is a right side view of the lavatory system of FIG. 41.
Figure 46:
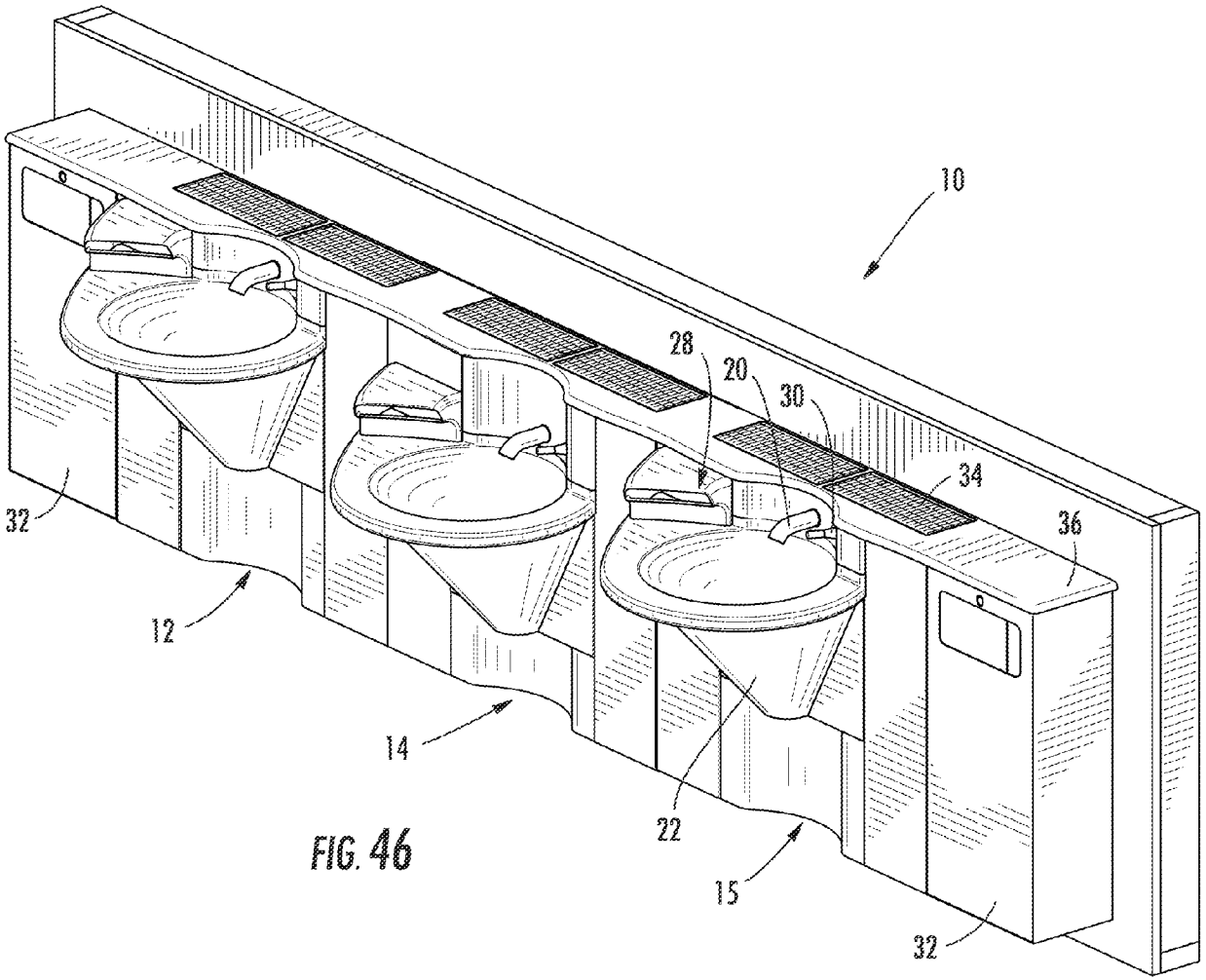
FIG. 46 is a front perspective view of a lavatory system according to an exemplary embodiment.
Figure 47:
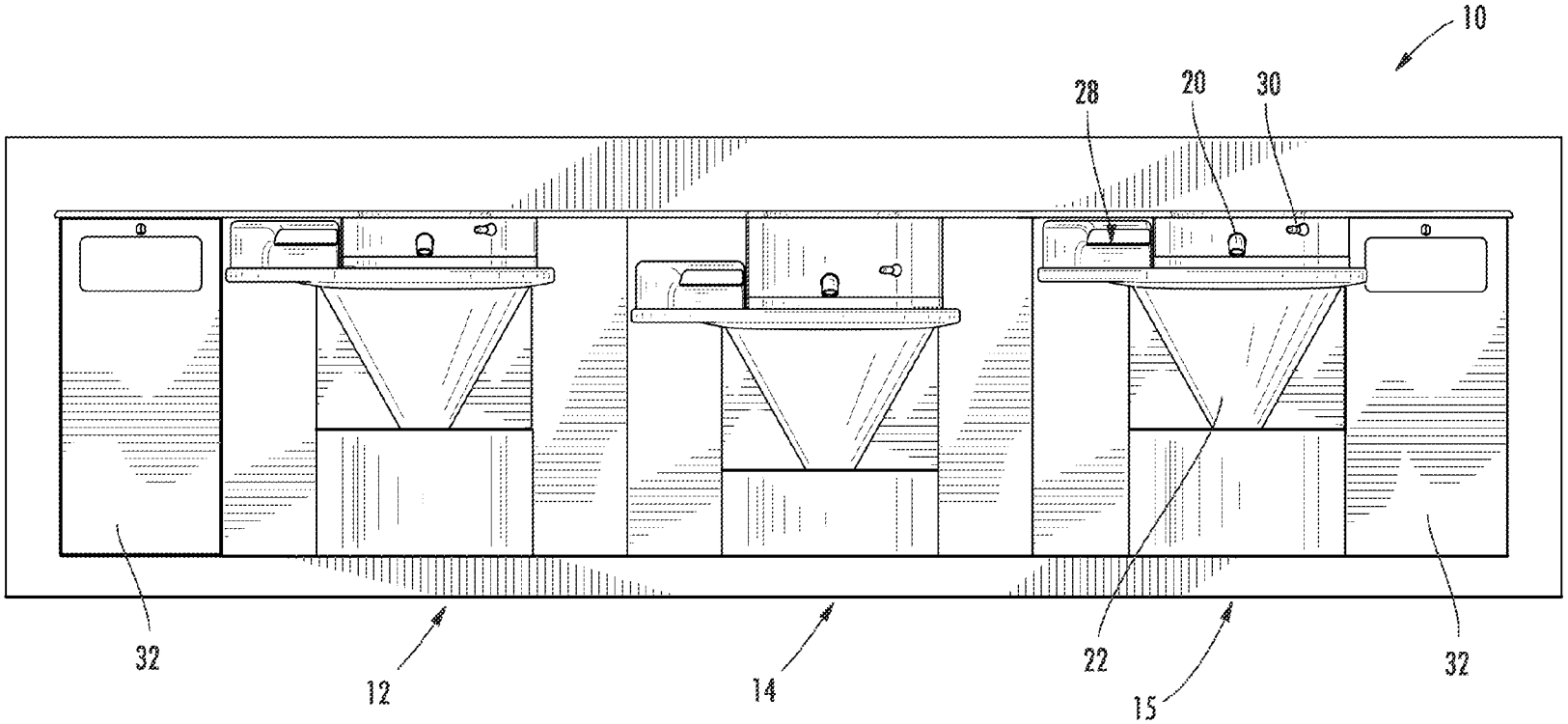
FIG. 47 is a front side view of the lavatory system of FIG. 46.
Figure 48:
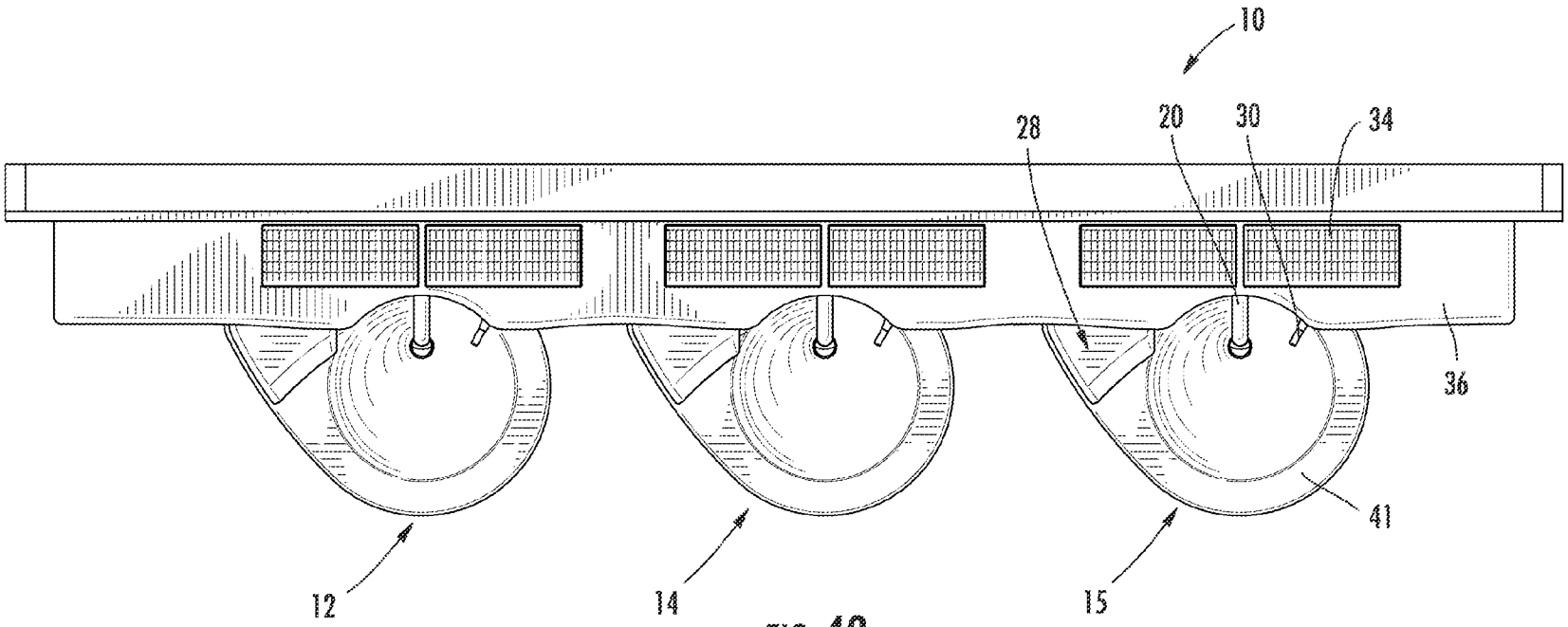
FIG. 48 is a top view of the lavatory system of FIG. 46.
Figure 49:
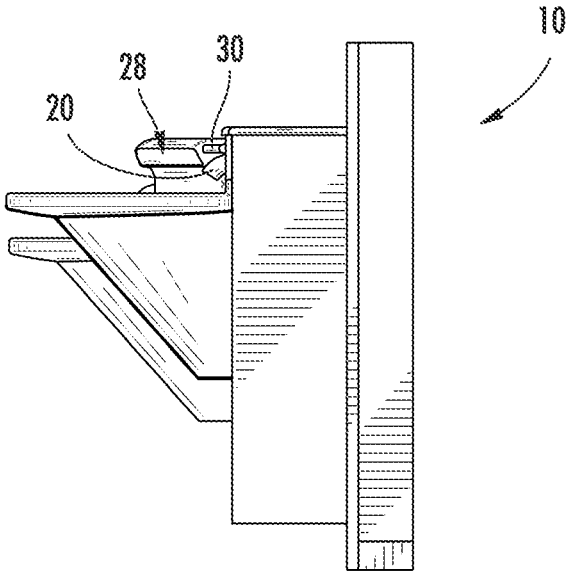
FIG. 49 is a right side view of the lavatory system of FIG. 46.
Figure 50:
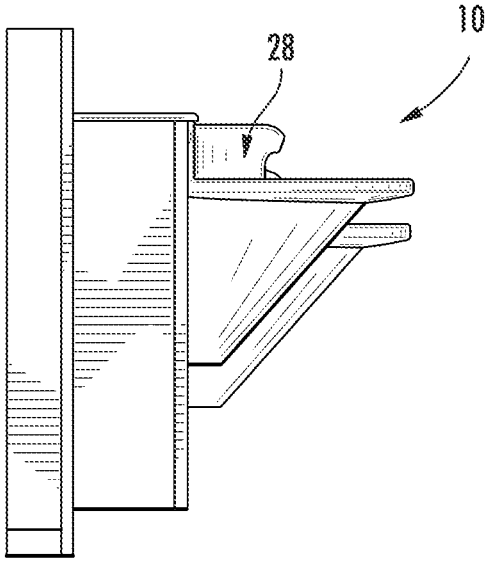
FIG. 50 is a left side view of the lavatory system of FIG. 46.

According to the embodiment illustrated, lavatory system 10 includes two washing stations (e.g., hand washing stations), shown as a first or upper station 12 and a second or lower station 14, mounted to a base (e.g., housing, cabinet, etc.). Alternatively, the lavatory system may include any number of washing stations (e.g., one, three, four, or more) arranged in any of a variety of configurations (e.g., all upper stations, all lower stations, mixed upper/lower stations, etc. set at a variety of upper/lower patterns, heights ("H" in FIG. 39), or sequences). Each hand washing station generally includes a sink 16 (e.g., bowl, basin, receptacle, etc.), a backsplash 18 at least partially surrounding each sink 16, hand washing fixtures 20 (e.g., faucet, soap dispenser, etc.) associated with each sink 16, a trap cover 22 supported under the sink for at least partially concealing plumbing (e.g., water supply, drain, etc. as shown in FIG. 9) associated with the station, a hand drying fixture (e.g., electric hand dryer, towel dispenser, etc.), shown as hand dryer 28, and a liquid soap dispenser 30. As shown in FIG. 1, hand dryer 28 includes a nozzle or air outlet 39 to direct air onto a user's hands to aid in drying. Lavatory system 10 may also include a hook 17 to allow the user of the lavatory system to hang a personal item (e.g., purse, coat, hat, backpack, etc.) so that the user's hands are free for hand washing, drying, etc.

Upper station 12 and lower station 14 may be configured to have different heights to accommodate persons having varying abilities or characteristics for using a lavatory system (e.g., disabled, tall, short, etc.). In one embodiment, upper station 12 has a height (e.g., the distance from the floor to the upper surface of the counter surrounding the basin) that is greater than 34 inches (e.g., about 36 inches) and lower station 14 has a height that is about 34 inches to accommodate an adult user in a wheelchair. In another embodiment, lower station 14 has a height that is about 31 inches to accommodate a juvenile user in a wheelchair. In another embodiment, lower station 14 has a height that is less than 31 inches (e.g., about 28 inches). In another embodiment, upper station 12 has a height that is about 34 inches, and lower station 14 has a height that is about 31 inches. In other embodiments, lavatory system 10 may include any number of hand washing stations (e.g., 3, 4, 5, etc.), each hand washing station located at one of the heights discussed above.

The embodiment illustrated further includes a housing 31. Housing 31 includes a shelf or platform (shown as a panel 36) located above the other components of the washing stations, a front portion 33, and side portions 35. Housing 31 generally defines an interior portion 37 of lavatory system 10 (shown in FIGS. 4 and 9). Lavatory system 10 further includes a waste receptacle 32 adjacent to upper station 12, a plurality of photovoltaic cells 34 mounted on panel 36, a power management system, and a towel dispenser 38.

Preferably, the one or more of the fixtures are "touchless", meaning that a user can operate the fixtures without physically contacting the fixtures and/or an interface coupled to the fixtures (i.e., "hands-free" operation). In this manner, the lavatory system is intended to overcome sanitation and/or accessibility limitations often associated with many conventional fixtures. The control system monitors a defined sensing region (an area adequately proximate to the fixtures in which a user of the fixture is likely to be positioned) for the presence of an object (e.g., a user, the user's hand, etc.) and controls the operation of the fixtures accordingly. The control system includes a power supply system, a detection system, and a fixture actuation system. In one embodiment, each washing station includes one or more sensors 29 (rear portion of one sensor 29 is shown in FIG. 9) that allows the user to activate one or more fixture (e.g., hand washing fixture 20, hand dryer 28, and/or soap dispenser 30) without touching any part of lavatory system 10 (i.e., sensor 29 provides for "hands free" operation of various portions of lavatory system 10). In one embodiment, each hand washing station includes a single sensor 29 configured to allow the user to operate all of the fixtures located at a single hand washing station. In another embodiment, each hand washing station includes a dedicated sensor 29 for each fixture associated with the sensor (e.g., a first sensor for hand washing fixture 20, a second sensor for hand dryer 28, and a third sensor for soap dispenser 30). Sensor 29 may be any device that allows for hand free operation of one or more fixtures. For example, sensors 29 may be infrared sensors, capacitive sensors, proximity sensors, or the like.

According to an exemplary embodiment, the lavatory system 10 is configured to inhibit or prevent inadvertent activation of one or more fixtures (e.g., faucets 20, soap dispensers 30, hand dryers 28, etc.). According to an exemplary embodiment, lavatory system 10 includes a control system to control the operation and activation of the various fixtures (e.g., faucets 20, soap dispensers 30, hand dryers 28, etc.) via user interaction with sensors 29. Since the fixtures are integrated and located around basin 16 at each wash station, it is preferred that the fixtures are not inadvertently activated during use of other fixtures. The control system includes one or more sensors 29, as discussed above, in communication with a control circuit (e.g., controller, processor, etc.), which is in communication with the fixtures. The control circuit may be configured (e.g., hardwired, programmed, etc.) to allow activation of only one fixture at a time, allow activation of certain two fixtures at a time (e.g., faucet and soap dispenser), or sequence the fixture activation at predetermined or calculated times and intervals. In addition, the control circuit may be configured to turn off one or more of the fixtures (e.g., the faucet and/or the soap dispenser) when another of the fixtures is activated (e.g., the hand dryer). For example, a flow sensor that detects the flow of water through faucet 20 can be used to disconnect the power from hand dryer 28. Alternatively, the sensor 29 associated with hand dryer 28 communicates with the faucet sensor using signals through optoisolators to activate and deactivate hand dryer 28. This communication may allow the control circuit to prevent the activation of faucet 20 and/or soap dispenser 30 when hand dryer 28 has been activated. Alternatively, there is no control interaction among the fixtures (i.e., independent operation). The sensors may be directed to provide a sensed area or zone that does not overlap with the sensed zones for other fixtures.

Figure 51B:
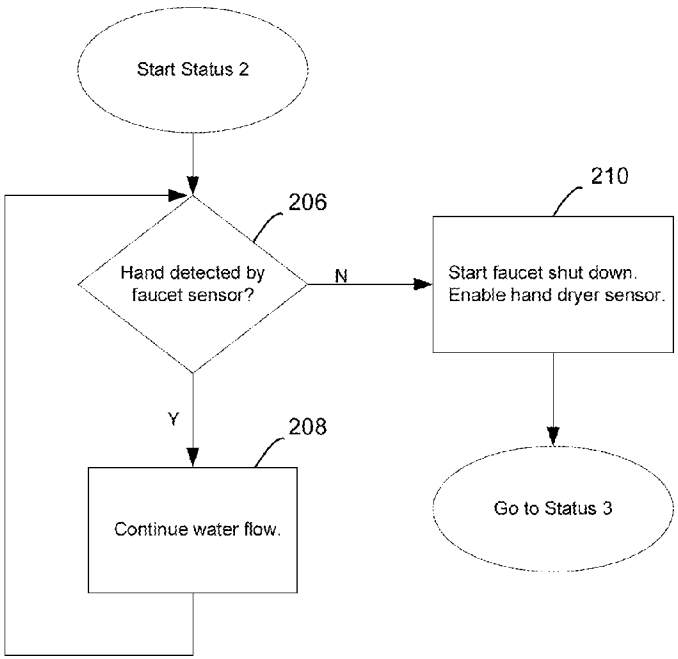
FIGS. 51A-51C are flow diagrams for a process of controlling a lavatory system according to an exemplary embodiment.
Figure 51A:
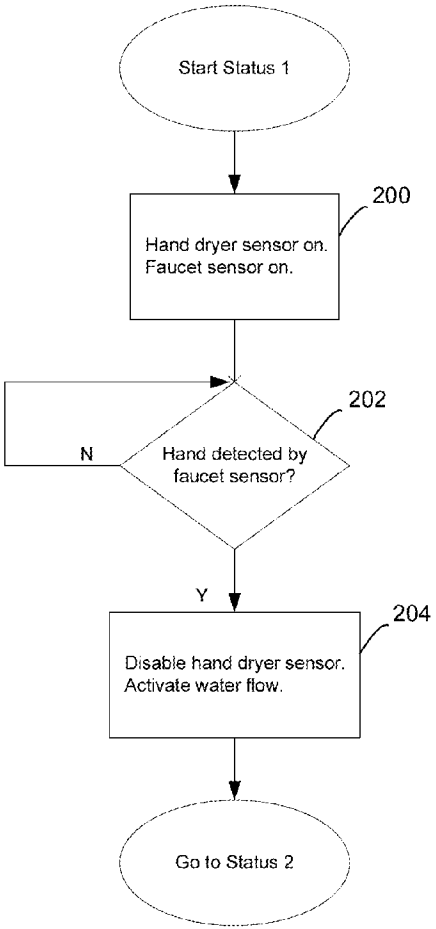
Figure 51C:
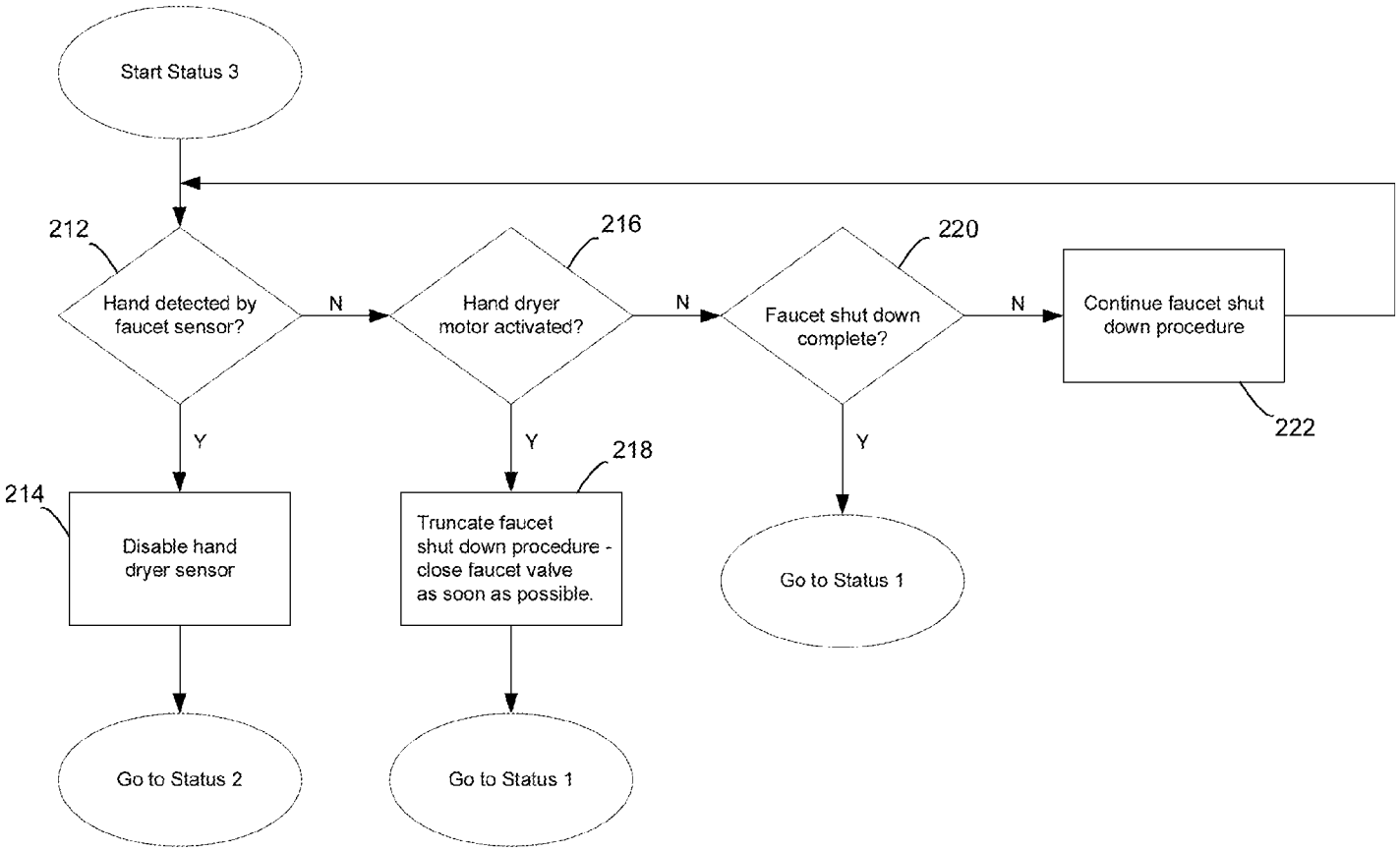

FIGS. 51A-51C are flow charts showing the control of a faucet 20 and a hand dryer 28 by a control system according to an exemplary embodiment. Referring to FIG. 51A, at step 200 a sensor 29 associated with hand dryer 28 is turned on and a sensor 29 associated with faucet 20 (i.e., a faucet sensor) is turned on. At step 202, the control system receives an input signal from the faucet sensor to detect the presence of a user's hand near faucet 20. If the signal received from the faucet sensor indicates that a user's hand is not near faucet 20, step 202 repeats until the signal received from the faucet sensor indicates that a user's hand is present near faucet 20. In one embodiment, during step 202 the control system tests for the presence of a user's hand every 0.25 seconds. At step 204, the control system disables the sensor 29 associated with hand dryer 28 and activates the flow of water through faucet 20 when the signal received from the faucet sensor indicates that a user's hand is present near faucet 20.

Referring to FIG. 51B, after step 204 is performed, the control system proceeds to perform step 206. At step 206, the control system continues to receive a signal from the faucet sensor. If the signal from the faucet sensor continues to indicate the presence of a user's hands near faucet 20, the control system continues to allow water to flow from faucet 20 during step 208. If the signal from the faucet sensor indicates the user's hands are no longer near faucet 20, the control system begins a shutdown (e.g., a timeout) procedure at step 210 to stop water from flowing through faucet 20 by the end of the shutdown procedure. Also during step 210, the control system enables (e.g., turns on) the sensor 29 associated with hand dryer 28. In one embodiment, the control system performs step 210 if the faucet sensor fails to detect the presence of a user's hands for more than 0.5 seconds.

FIG. 51C is a flow chart showing operation of the control system during the faucet shutdown procedure initiated at step 210. At step 212, the control system receives a signal from the faucet sensor to detect the presence of a user's hand near faucet 20. If the signal received from the faucet sensor indicates that a user's hand is present near faucet 20, at step 214 the control system disables the sensor 29 associated with hand dryer 28 and returns to step 206 shown in FIG. 51B. This allows the control system to end the shutdown procedure that was initiated during step 210 to allow water to continue to flow from faucet 20. If during step 212, the signal received from the faucet sensor indicates that a user's hand is not near faucet 20, step 216 is performed.

At step 216, the control system determines if the motor of hand dryer 28 is active. In one embodiment, the motor of hand dryer 28 may be activated by the sensor 29 associated with hand dryer 28 detecting the presence of a user's hand near hand dryer 28. In another embodiment, the motor of hand dryer 28 may be activated by other means such as by manual activation by a user via a switch or button. If, during step 216, the control system determines that the motor of hand dryer 28 is active, the control system proceeds to step 218. During step 218, the control system closes the valve associated with faucet 20 to stop water from flowing through faucet 20 as quickly as possible. Thus, during step 218, the faucet shutdown procedure initiated during step 210 is truncated or shortened when the user of lavatory system 10 switches from using faucet 20 to using hand dryer 28. However, if during step 216, the control system determines that the motor of hand dryer 28 is not active, the control system proceeds to step 220. At step 220, the control system detects whether the faucet shutdown procedure is complete. If the faucet shutdown procedure is complete, the control system returns to step 200. If the faucet shutdown procedure is not complete, at step 222 the faucet shutdown procedure is continued by returning to step 212. Steps 212 through 222 are repeated until faucet shutdown is complete.

According to an exemplary embodiment, the lavatory system includes one or more integrated hand washing stations. Each hand washing station includes a basin, a faucet, a solenoid valve configured to control water flow to the faucet, and a electric hand dryer located adjacent the basin and the faucet so that the user of the washing station may use the faucet and the electric hand dryer without leaving the washing station. The electric hand dryers include an outlet to direct air across the associated basin so that any water that drips from the user's hands will fall within the basin. The system further includes a control system configured to control activation of the solenoid valve and the electric hand dryer, wherein the control system is configured to inhibit simultaneous activation of the solenoid valve and the hand dryer. For example, the control system may be configured to prevent activation of the electric hand dryer when the solenoid valve has been activated; prevent activation of a soap dispenser when the solenoid valve and/or the hand dryer has been activated. The activation of the various fixtures may be according to a predetermined timing and sequence (e.g., an algorithm that activates fixtures based on sensed conditions or other factors). The control system may be in communication with a single sensor dedicated (directed) to each wash station that is configured to sense the presence of the user's hands near the hand washing station. Alternatively, each wash station may include a sensor to detect the presence of a hand of the user proximate that station's faucet, another sensor to detect the user's hand proximate that station's soap dispenser, and/or another sensor to detect the presence of a hand of the user proximate that station's electric hand dryer, wherein the control system activates the solenoid valve and the hand dryer based on signals received from the first sensor and second sensor according to a predetermined timing and sequence.

Referring further to FIGS. 1-4, tower dispenser 38 is shown mounted between two hand washing stations 12, 14. Towel dispenser 38 includes a housing 40, an access panel 42 (e.g., door), an upper surface or shelf 44, and a lower surface or shelf 46.

Housing 40 has generally vertical sides 48, an angled front panel or front side 50 and is configured to contain a paper towel roll 52 being dispensed as well as additional storage for extra paper towel rolls 54 or other supplies. Angled front side 50 has a top portion that extends further from wall 11 than the bottom portion of front side 50. Angled front side 50 is intended to provide an aesthetic appearance consistent with other design aspects of lavatory system 10 as well as additional clearance for users in wheelchairs or having other needs. Access panel 42 allows access (visual and/or physical) to the interior of towel dispenser 38, and is coupled to the housing by a hinge 56 and a lock 58.

Figure 4:
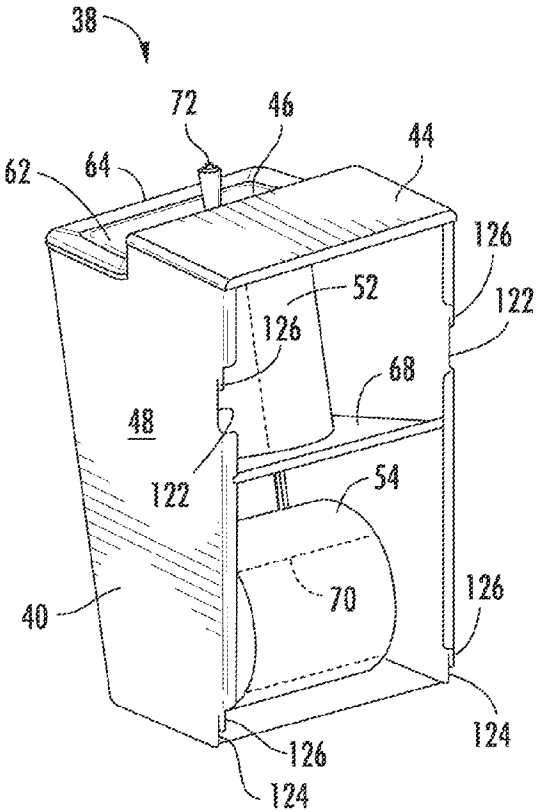
FIG. 4 is a rear perspective view of the towel dispenser of the lavatory system of FIG. 1.
Figure 3:
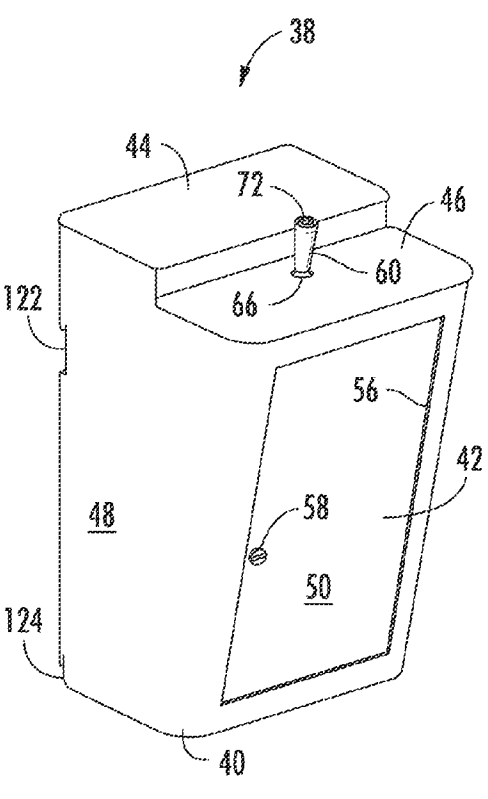
FIG. 3 is a front perspective view of a towel dispenser according to another embodiment.
Figure 2:
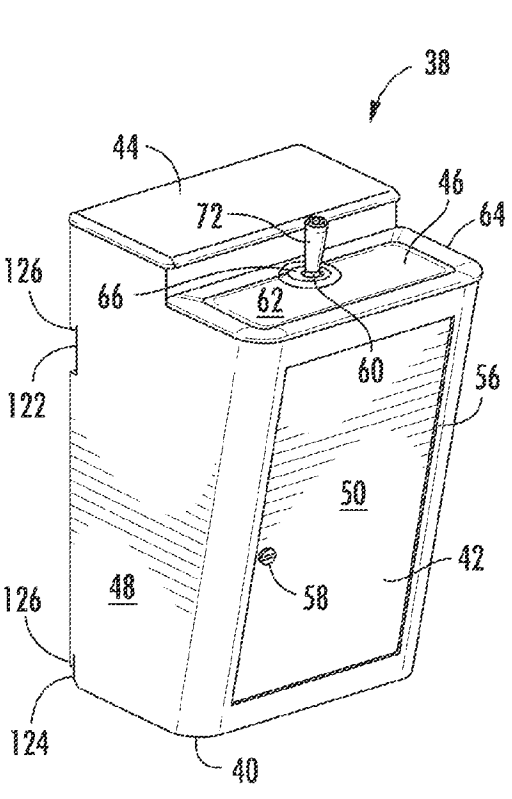
FIG. 2 is a front perspective view of the towel dispenser of the lavatory system of FIG. 1.
Figure 5:
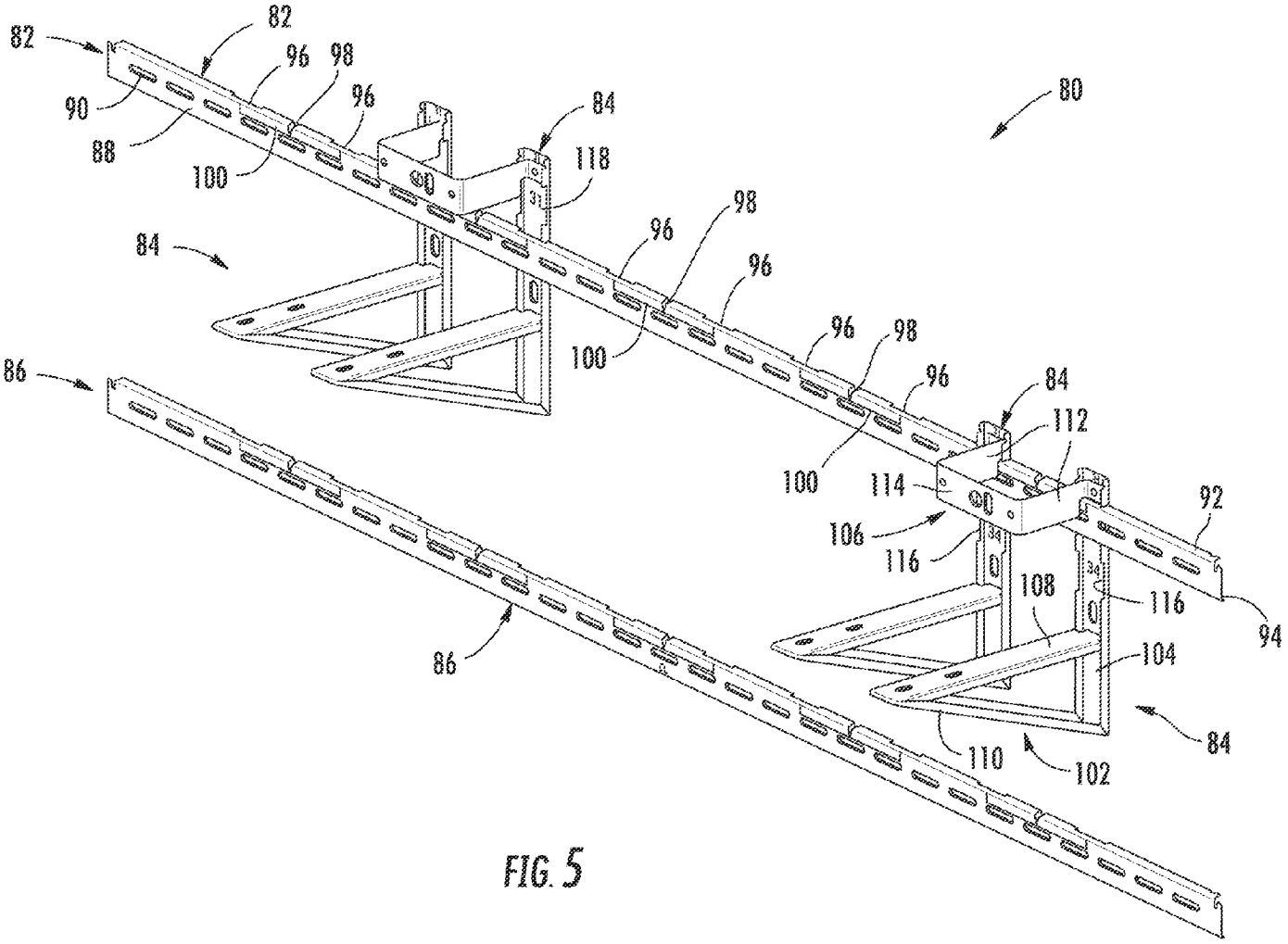
FIG. 5 is a front perspective view of a mounting system for use with the lavatory system of FIG. 1 according to an exemplary embodiment.
Figure 6:
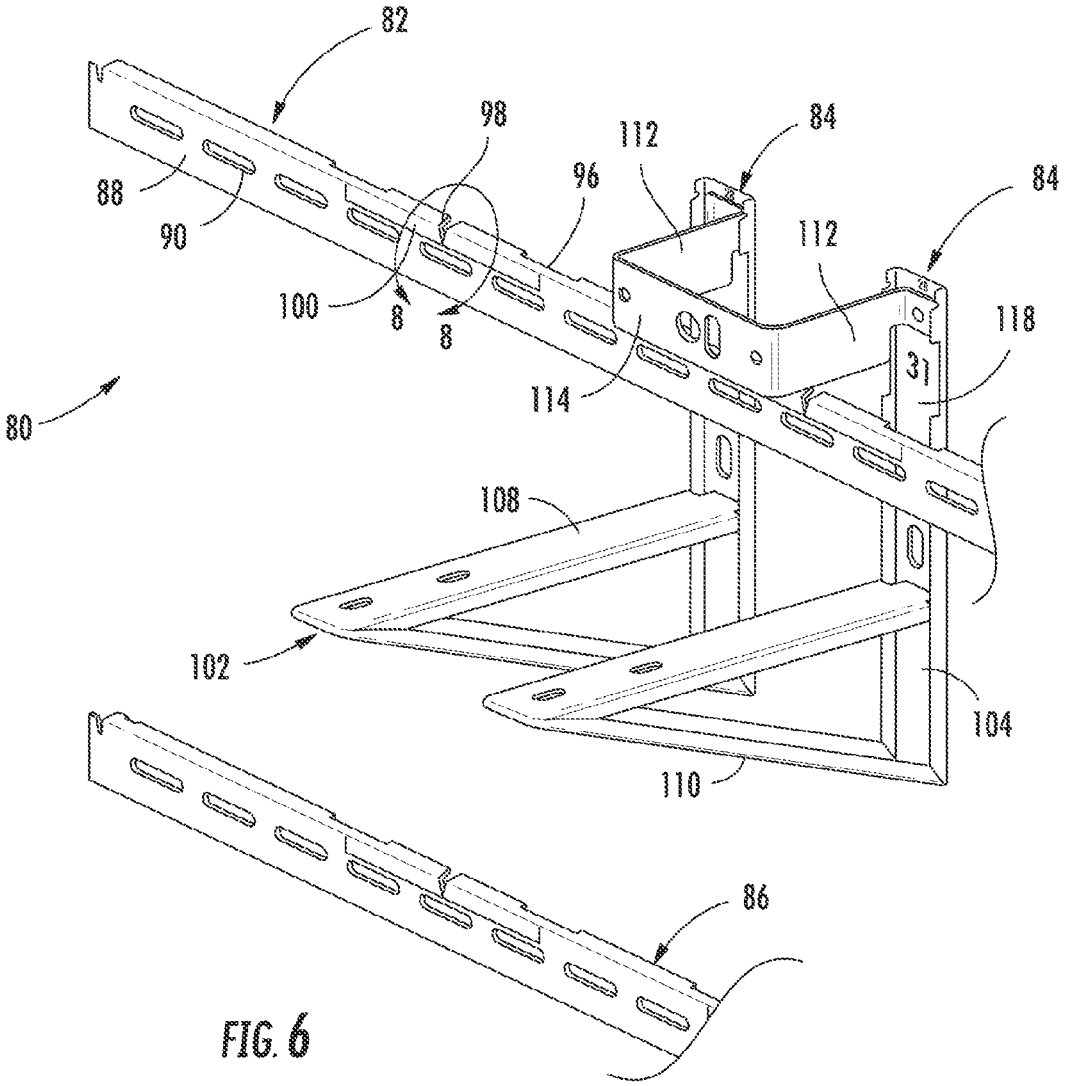
FIG. 6 is a close up front perspective view of a portion of the mounting system shown in FIG. 5.

Upper shelf 44 may be a generally horizontal panel facing in a generally upward direction, as shown in FIGS. 2 through 4, generally extending the entire width of towel dispenser 38 if the dispenser is used individually/separately from the lavatory system 10. Alternatively, upper shelf 44 may be provided by a generally horizontal shelf or platform that extends across multiple fixtures (e.g., waist receptacle, one or more hand washing stations, and the towel dispenser).

Lower shelf 46 may be a generally horizontal panel facing in a generally upward direction. Lower shelf 46 includes an opening 60 through which paper towel is dispensed to be accessed by the user of lavatory system 10. According to an exemplary embodiment, lower shelf 46 is formed with a recess 62 where outer peripheral edge 64 is vertically above the bottom surface of recess 62. Opening 60 for the paper towel is defined by a flange or rim 66 that extends upward from and above the bottom surface of recess 62. Water that drips off a user's hands is then retained in recess 62 and allowed to evaporated to prevent water from accumulating on floor 13 or from wetting the unused paper towels.

Roll of paper towel 52 is supported on a panel or shelf 68 located within housing 40. Roll of paper towels 52, 54 may be comprised of a plurality of sheets or sections separated by perforations 70 or other means to demark separate sheets. An end 72 of paper towel roll 52 (i.e., the next sheet to be used) extends or projects upwardly through opening 60 (e.g., aperture, hole, etc.) in lower shelf 46 and is presented to the user. Roll of paper towel 52 dispenses in a generally vertical direction. The user grasps end portion 72 extending from dispenser 38, pulls in a vertical direction and/or a non-vertical direction (e.g., horizontally, diagonally, etc.). The sheet being grasped by the user separates at perforation 70, leaving another end portion extending from dispenser 38 as before.

Referring to FIGS. 5 through 8, a mounting system 80 for lavatory system 10 is shown. Mounting system 80 is intended to provide easy and accurate installations of the lavatory system (i.e., hand washing stations 12, 14, waste receptacle 32 (if used), and towel dispenser 38 (if used), and other components). Mounting system 80 includes an upper (mounting) track 82, one or more mounting frames 84 (basin frame), and a lower (mounting) track 86. Upper track 82 is configured to engage mounting frame 84 a plurality of different positions allowing the basins or other fixtures to be mounted at a plurality of different heights.

Upper track 82 is an elongated U-shaped member (e.g., channel). Middle portion 88 of the U-shaped member includes a plurality of spaced-apart slots 90. The plurality of slots 90 are configured to provide a variety of locations to mount lavatory system 10 to wall 11 (i.e., fasteners able to engage building structure such as "studs" without limiting the relative position of the overall lavatory system relative to the studs). Upper leg 92 and lower leg 94 of the U-shaped member includes a plurality of notches or recesses 96 grouped together in pairs located along the longitudinal axis of upper track 82. Located within each pair of recesses 96 is a V-shaped centerline notch 98 located mid-way between the associated recesses 96. Preferably, there is an indicia 100 identifying the associated pair of recess 96 (e.g., location marker for the basin frame). Such indicia may be a groove on the outer surface (e.g., etched, lasered, machined, etc.).

Mounting frame 84 couples to upper track 82 and is configured to support one or more hand washing stations (e.g., sink, trap cover, backsplash, etc.), waste receptacles, towel dispensers, top shelf, cabinets, outer housings (e.g., "skin", shell, etc.), or other fixtures or modules provided with lavatory system 10. Mounting frame 84 includes a pair of basin supports 102 (e.g., members, brackets, etc.), a pair of vertical members 104 (e.g., tracks, channels, members, etc.), and a backsplash support member 106 connecting vertical members 104. Basin support 102 includes a horizontal member 108 extending from one of the vertical members 104, and an angled member 110 extending from a lower portion of the vertical member 104 and coupled to the horizontal member 108 (i.e., to form a right triangle). Backsplash support 106 is generally a horizontally-orientated U-shaped bracket with outer legs 112 coupled to the respective vertical members (e.g., with fasteners, welding, etc.). Middle portion 114 of the U-shaped bracket includes one or more apertures to receive fasteners for coupling to backsplash 18. Vertical members 104 include a plurality of spaced apart recesses 116 configured to engage (e.g., mate, fit, register, etc.) with recesses 96 on upper track 82. Vertical members 104 have indicia 118 indicating which recesses 96 to use for the desired height H of the basin (e.g., 28 inches, 31 inches, or 34 inches) associated with the ADA regulatory requirements.

Lower track 86 is an elongated U-shaped member (e.g., channel). The middle portion of the U-shaped member includes a plurality of spaced-apart slots. According to a preferred embodiment, the lower track is identical to the upper track to minimize individual parts/components.

Figures 7, 8:
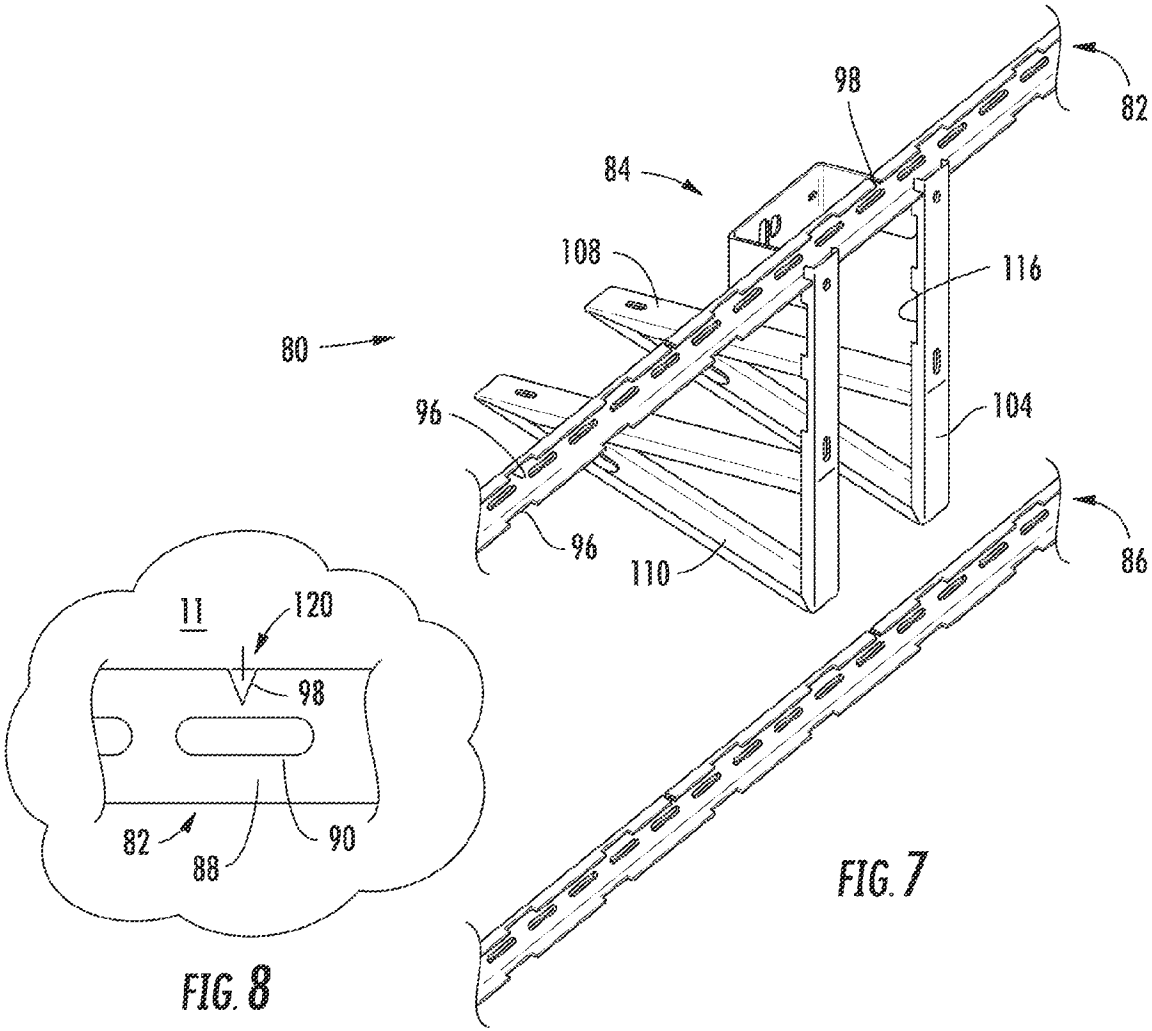
FIG. 7 is a rear perspective view of the portion of the mounting system shown in FIG. 6.
FIG. 8 is a close-up front view of a portion of the upper track of the mounting system of FIG. 5.
Figure 52:
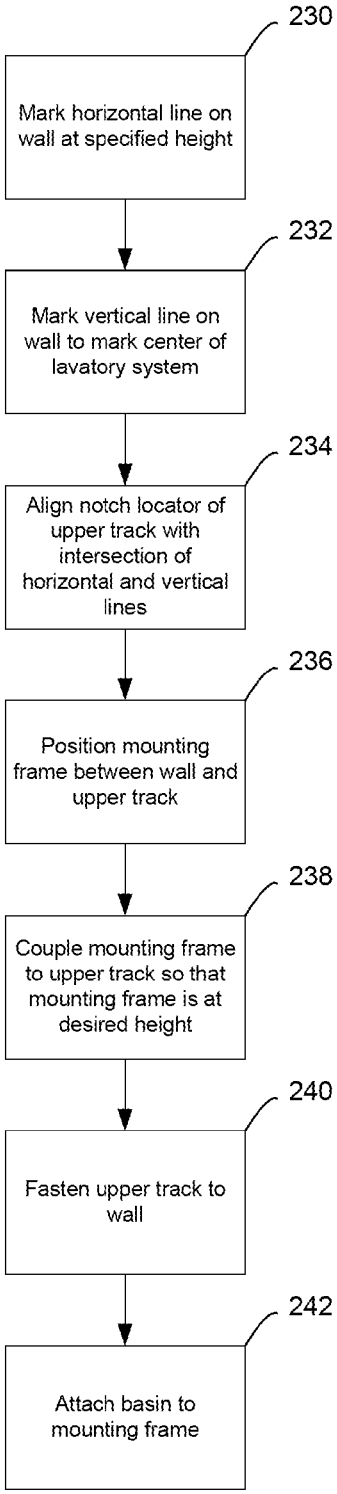
FIG. 52 is a flow diagram for a process of assembling and mounting a lavatory system according to an exemplary embodiment.

FIG. 52 is a flow diagram of a process of assembling and mounting a lavatory system according to an exemplary embodiment. At step 230, the installer marks a horizontal line on wall 11 at a specified height above floor 13 (e.g., 33 inches), and at step 232, the installer marks a vertical line on wall 11 representative of the desired centerline of lavatory system 10. At step 234, upper track 82 is placed on wall 11 so that intersection 120 of the horizontal line and the vertical line are located within the V-shaped centerline notch 98 locator on upper track 82. The alignment of intersection 120 within the V-shaped centerline notch 98 locator on upper track 82 is shown in FIG. 8. In one embodiment, fasteners (e.g., screws, bolts, nails, pins, etc.) are inserted through the slots in upper track 82 to engage building structure (e.g., "studs"). Before tightening the fasteners, at step 236, mounting frames 84 are slid between the upper track 82 and the wall 11, and at step 238, mounting frames 84 are coupled to upper track 82 by engaging recesses 116 on vertical members 104 with the recesses 96 on upper track 82 to fix mounting frames 84 at a plurality of different position (e.g., first position, second position, etc.) each resulting in a different height H of basin 16. At step 240, the fasteners are further tightened to "lock" mounting frames 84 to upper track 82 and to fasten both to wall 11. At step 242, basins 16 are coupled or attached to mounting frames 84.

Other fixtures, accessories, modules, and the like may also be attached to the upper track and lower track. For example, towel dispenser 38 shown in FIGS. 1-4 includes upper and lower recesses 122, 124 and hooks 126 that engage upper track 82 and lower track 86.

Because upper track 82 is attached to wall 11 or to other support structures at a predetermined height above floor 13, mounting frames 84 may then be coupled to upper track 82 at any of a variety of prescribed locations or positions depending on the heights H desired for basins 16. As shown in FIG. 7, when mounting sink 16 at the lower most position (e.g., 28 inches), the top end of vertical members 104 engage lower leg 94 of the U-shaped member.

FIG. 9 shows a rear perspective view of lavatory system 10 (without the wall obscuring the internal components) to further illustrate the mounting, coupling, and arrangement of internal components within interior portion 37 of lavatory system 10. Various items (e.g., liquid soap containers, paper towels, wiring, plumbing, etc.) may be located within interior portion 37. As shown in FIG. 9, two liquid soap containers 21 are located within interior portion 37 of lavatory system 10. A tube 23 is coupled between each liquid soap container 21 and each soap dispenser 30 to allow soap to flow from liquid soap containers 21 to the output portion of each soap dispenser 30 to provide soap to the user of each wash station. Each faucet 20 is in fluid communication with a cold water pipe 25 and a hot water pipe 26. In one embodiment, water from cold water pipe 25 and hot water pipe 26 are mixed by a device or valve (e.g., a solenoid valve) prior delivering water through faucet 20 to the user of the wash station. Each basin 16 of each wash station may be in fluid communication with a drain pipe 27 to allow water collected in each basin 16 during use of the wash station to drain away. As shown in FIG. 9, hand dryer 28 includes a heating and air circulation device, shown as motor 78, and a duct or conduit 79. Conduit 79 is coupled between motor 78 and nozzle 39. Motor 78 may include a fan or other suitable device to move air through conduit 79 and out of nozzle 39 to allow the moving air to dry the hands of the user of the hand washing station. Hand dryer 28 may also include one or more heating element to heat the air moved by motor 78.

Outer housing 31 generally prevents access to interior portion 37 of lavatory system 10 and to the various portions of lavatory system 10 located within interior portion 37. However, certain components of lavatory system 10 may be configured to allow access to various portions of interior portion 37. For example, as discussed above, towel dispenser 38 includes a hinged access panel 42 to allow access to the portion of interior portion 37 defined by the housing of towel dispenser 38. Panel 36 is configured to articulate between opened and closed positions. As shown in FIG. 9, panel 36 may be coupled to a hinge member 130 configured to allow panel 36 to move from a closed position (shown in FIG. 9) to an open position (shown in FIG. 10B).

Figure 10A:
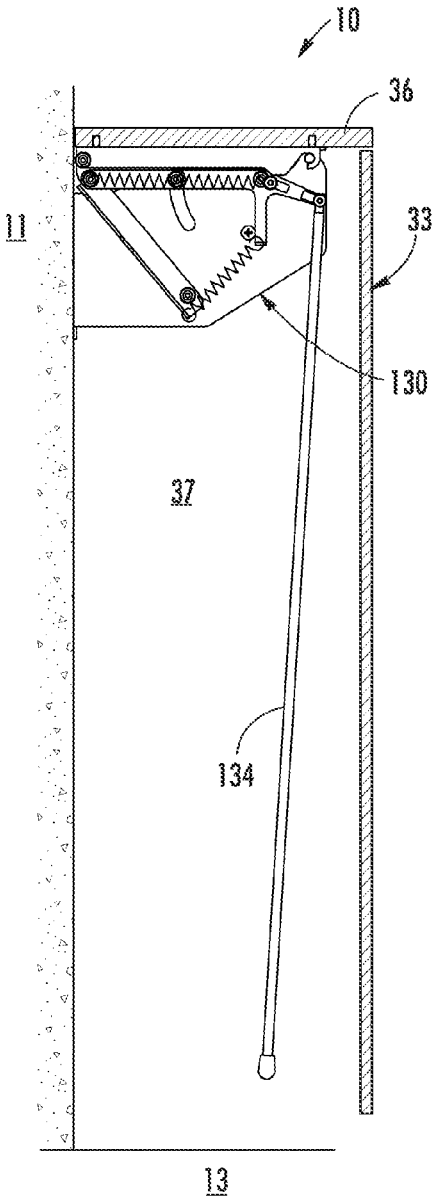
FIG. 10A is a sectional view of the lavatory system of FIG. 1 showing the shelf in a closed position.

FIGS. 10A-12 show cross-sectional views of lavatory system 10 taken along line X-X in FIGS. 1 and 9. As shown, lavatory system 10 includes a hinge member 130. As shown, panel 36 is coupled to hinge member 130. Hinge member 130 is also coupled to bracket 132. Bracket 132 provides support for panel 36 and for hinge member 130. As shown in FIGS. 10A and 10B, bracket 132 may be attached to wall 11. However, in other embodiments, bracket 132 is attached to and supported by one or more elements of lavatory system 10 (e.g., housing 31, internal support structures, etc.). Hinge member 130 is also coupled to a release mechanism, shown as rod 134, which extends downward toward floor 13 adjacent the inner side of housing front portion 33. As shown best in FIGS. 10A and 10B, front portion 33 does not extend completely to floor 13. The space between the lower edge of front portion 33 and floor 13 provides access to rod 134 from outside lavatory system 10 by reaching underneath front portion 33.

Figure 12:
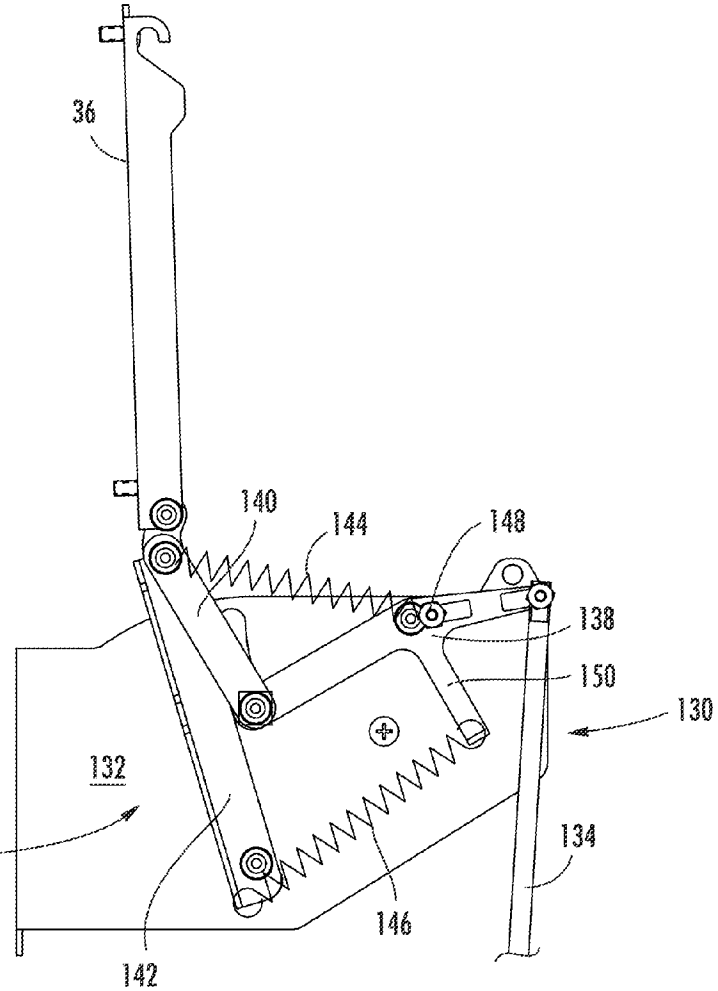
FIG. 12 is a close up sectional view of the shelf shown in FIG. 10B.
Figure 11:
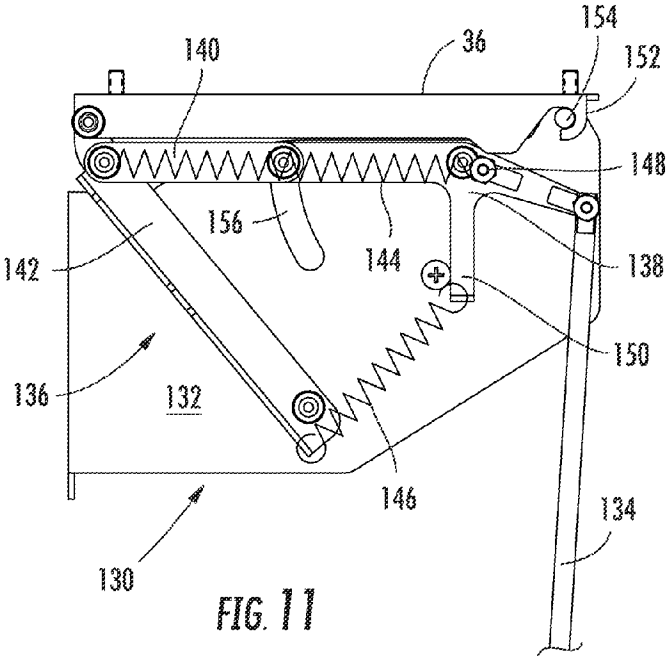
FIG. 11 is a close up sectional view of the shelf shown in FIG. 10A.

FIGS. 11 and 12 show a close-up view of hinge member 130 according to an exemplary embodiment. Rod 134 is connected at its upper end to linkage 136. Linkage 136 includes a first link 138, a second link 140, and a third link 142. First link 138 has a first end coupled to the upper end of rod 134. First link 138 has a second end coupled to a first end of second link 140. Second link 140 has a second end coupled to third link 142. Third link 142 has a first end coupled to panel 36. Each of the connections between elements of linkage 136 and between linkage 136 and panel 36 and rod 134 are pin joints that allow for rotation about an axis perpendicular to the pin joint. Linkage 136 also includes an arm 150 extending below and generally perpendicular to first link member 138.

Hinge member 130 includes a first spring 144 and a second spring 146. First spring 144 is connected between the pin joint joining second link 140 to third link 142 and a connection point 148. Second spring 146 is connected between the second end of third link 142 and the lower end of arm 150.

Referring to FIG. 11, panel 36 is shown in a first or closed position. In the closed position, a hook 152 extending from the lower side of panel 36 engages a cylindrical projection 154 extending from bracket 132. In the closed position, first spring 144 is biased such that it exerts an inwardly directed force, and second spring 146 is biased such that it exerts an outwardly directed force. Further, as shown in FIG. 10A, in the closed position, the front edge of panel 36 is substantially aligned with housing front portion 33, and the rear edge of panel 36 abuts wall 11. Thus, in the closed position, panel 36 prevents access to interior portion 37 of lavatory system 10 via the upper end of housing 31.

Figure 10B:
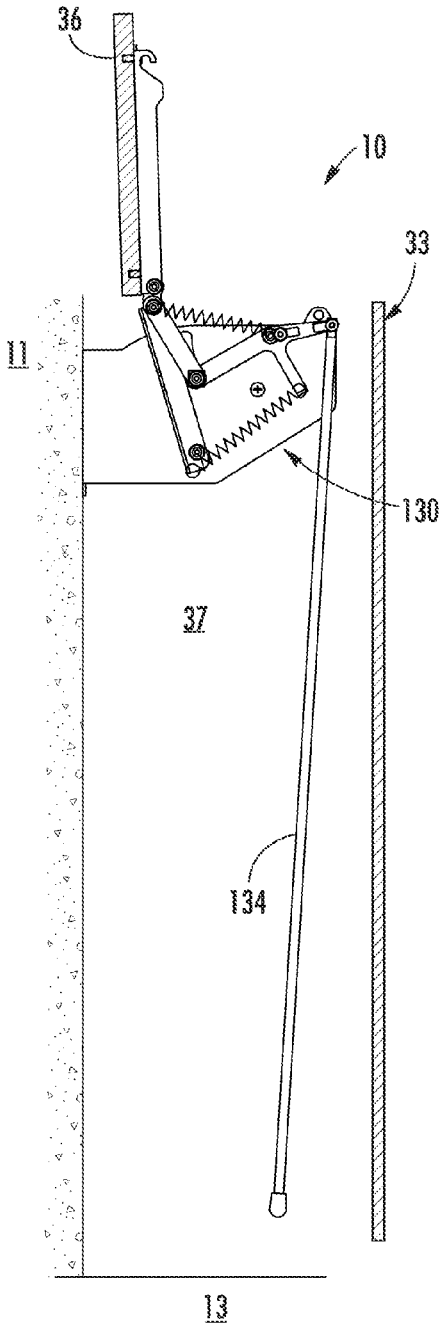
FIG. 10B is a sectional view of the lavatory system of FIG. 1 showing the shelf in an open position.

As shown in FIGS. 10A and 10B, rod 134 is accessible by the user from below a bottom portion of the housing or base. To move panel 36 from the closed position to the open position, an upwardly directed force is applied to rod 134 by reaching underneath housing front portion 33. The application of force to rod 134 cause the first end of first link 138 to move upward and the second end of first link 138 to move downward. Bracket 132 includes a slot 156 that allows the pin joint between first link 138 and second link 140 to move downward. As the second end of first link 138 moves downward, second link 140 moves from the horizontal position shown in FIG. 11 to the angled position shown in FIG. 12.

In the closed position, first link 138 and second link 140 are in substantial axially alignment allowing first link 138 and second link 140 to resist the forces exerted by first spring 144 and second spring 146. The application of an upward force to rod 134 causes first link 138 and second link 140 to come out of axial alignment. This allows first spring 144 to contract and second spring 146 to expand. The contraction of first spring 144 and the expansion of second spring 146 cause hook member 152 to disengage cylindrical projection 154 and also moves panel 36 away from wall 11. With panel 36 moved away from wall 11 and with hook 152 disengaged from cylindrical projection 154, panel 36 may be rotated to the open position of FIG. 12.

With panel 36 in the open position, access to interior portion 37 is permitted via the upper end of housing 31. Access to interior portion 37 may be desirable for a variety of purposes, such as to repair wiring and plumbing, to replace or refill soap, paper towels, etc. To move panel 36 to the closed position, the process is reversed. In this embodiment, rod 134 is hidden from view from outside of lavatory system 10. Thus, only people who know the position of rod 134 will be likely to obtain access to interior portion 37. In addition, this limited access is achieved without the need for locks, keys, etc.

According to an exemplary embodiment, the faucets (e.g., valve, sensor, etc.) and soap dispensers (e.g., valve, sensor, etc.) are powered by a photovoltaic cell and a power management system such as disclosed in U.S. patent application Ser. No. 11/041,882 titled "Lavatory System" filed Jan. 21, 2005 is hereby incorporated herein by reference in its entirety. The hand dryers are powered by an AC power line. The electric hand dryers may be powered by the photovoltaic system as well (e.g., battery or other energy storage element that is charged by the photovoltaic cell array).

The photovoltaic system is capable of converting light energy to electrical energy, and can be used to power one or more of the fixtures and/or the control system providing for the "hands-free" operation of fixtures. The photovoltaic system may include one or more photovoltaic cells (such as an array of cells) coupled to a support structure (e.g., the panel, shelf, etc.) on the base of the lavatory system. The photovoltaic cells may be supported by, mounted to, contained within, and/or integrally formed with a portion of support structure (e.g., the panel, countertop, basins, etc.) or other surrounding structures (e.g., a mirror, etc.). Preferably, photovoltaic cells are provided at the shelf of upper portion of support structure in an effort to maximize the exposure of the photovoltaic cells to the ambient light. Preferably, the addition of photovoltaic cells to the shelf does not significantly limit the functionality of the shelf as a usable surface for a user. The photovoltaic cells are electrically coupled to the fixtures and/or a control system providing for the operation of the fixtures.

The power management system is intended to provide for an efficient use of the electrical energy generated by the photovoltaic cells. The power management system generally includes an energy storage element configured to receive and store electrical energy generated by the photovoltaic cells, a detector (shown as a voltage detector) for monitoring the level of ambient light surrounding the lavatory system (e.g., by monitoring the energy stored in an energy storage element, etc.) to recognize periods of time when it is unlikely that the lavatory system will be used (e.g., when the ambient light is turn off or otherwise reduced), a switch capable of electrically disconnecting energy storage element from the control system when the voltage detector sends an output signal indicating that given the level of ambient light surrounding the lavatory system it is unlikely that the lavatory system will be used, and a voltage regulator for adjusting the voltage being sent to the control system. According to various alternative embodiments, power management system may be used without photovoltaic cells to electrically disconnect an energy storage element (such as a battery) from the control system.

FIGS. 13-50 show multi-height lavatory systems according to exemplary embodiments. Each lavatory system is configured to accommodate persons having varying abilities or characteristics for using a lavatory system (e.g., disabled, tall, short, etc.). In addition to the ease of manufacturing and installation, the lavatory system incorporates a unitary lavatory subassembly that has a minimum number of components, and provides an independent hand-washing station for users having varying physical attributes or abilities to attend to their washing needs. Also, this provides each user with an adequate sense of privacy while washing at a spaced distance from the next person using the lavatory system.

Each lavatory system includes a deck, a mounting arrangement configured to attach the lavatory system to an adjacent wall, a drain system disposed below deck, and a cover configured to enclose plumbing system. The lavatory system may be configured for attachment to a surface (such as the wall of a restroom or other area where it may be desirable to provide a lavatory services) with a plurality of connection points. Alternatively, the lavatory system may be configured as a free-standing structure. Adjacent wall 11 may be provided with the plumbing source (including both (or either) a hot and cold water supply, preferably combined with a thermostatic mixing valve, or a tempered water supply, a drain, etc.) and an optional source such as an electrical outlet (preferably providing 110 volts GFCI).

According to an exemplary embodiment, the deck includes a countertop with a backsplash extending upwardly from the countertop, and a front apron extending downwardly from countertop. According to another exemplary embodiment, the countertop may be configured in any of a variety of constructions intended to promote the drainage of spilled or splashed water to the drain from the countertop. The countertop may include an upper surface of a lower station and an upper surface of an upper station. According to an exemplary embodiment, the countertop includes a curved surface configured to prevent water from collecting (or "ponding"), to allow excess, splashed (or spilled fluids) to drain toward a bowl or drain, and to facilitate clean-up. According to exemplary embodiments, the countertop deck may have a radiused surface, a sloped surface, a pitched surface, or the like, and/or arranged at a variety of heights.

The lower station and the upper station are configured to provide lavatory service and to accommodate persons having varying abilities for using the lavatory system (e.g., disabled, tall, short, etc.). According to any preferred embodiment, one or more stations of the lavatory system are mounted at a standard height that is designed to comply with applicable accessibility standards, such as the Americans with Disabilities Act (ADA) Accessibility Guidelines for Buildings and Facilities and Uniform Accessibility Standards for Lavatories, or other standards (e.g., Texas Accessibility Standards or TAS). According to a particularly preferred embodiment, the height of the upper surface of the deck is approximately 34 inches (865 millimeters), provides a lower clearance (i.e., from the floor to the bottom of the apron) of at least 29 inches (735 millimeters) or less above the floor, and is equipped with a set of ADA or other accessibility regulation compliant faucet assemblies. According to any preferred embodiment, the lavatory system is mounted with a counter surface no higher than thirty-one inches.

FIGS. 13-50 show lavatory systems according to exemplary embodiments. The lavatory systems are configured to accommodate (e.g., to provide hand washing access to) persons having varying abilities or physical attributes or characteristics (e.g., adult, juvenile, children, persons with disabilities, tall, short, etc.) and/or be in compliance with accessibility guidelines. The lavatory systems are also configured to provide for improved manufacturing, inventory control, assembly, installation and maintenance by incorporating common or universal components (at least in the manufacturing stage) that are configurable or reconfigurable for a variety of lavatory system designs and/or configurations (e.g., one-station, two-station, three-station, etc.). The multi-station lavatory systems (i.e., two or more stations) are configured to provide hand washing access to multiple users at the same time. The lavatory systems are further configured to use space more efficiently (e.g., fit and design of deck, sink, cover, and/or walls) to provide improved access to and usability of the lavatory system for users having varying physical attributes or abilities to attend to their washing needs.

The lavatory systems of U.S. patent application Ser. No. 10/116,335 titled "Lavatory System" filed Apr. 4, 2002, now U.S. Pat. No. 7,039,963, and U.S. patent application Ser. No. 10/637,801 titled "Lavatory System" filed Aug. 8, 2003, are hereby incorporated herein by reference in their entireties.

Figure 13A:
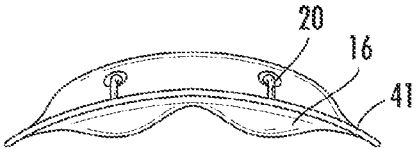
FIGS. 13A-13D show a front view of a modular lavatory system according to an exemplary embodiment having a generally convex countertop that may be mounted at different angular positions.
Figure 13C:
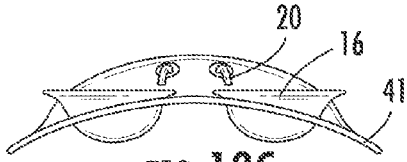
Figure 13B:
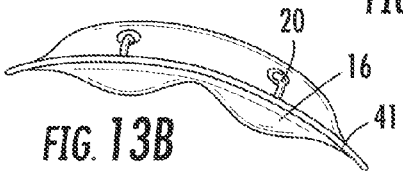
Figure 13D:
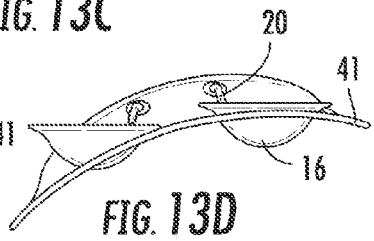

FIGS. 13A-13D illustrates a modular lavatory system having a deck or countertop 41. As shown in FIGS. 13A-13D, countertop 41 is a generally convex countertop. The convex countertop has one or more openings (two are shown) to receive basins 16. Depending on the desired orientation and height of basins 16, countertop 41 may be mounted in a variety of tipped or rotated orientations. For example, if it is desired to have the wash stations (and basins) at the same height or level, the countertop is mounted as shown in FIG. 13A and FIG. 13D. If it is desired to have one of basins 16 to be lower (e.g., to meet certain ADA requirements), countertop 41 is rotated or tipped clockwise in the amount that brings the station to the desired height (e.g., relative to the floor). Hand washing fixtures 20 (e.g., faucets, soap dispensers, towel dispensers, hand dryers, etc.) are then mounted according to the orientation of the countertop. Taken together, FIGS. 13A-13D also illustrate a method of installing a lavatory system having a first hand washing station and a second hand washing station to provide hand washing functionality to one or more users. The method comprises a step of providing an elongated countertop having a left lateral edge, a right lateral edge, and a front edge extending between the left lateral edge and the right lateral edge, a first basin, a second basin, a first faucet, and a second faucet. When mounting the countertop to a wall, the countertop may be mounted in its generally horizontal (neutral) position wherein the left and right lateral edges are about the same distance from the floor (FIGS. 13A and 13C). The countertop may also mounted to a wall at an angle so that one hand washing station is lower (or higher) than the other (FIGS. 13B and 13D). The basins or sinks may be integrally formed with countertop (FIGS. 13A and 13B). Alternatively, the basins or sinks may be separate components that are coupled to the countertop (e.g., to provide a greater horizontal appearance such as shown in FIGS. 13D and 13D).

Figure 14:
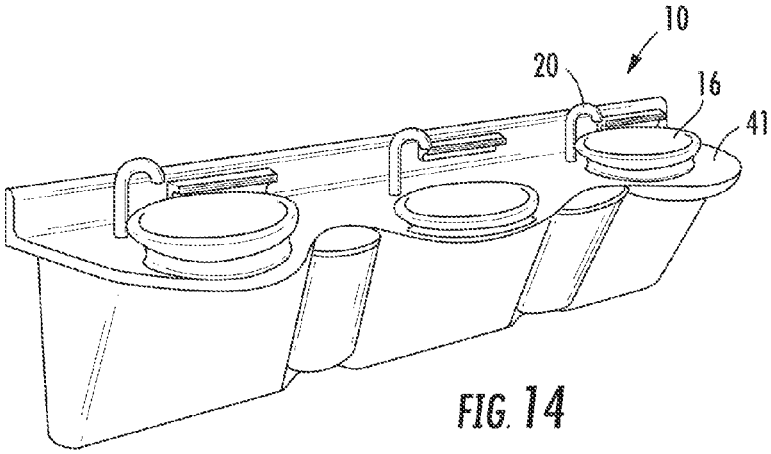
FIG. 14 is a front perspective view of a modular lavatory system according to an exemplary embodiment.

FIG. 14 illustrates another embodiment of a modular lavatory system 10 having a generally planer countertop 41. Countertop 41 has one or more openings (holes, apertures, etc., which may be circular, oval, rectangular, or other shapes) to receive one of a variety of basins 16. Basins 16 are configured to provide a variety of heights and comprise a mounting portion and a receptacle (bowl) portion. The mounting portion engages countertop 41 at one of the openings. The height presented by the washing station is defined by the size or amount of the bowl portion extending from the mounting portion. A single countertop may therefore be used to provide a lavatory system 10 having a variety of configurations. For example, if it is desired to provide three wash stations at three different user access heights, three different basin configurations are coupled to openings in countertop 41, such as shown in the embodiment of FIG. 14.

Figure 15:
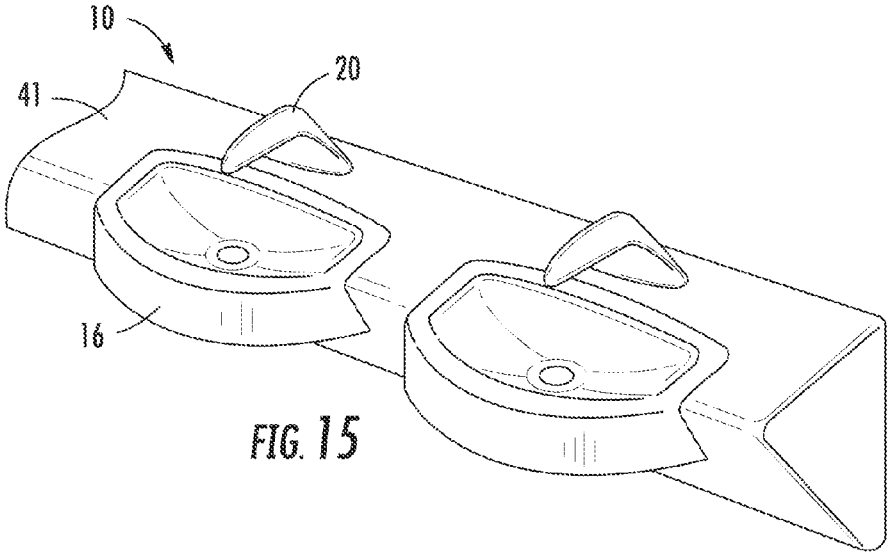
FIG. 15 is a front perspective view of a modular lavatory system according to an exemplary embodiment.

FIG. 15 illustrates a modular lavatory system 10 having a generally planer countertop 41. Countertop 41 has one or more slots into which the basin slides in for mounting. Basins 16 may have any of a variety of relative heights of the bowl portion to provide a variety of wash station heights. The example illustrated in FIG. 15 shows two identical basins mounted to the countertop to provide the same wash station heights.

Figure 16:
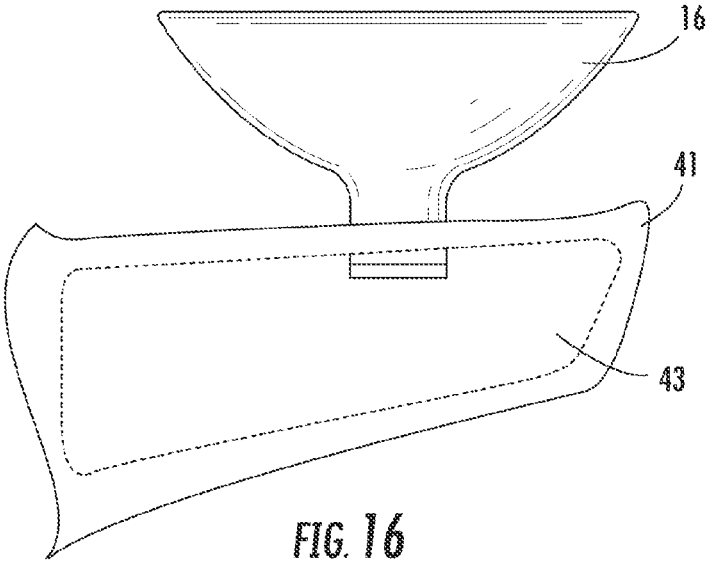
FIG. 16 is a side view of a modular lavatory system according to an exemplary embodiment.

FIG. 16 illustrates a modular lavatory system 10 having a countertop 41. The countertop has a hollow area providing a common drain table or channel 43, and defined by an inclined top surface with one or more overflow openings and one or more basin openings configured to receive a mounting portion of a raised basin. The mounting portion also provides a drain/outlet 51 so water in the receptacle drains into the common drain table 43. The draining water is therefore obscured from the user or users of the lavatory system.

Figure 17:
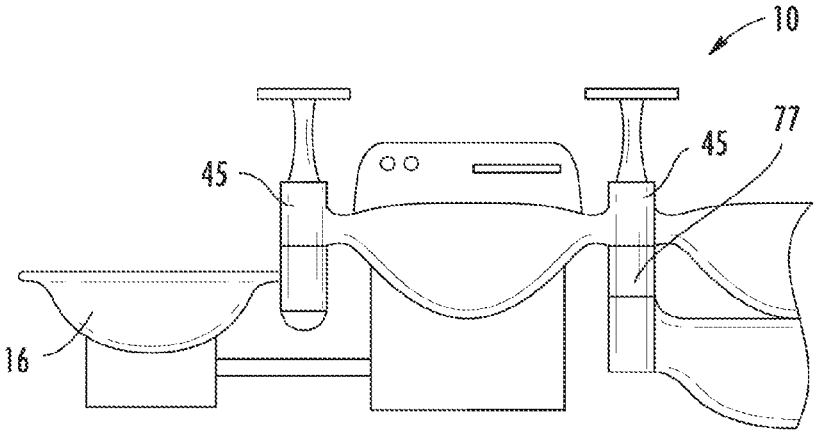
FIG. 17 is a front side view of a modular lavatory system according to an exemplary embodiment.

FIG. 17 illustrates a modular lavatory system 10 having a plurality of countertops 41 and basins 16. The countertops have a pair of mounting arms 45 extending outwardly. Mounting arms 45 include a bore with a vertical axis that is coupled to a base (e.g., post, tube, etc.). A variety of wash station heights is provided by the location that the mounting portions engage (e.g., coupled, fastened, etc.) to the base. As shown, a spacer 77 may be used to further separate adjacent countertops. As such, the same countertop/basin assembly is used and mounted at the desired height.

Figure 18:
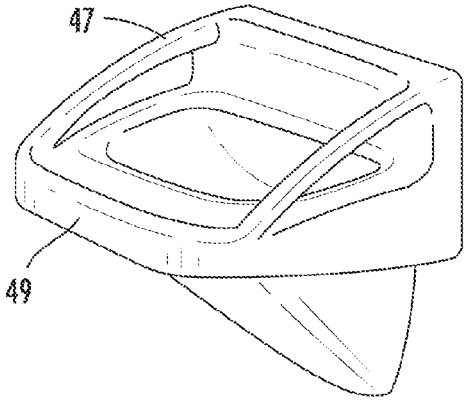
FIG. 18 is a front perspective view of a wash station with grab bars according to an exemplary embodiment.

FIG. 18 illustrates a wash station with grab bars 47 and a grab lip 49 to assist users with using the lavatory system (e.g., pulling a wheelchair in close and alignment).

Figure 19:
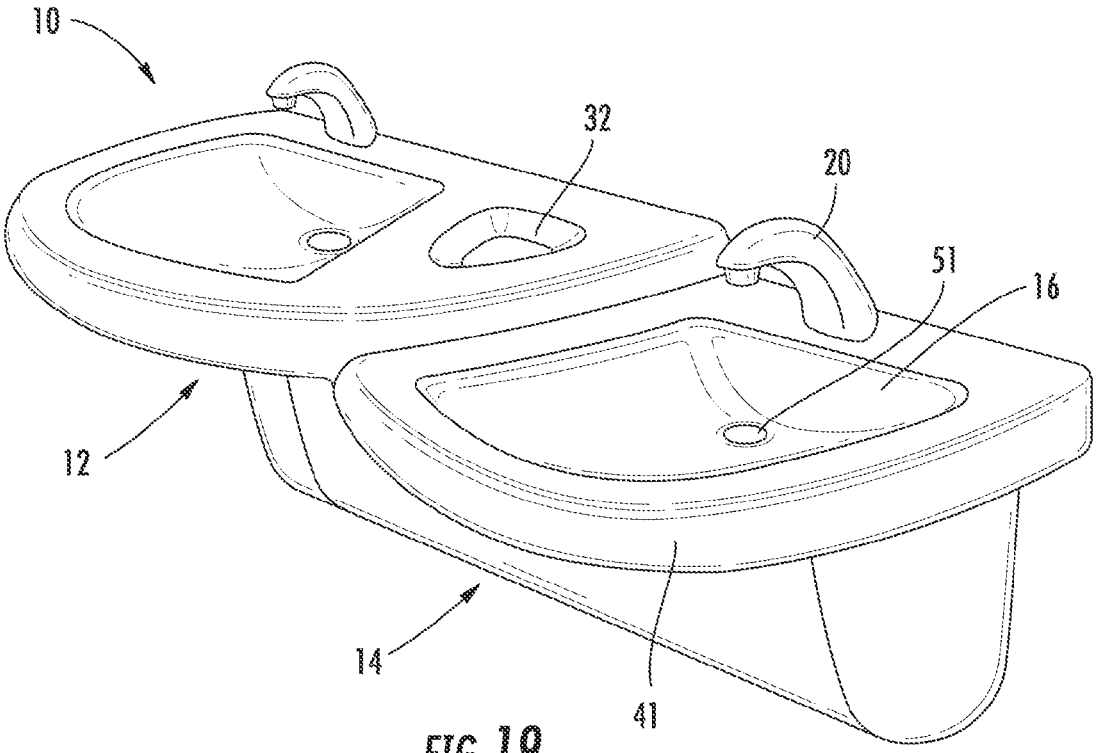
FIG. 19 is a front perspective view of a lavatory system including two hand washing stations according to an exemplary embodiment.

FIG. 19 illustrates a lavatory system 10 including a countertop 41 providing two hand washing stations 12, 14 located at different heights. Countertop 41 has an integrated waste receptacle 32. Waste receptacle 32 is intended to improve water containment and reduce the amount of water dripped on the floor by a user that would otherwise have to walk across the washroom from the hand washing area to the hand drying station (e.g., towel or electric dryer). Instead, hand drying is done with towels dispensed from a towel dispenser (not shown, but located, for example, above the countertop) and thrown away without having to leave the hand washing station. Preferably, the opening to the receptacle 32 is angled to assist guiding waste into the receptacle.

Figure 20:
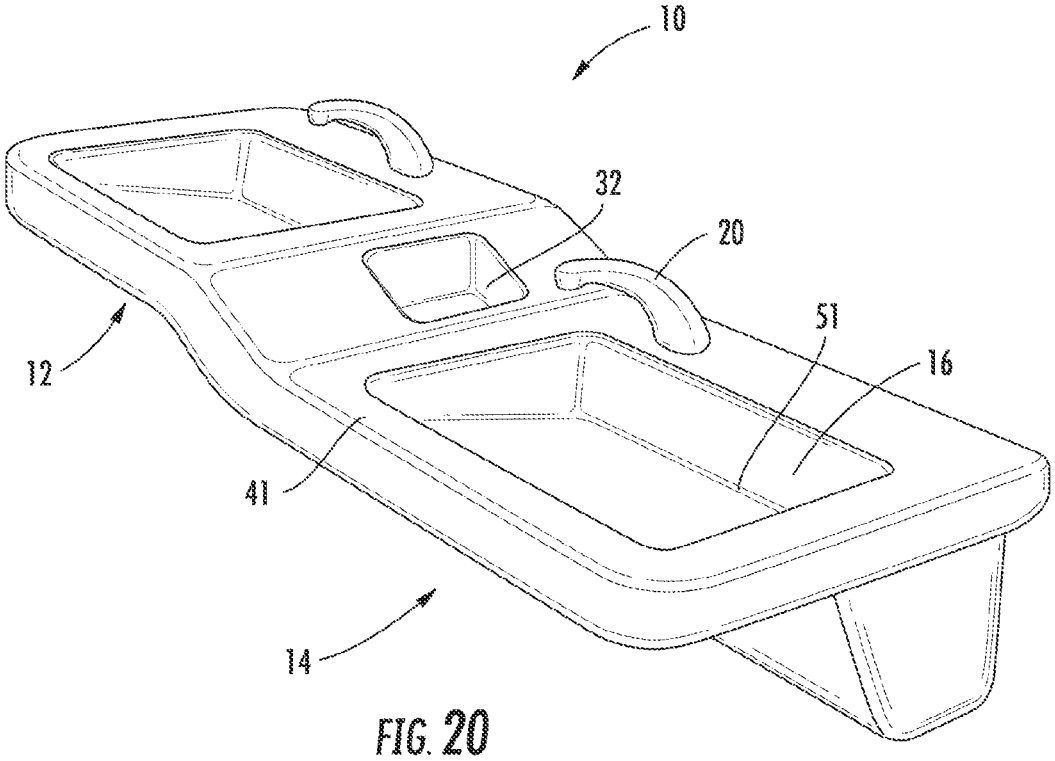
FIG. 20 is a front perspective view of a lavatory system including two hand washing stations according to an exemplary embodiment.

FIG. 20 illustrates a lavatory system 10 including a countertop 41 providing two hand washing stations 12, 14 located at different heights. Each hand washing station is generally planer between its lateral sides, and is angled downwardly from front to back for water containment. Countertop 41 also has an integrated waste receptacle 32 to also improve water containment as discussed with regard to FIG. 19. Each basin 16 includes a concealed or obscured drain 51 provided by a slit extending at least partially across the rear portion of the basin.

Figure 21:
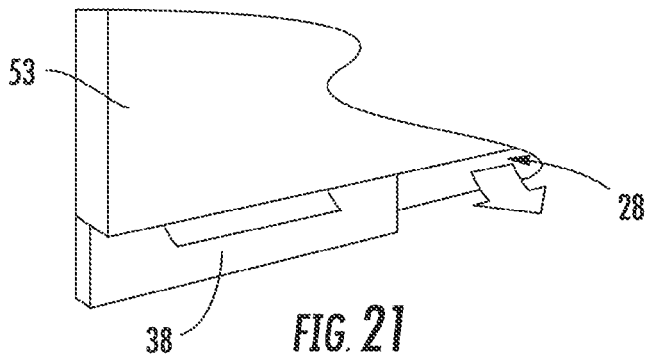
FIG. 21 shows a hand drying station integrated with a mirror.

FIG. 21 illustrates a hand drying fixture or station configured to be integrated (e.g., coupled to, mounted adjacent to, etc.) with the lavatory systems as disclosed herein. The hand drying station comprises both a paper towel dispenser 38 and an electric hand dryer 28. The hand drying station is also integrated with another standard washroom fixture, such as a mirror 53, to provide additional functionality as well as help obscure the station.

Figure 22:
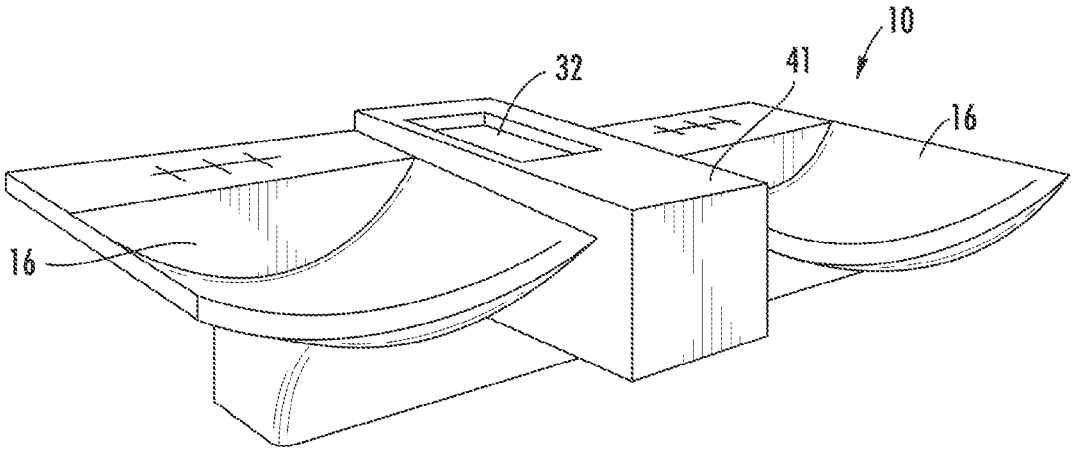
FIG. 22 is a front perspective view of a modular lavatory system according to an exemplary embodiment.

FIG. 22 illustrates a modular lavatory system 10 having a countertop 41 and a plurality of modular basins 16. Countertop 41 is located at a predetermined height between adjacent basins 16. Basins 16 are mounted at desired heights. Countertop 41 has a waste receptacle 32 to assist in water containment as discussed above.

Figure 23:
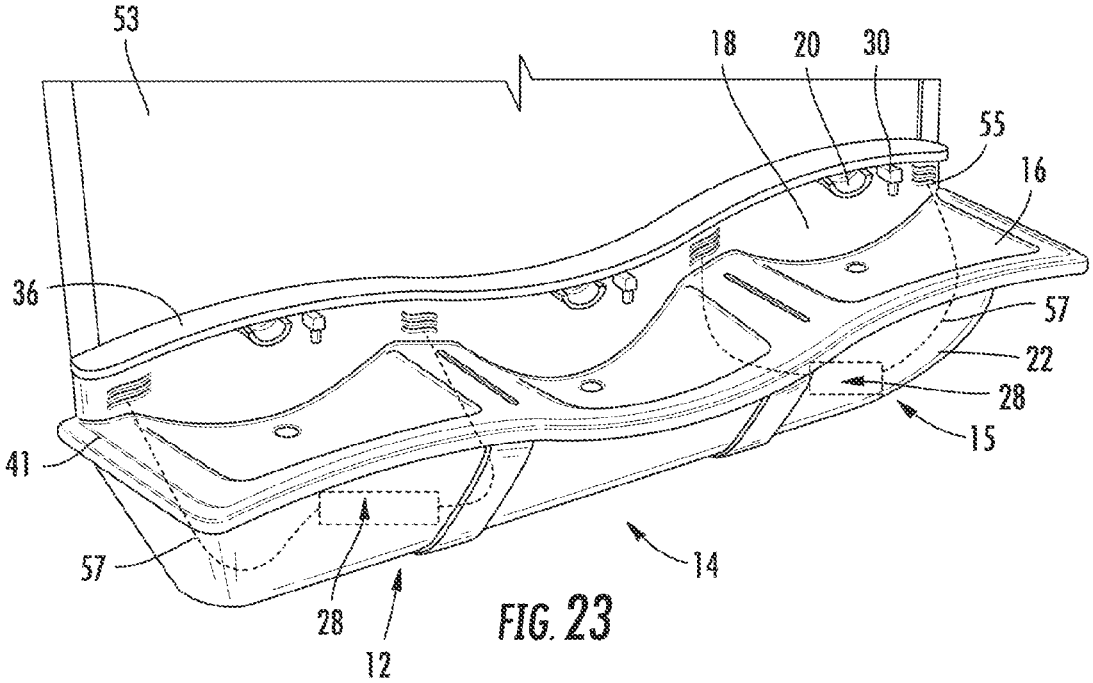
FIG. 23 is a front perspective view of a lavatory system including three hand washing stations according to an exemplary embodiment.

FIG. 23 illustrates a lavatory station 10 with three hand washing stations 12, 14, and 15 located at different heights. Each wash station includes a basin 16, a faucet 20, and a soap dispenser 30. One or more electric hand dryers 28 (shown schematically as broken line rectangles) for one or more hand drying stations are located inside of trap enclosure or trap cover 22. Hand dryers 28 are coupled to vents or outlets 55 (shown as a series of curved slots) that are integrated with backsplash 18. According to an exemplary embodiment, two hand dryers 28 are used to provide heated air to, for example, four outlets. Air ducts 57 (e.g., conduit) split the heated output air as shown schematically by the broken lines connecting the dryers and the outlets. Photovoltaic cells may be mounted above the mirror 53 and/or in the light fixture above the mirror. Mirror 53 may be, for example, integrated with the lavatory fixture such as shown in FIG. 23.

Figure 24:
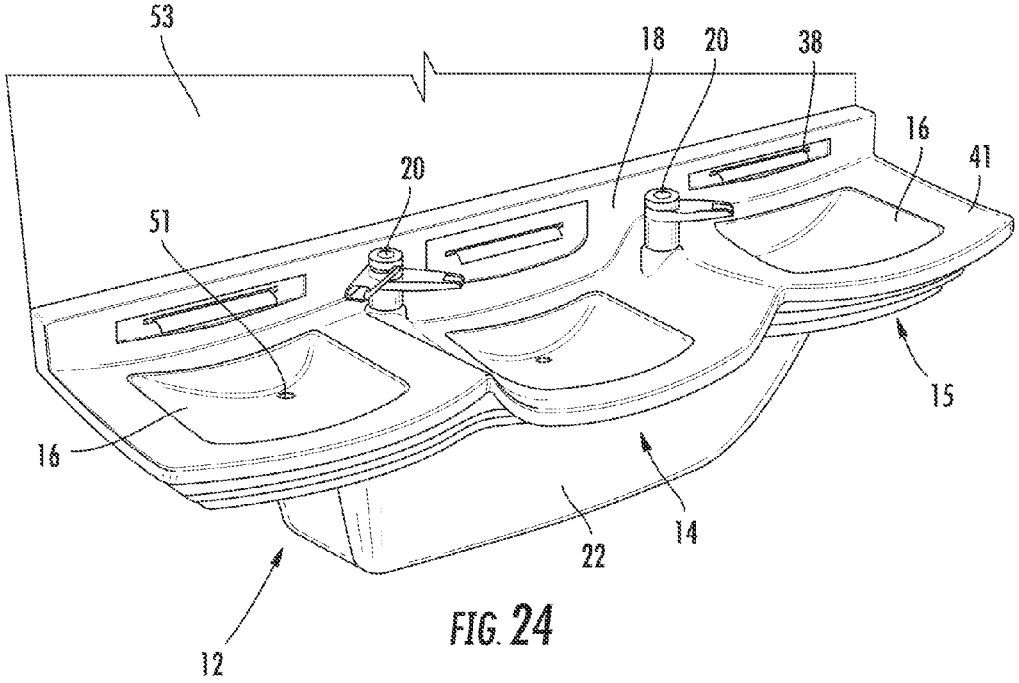
FIG. 24 is a front perspective view of a lavatory system including three hand washing stations according to an exemplary embodiment.

FIG. 24 illustrates a lavatory system 10 having three wash stations 12, 14, 15. Lateral edges of countertop 41 of each wash station extend (e.g., curve) upwardly at the interface between adjacent wash stations for water containment and ornamental appearance. Hand drying stations, shown as towel dispensers 38 (but could be an electric hand dryers), are integrated with backsplash 18. Drains 51 in each basin 16 are located towards the middle of the lavatory system—the drain in station 12 is on the right side of the basin, the drain in station 14 is in the middle of the basin, and the drain in station 15 is on the left side of the basin. As such, the width of trap cover 22 (the enclosure used to cover the plumbing and electrical components) is reduced or minimized to open up space below countertop 41. According to an exemplary embodiment, faucets 20 (e.g., valve, sensor, etc.) and soap dispensers (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. One or more of faucets 20 may comprise a double-decker configuration, comprising a (vertical) single conduit provides water to outlet spouts and sensors servicing two different wash stations (e.g., to minimize the "rough-in" for fixtures, electrical wiring, and the like).

Figure 25:
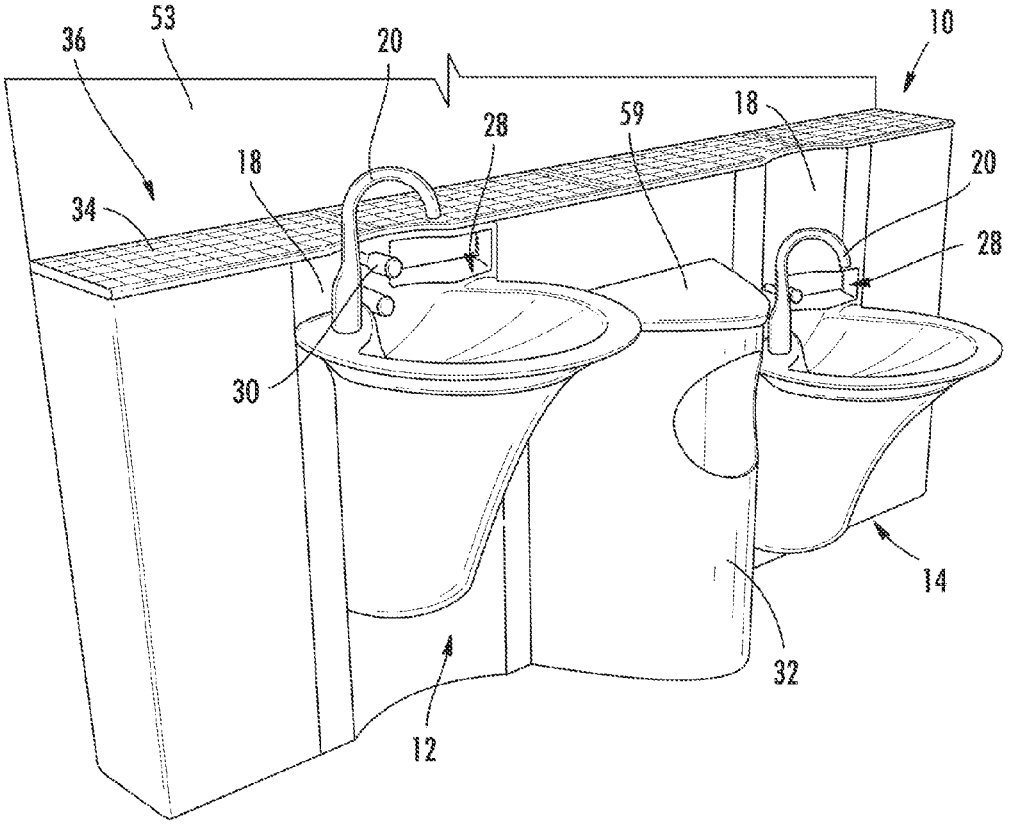
FIG. 25 is a front perspective view of a lavatory system including two hand washing stations according to an exemplary embodiment.

FIG. 25 illustrates a lavatory system 10 having two wash stations 12, 14. A hand drying station, shown as electric hand dryer 28 (but could be a towel dispenser) is integrated with the backsplash 18. According to an exemplary embodiment, faucet 20 (e.g., valve, sensor, etc.) and soap dispenser 30 (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. Photovoltaic cells 34 are mounted on panel 36 located above the backsplash 18. Panel 36 may provide, for example, a place for personal items of the user(s). Each wash station 12, 14 includes a faucet 20, a soap dispenser 30, and a hand dryer 28 with air outlet and/or towel dispenser (not shown). A waste receptacle 32 is mounted between wash stations 12, 14 and also includes a surface 59 for personal items, or another location for additional photovoltaic cells 34.

Figure 26:
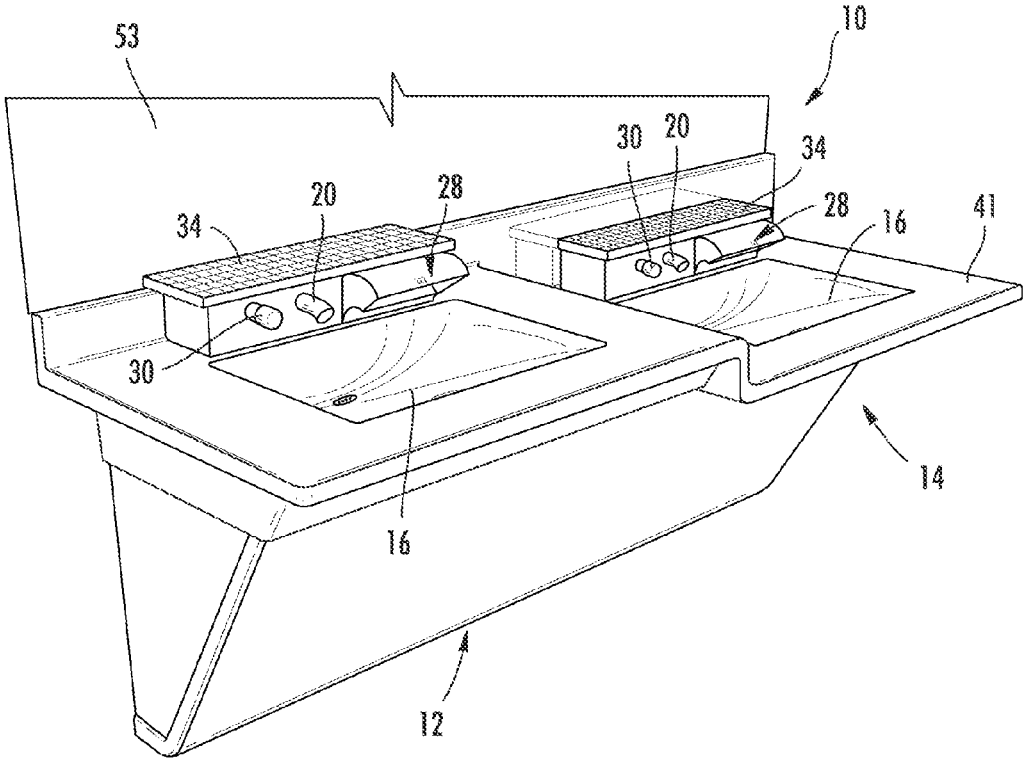
FIG. 26 is a front perspective view of a lavatory system including two hand washing stations according to an exemplary embodiment.
Figure 27:
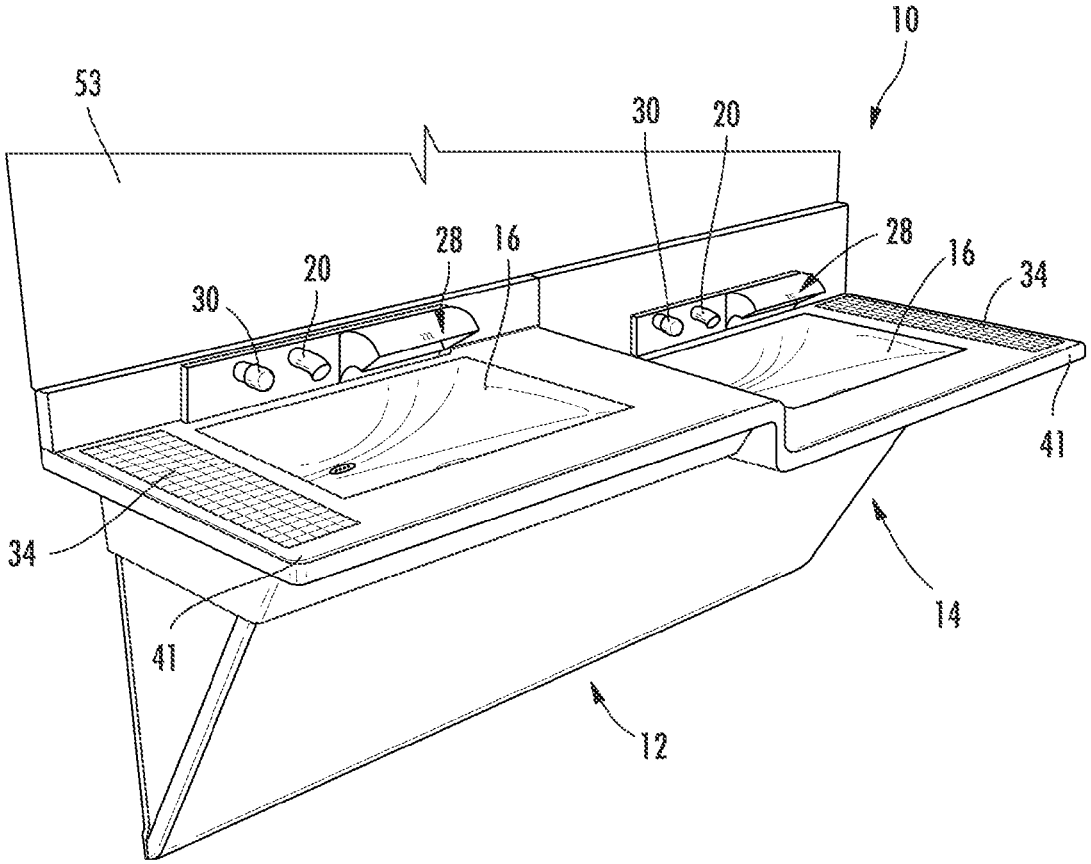
FIG. 27 is a front perspective view of a lavatory system including two hand washing stations according to an exemplary embodiment.
Figure 28:
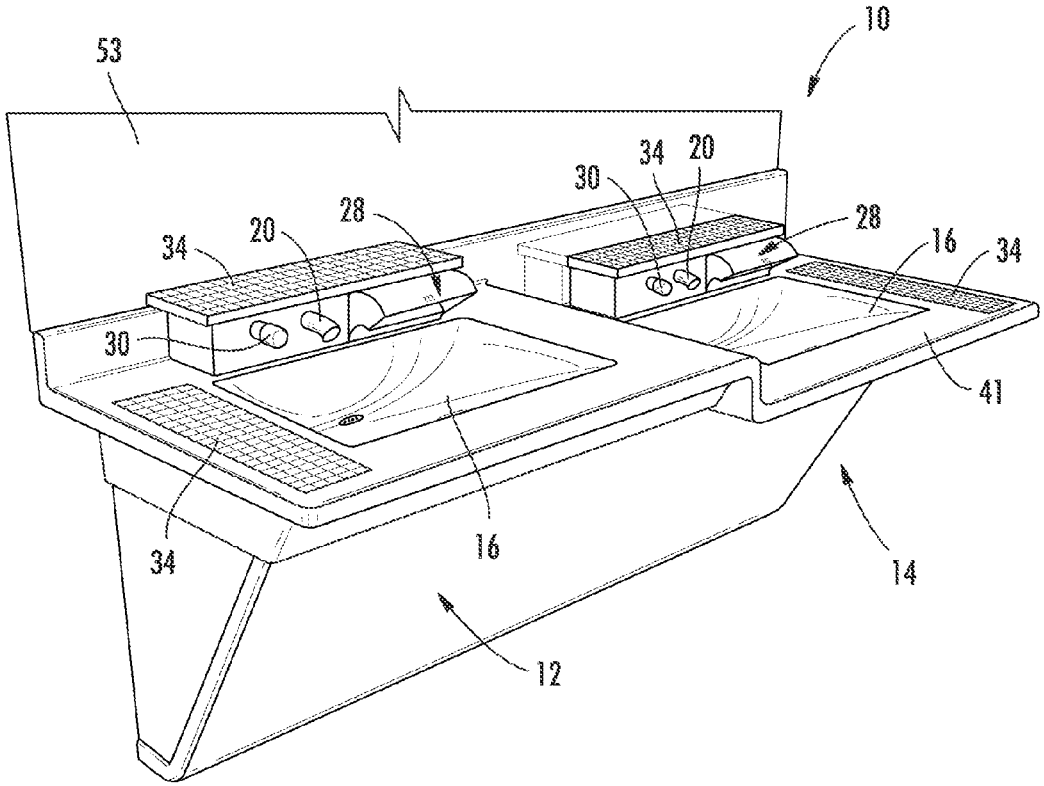
FIG. 28 is a front perspective view of a lavatory system including two hand washing stations according to an exemplary embodiment.

FIGS. 26-28 show similar embodiments of lavatory systems 10. Each includes two wash stations 12, 14 offset vertically at different heights. Each station 12, 14 includes a faucet 20, a soap dispenser 30, and an electric hand dryer 28. At least the faucet (e.g., valve, sensor, etc.) and soap dispenser (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. FIG. 26 shows the fixtures (e.g., faucet 20, a soap dispenser 30, and an electric hand dryer 28) mounted in a pedestal having a top surface of photovoltaic cells 34. FIG. 27 shows the fixtures recessed in the wall and photovoltaic cells 34 mounted in countertop 41. FIG. 28 shows the photovoltaic cells 34 mounted in both the top of the pedestal and countertop 41.

Figure 29:
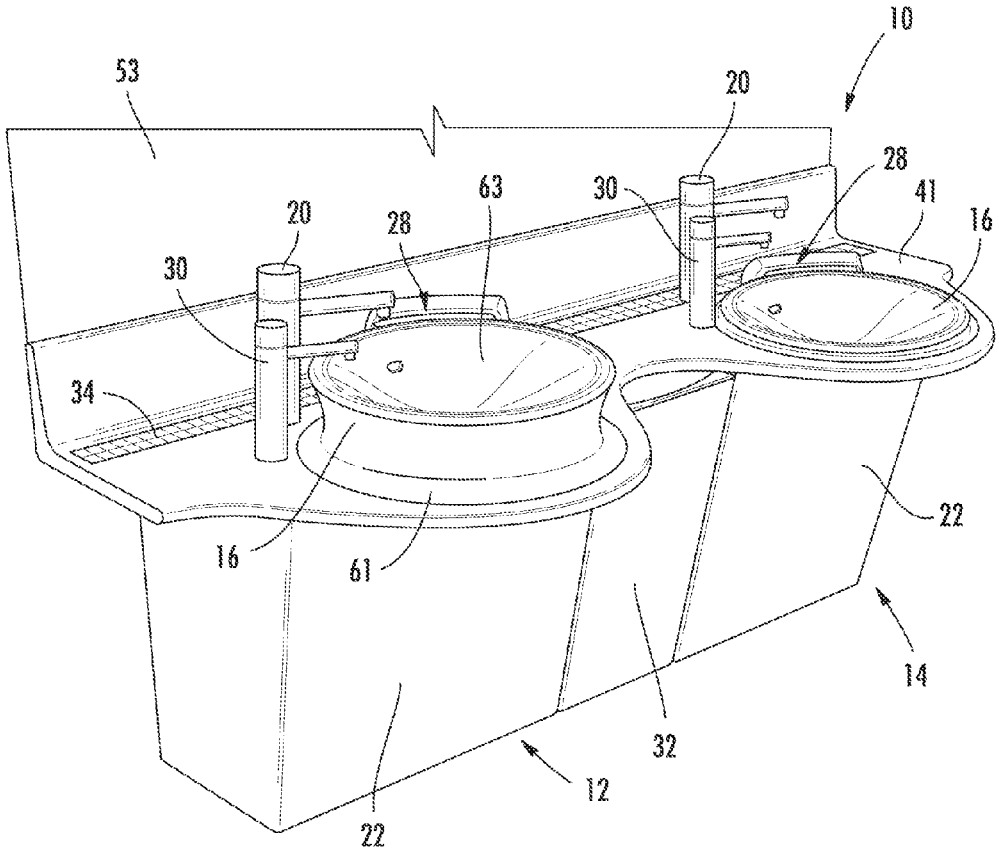
FIG. 29 is a front perspective view of a lavatory system including two hand washing stations according to an exemplary embodiment.
Figure 30:
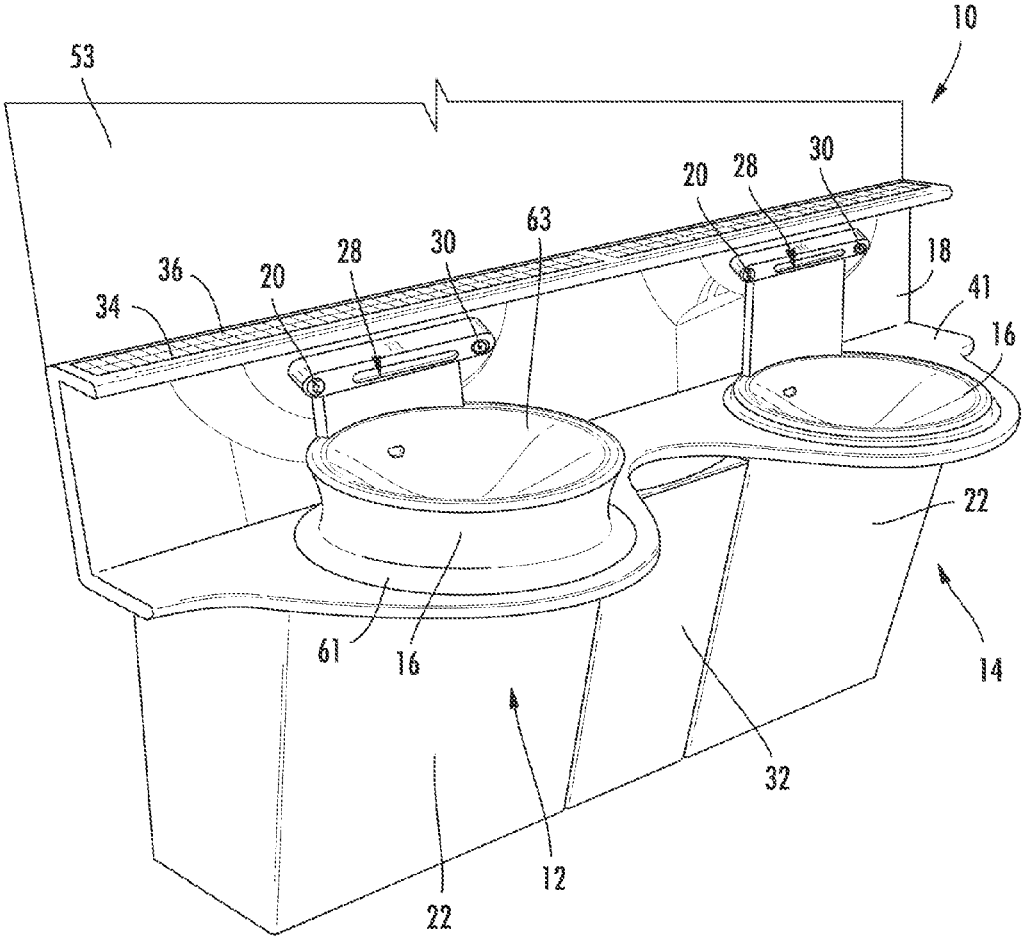
FIG. 30 is a front perspective view of a lavatory system including two hand washing stations according to an exemplary embodiment.
Figure 37:
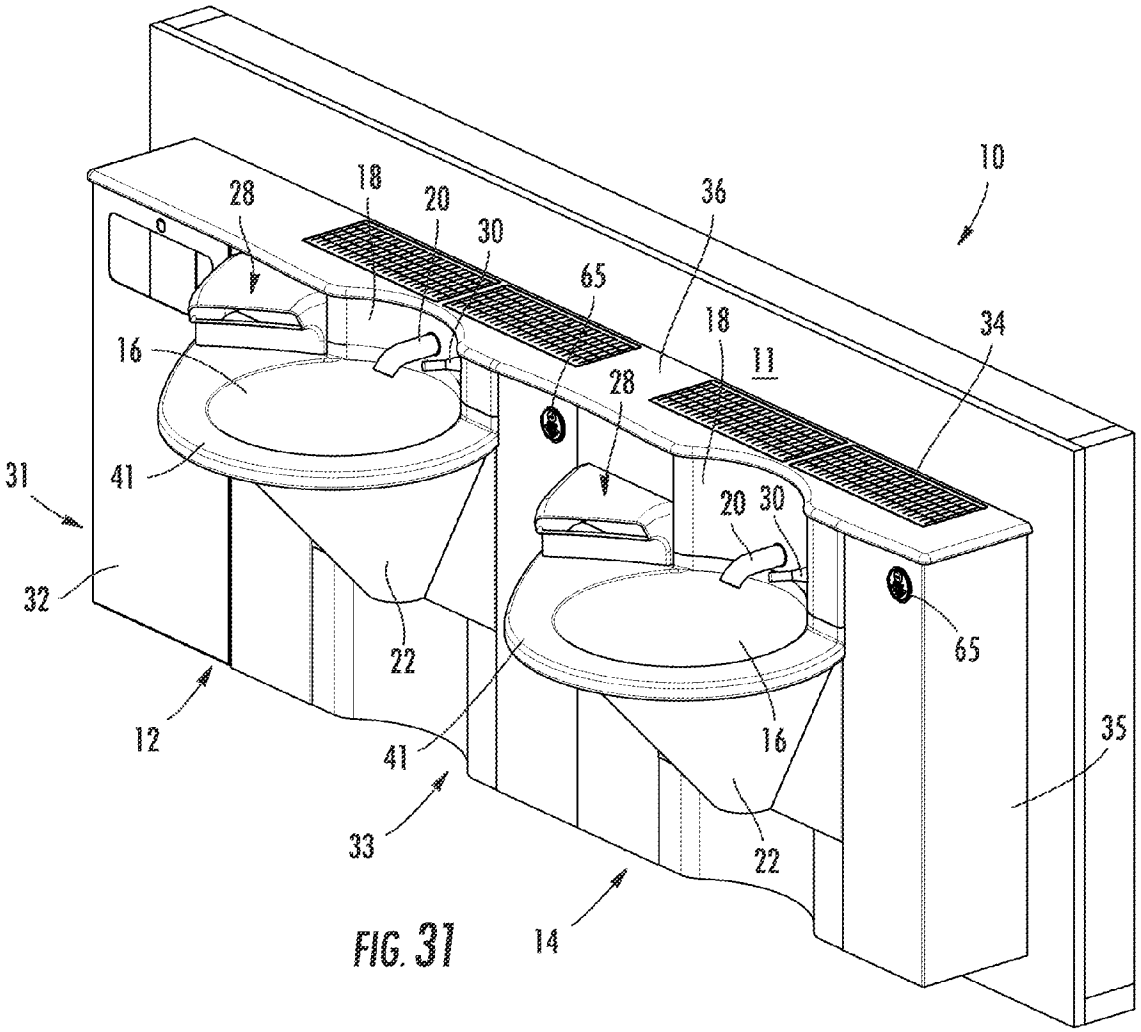
FIG. 37 is a front side view of the lavatory system of FIG. 36.
Figure 32:
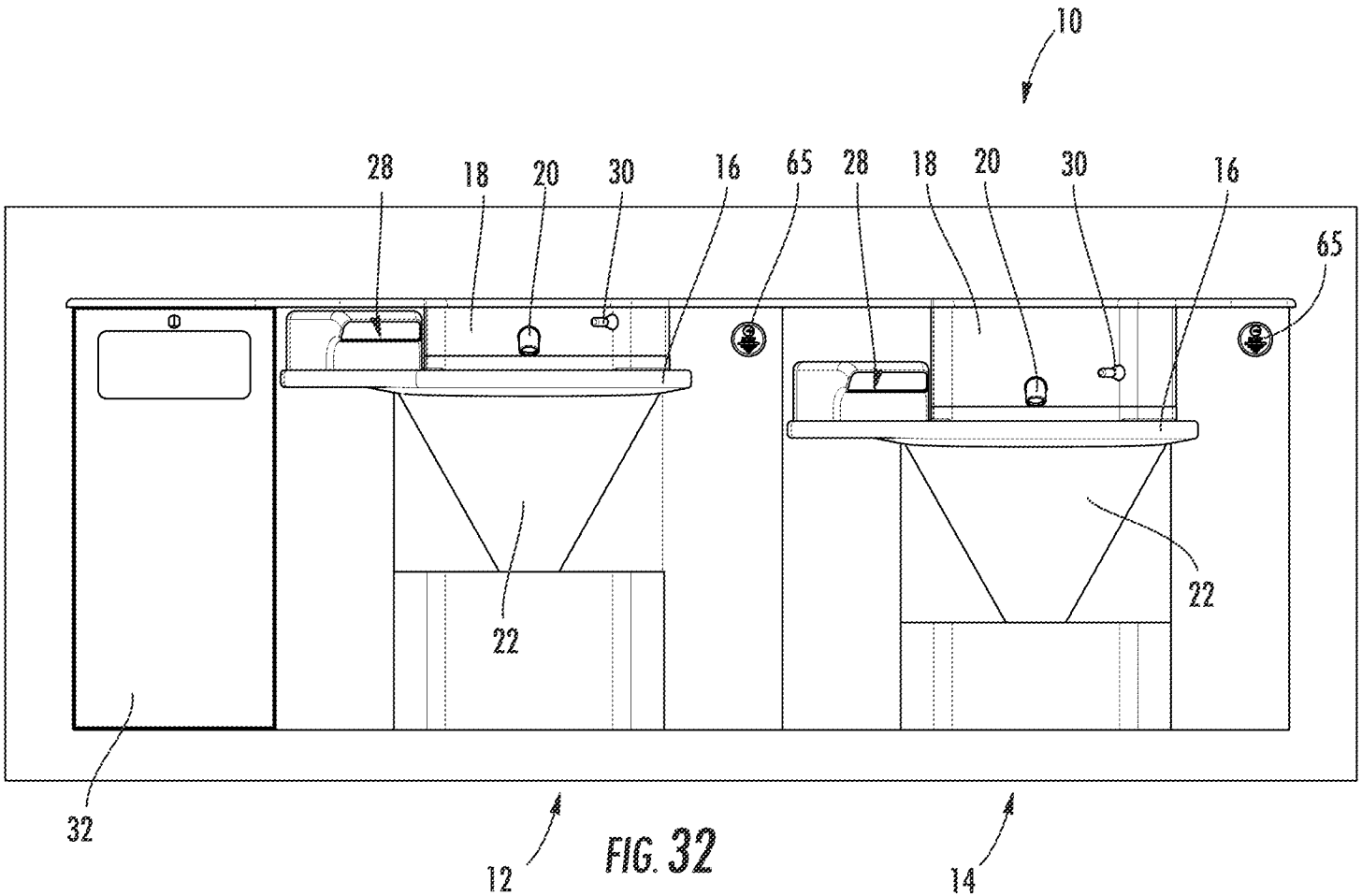
FIG. 32 is a front side view of the lavatory system of FIG. 31.

Similar to FIGS. 14, 29, and 30 illustrate modular lavatory systems 10 having a generally planer countertop 41. Countertop 41 has one or more openings (holes, apertures, etc., which may be circular, oval, rectangular, or other shapes) to receive one of a variety of basins 16. Basins 16 are configured to provide a variety of heights and comprise a mounting portion 61 and a receptacle (bowl) portion 63. Mounting portion 61 engages countertop 41 at one of the openings. The height presented by the washing station is defined by the size or amount of bowl portion 63 extending from the mounting portion 61. A single countertop 41 may therefore be used to provide a lavatory system 10 having a variety of configurations. For example, for the two wash station heights shown in FIGS. 29 and 30, countertop 41 with two openings is installed with basins 16 having two different heights. Each station 12, 14 includes a spray head 20 (instead of a faucet), a soap dispenser 30, and an electric hand dryer 28. FIG. 29 shows the spray head 20 and soap dispenser 30 are mounted to the countertop 41 and the outlet for the hand dryer integrated with the basin 16. FIG. 30 shows the spray head 20 and soap dispenser 30 and the outlet for the hand dryer 28 integrated with the backsplash 18. At least the faucet (e.g., valve, sensor, etc.) and soap dispenser (e.g., valve, sensor, etc.) are powered by a photovoltaic cell and power management system such as disclosed in U.S. patent application Ser. No. 11/041,882 titled "Lavatory System" filed Jan. 21, 2005 is hereby incorporated herein by reference in its entirety. In FIG. 29, photovoltaic cells 34 are mounted in countertop 41. In FIG. 30, photovoltaic cells 34 are mounted in a panel 36 (e.g., for personal items). The lavatory systems of FIGS. 29 and 30 also include a waste receptacle 32 integrated with trap cover 22. Items may be placed in the waste receptacle through a small opening between the countertop and a panel (e.g., small items such as a tissue), or by pulling the panel outward (e.g., for larger items).

Referring to FIGS. 31 through 35, a lavatory system 10 is shown according to another exemplary embodiment. Similar to the exemplary embodiments detailed above, the embodiment illustrated in FIGS. 31 through 35 may be configured to be supported by an adjacent wall 11 (as shown) or may be a freestanding structure configured to be supported by a base (e.g., legs, pedestal, vanity, etc.).

According to the embodiment illustrated, lavatory system 10 includes two hand washing stations, shown as a first or upper station 12 and a second or lower station 14. Alternatively, the lavatory system may include any number of washing stations (e.g., one, three, four, or more) arranged in any of a variety of configurations (e.g., all upper stations, all lower stations, mixed upper/lower stations, etc. set at a variety of upper/lower patters or sequences). Each hand washing station 12, 14 generally includes a basin 16 (e.g., bowl, sink, receptacle, etc.), a countertop 41 or surface (e.g., rim, ledge, etc.) at least partially surrounding the basin, washing fixtures (e.g., faucet 20, soap dispenser 30, etc.) associated with each basin 16, a cover 22 supported under each basin 16 for at least partially concealing plumbing (e.g., water supply, drain, etc.) associated with the station, a hand drying fixture (e.g., electric hand dryer, towel dispenser, etc.), shown as hand dryer 28, and an interface 65 for filling or refilling a reservoir (e.g., chamber, receptacle, etc.) that is configured to retain a liquid soap for soap dispenser 30.

The embodiment illustrated is further shown as including a waste receptacle 32 adjacent to the upper station 12 and a plurality of photovoltaic cells 34 mounted on a shelf or platform 36 located above the other components of the washing stations 12, 14. Waste receptacle 32 may be at any of a variety of locations on the lavatory system 10 (e.g., between each wash station, on the outer ends of the wash stations, etc.). According to the embodiment illustrated, faucet 20 and soap dispenser 30 are powered by the photovoltaic cells 34 and a power management system, such as disclosed in U.S. patent application Ser. No. 11/041,882 titled "Lavatory System" filed Jan. 21, 2005, referenced above, the entire contents of which is hereby incorporated herein by reference in its entirety. Further, if hand dryer 28 is an electric hand dryer, hand dryer 28 may be powered by the same photovoltaic cells 34 and power management system.

Figure 33:
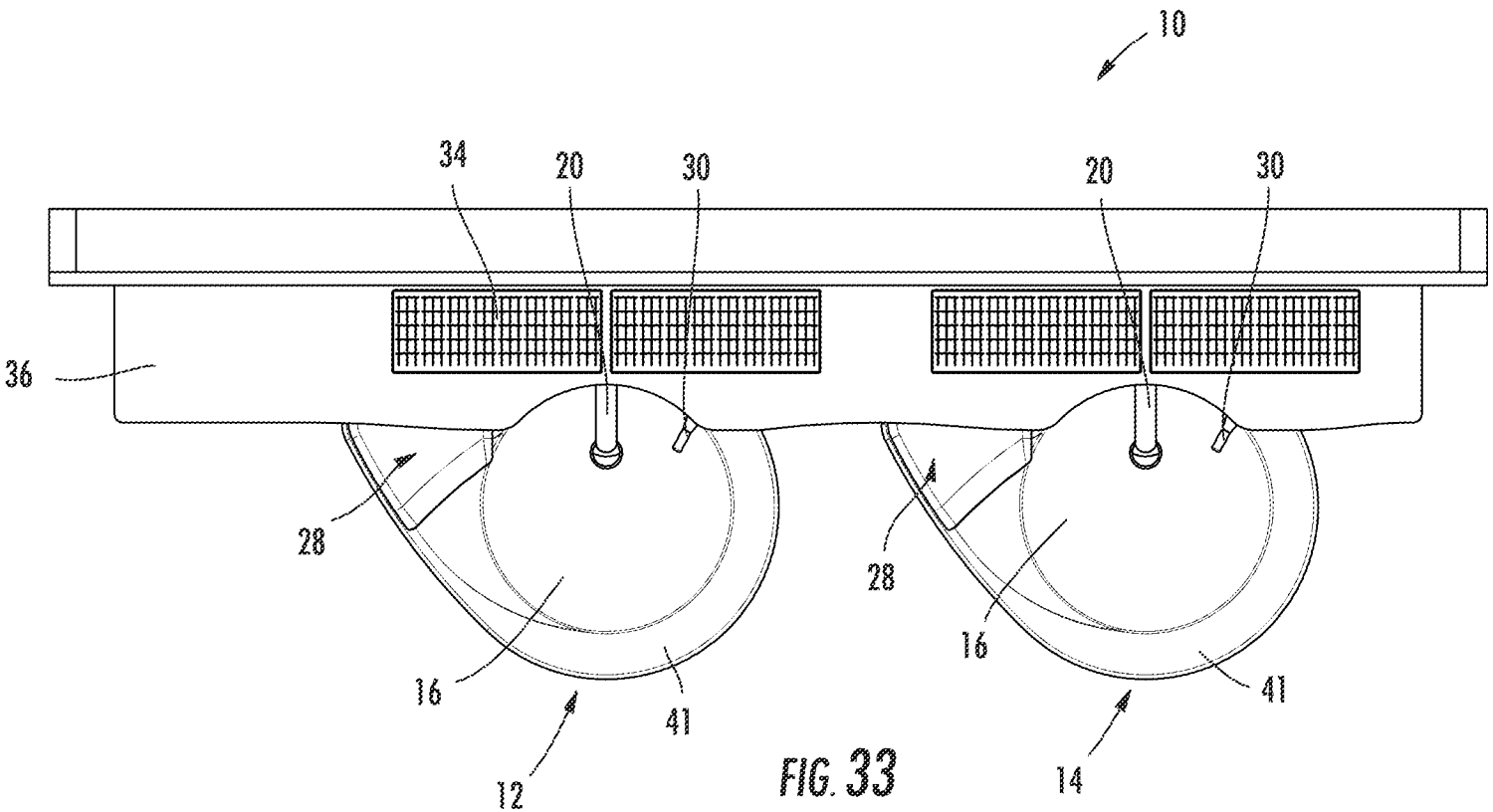
FIG. 33 is a top view of the lavatory system of FIG. 31.
Figure 34:
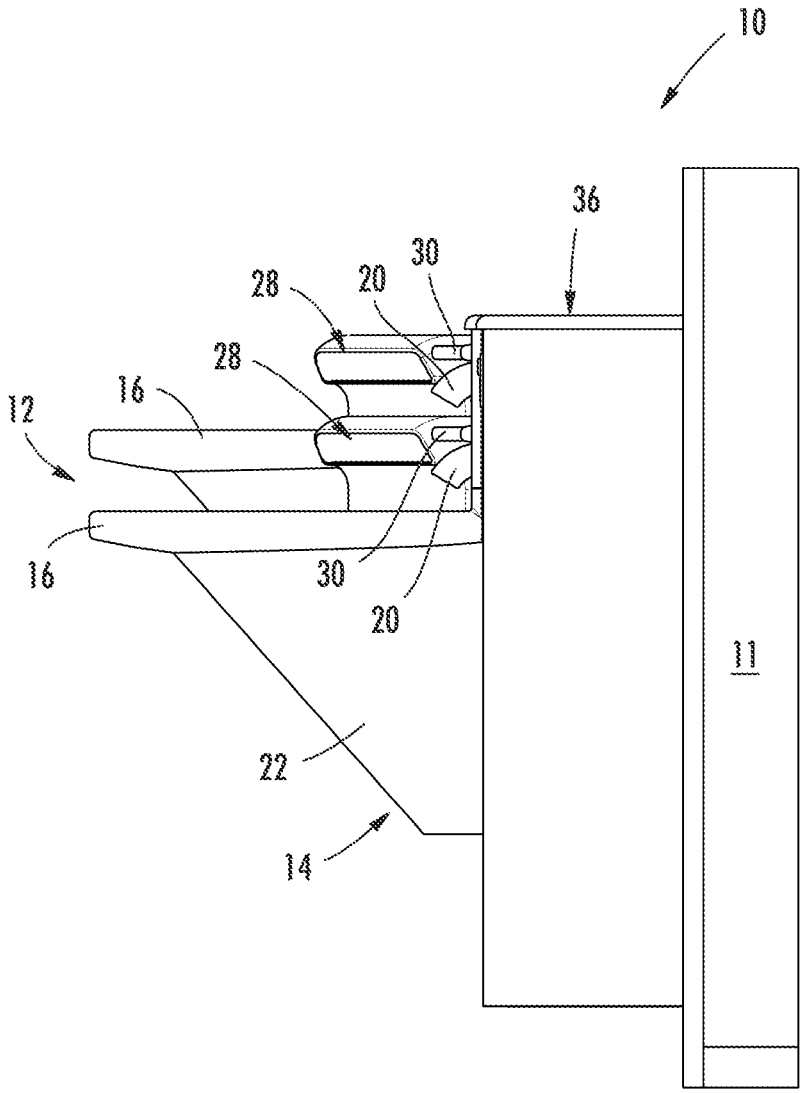
FIG. 34 is a right side view of the lavatory system of FIG. 31.

A hand dryer 28 is provided at each washing station 12, 14 so that a user does not have to move away from the washing station before drying his or her hands. Having access to a hand dryer 28 at the washing station, as opposed to a distance away from the washing station, is intended to reduce the likelihood that water from a user's hands will collect on the floor of the facility in which the lavatory system is located. According to the embodiment illustrated, hand dryer 28 is integrated with a backsplash area 18 of the washing station and is supported by the countertop 41. As shown in FIG. 33, countertop 41 is configured to be larger on one side to accommodate hand dryer 28. As further shown in FIG. 33, the contour of the countertop substantially corresponds to the contour of hand dryer 28 to provide a continuous appearance between hand dryer 28 and countertop 41.

According to an exemplary embodiment, hand dryer 28 is an electric hand dryer configured to provide forced air in the direction of the user. The output opening of the hand dryer is configured so that as water is blown off the hands of a user, the water will be directed towards the basin. To facilitate this, the output opening of hand dryer 28 is directed downward and inward towards basin 16. To further facilitate the collection of the water in the basin rather than the floor, the top surface of countertop 41 may have a contour that is angled (e.g., slanted, sloped, etc.) downward and/or inward towards basin 16 as shown in FIG. 33.

Referring back to FIG. 31, an interface 65 is provided at each washing station 12, 14 that can be used to fill and/or refill a reservoir (not shown) that retains soap that is supplied to soap dispenser 30. Interface 65 is intended to simplify the task of filling and/or refilling the reservoir. According to the embodiment illustrated, interface 65 includes a face plate 67 (e.g., cover member, etc.) and a base member 69. Face plate 67 is coupled to a first end of the base member 69 while a second end of base member 69 is movably coupled a support structure, shown as front portion 33 of housing 31, of lavatory system 10. Base member 69 is configured to be selectively moved between a stowed position (shown in FIG. 31) and an extended or fill position (shown in FIG. 35). According to the embodiment illustrated, base member 69 is configured to slide between the stowed position and the fill position. One or more mechanisms (e.g., bearing surfaces, rollers, glides, etc.) may be provided between base member 69 and the support structure of lavatory system 10 to assist in the movement of base member 69.

Figure 35:
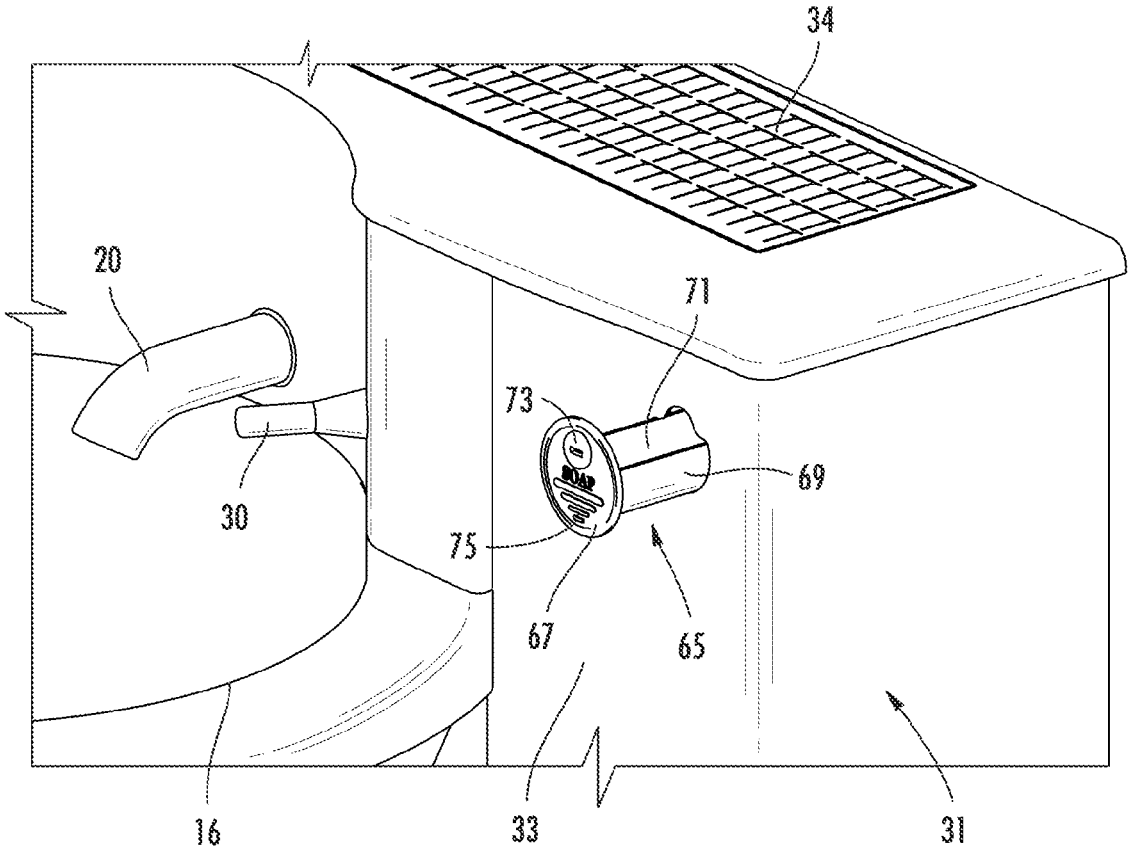
FIG. 35 is a front perspective view of the lavatory system of FIG. 31 showing a soap dispenser interface in the extended position.
Figure 36:
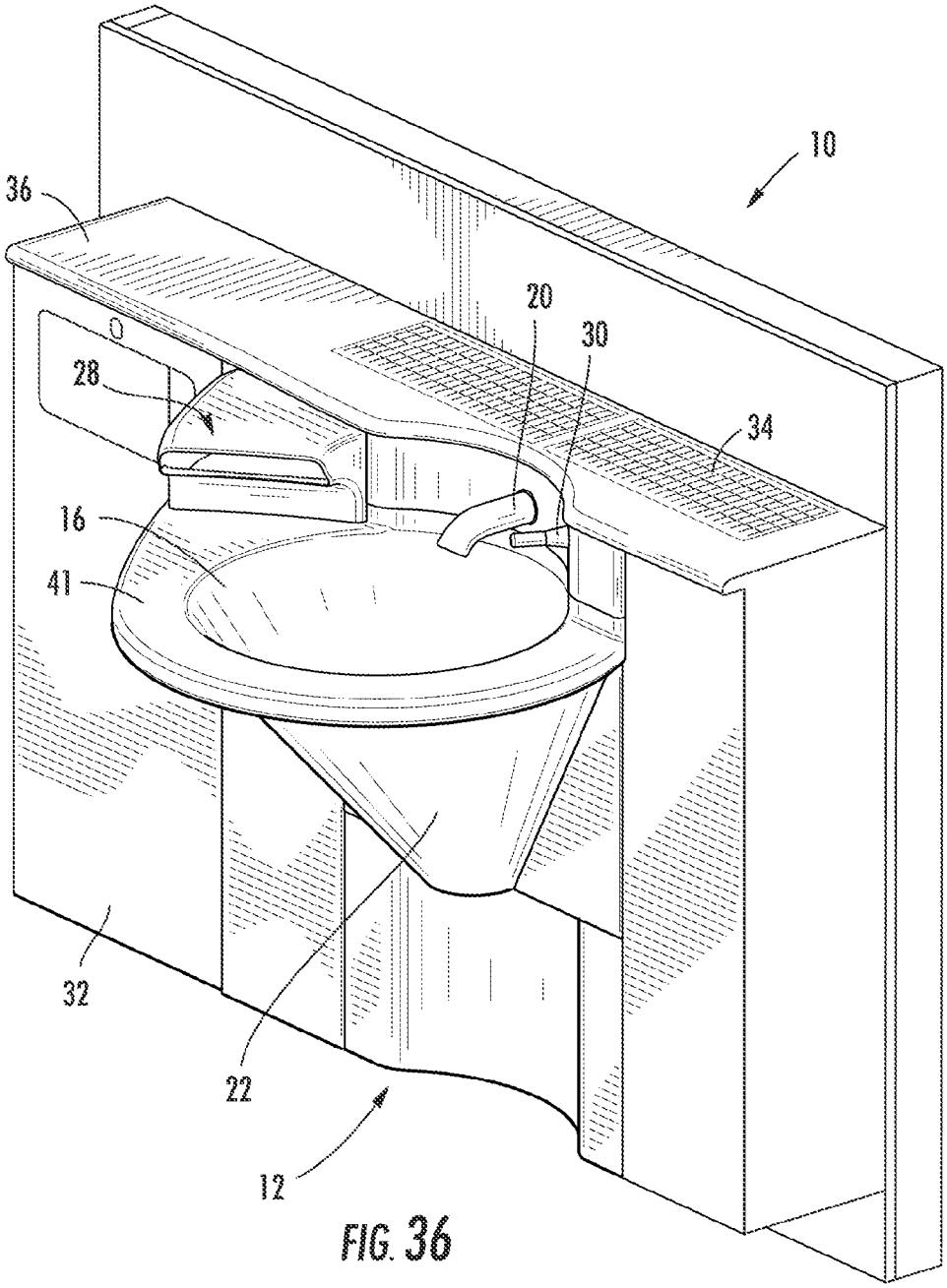
FIG. 36 is a front perspective view of a lavatory system according to an exemplary embodiment.
Figure 37:
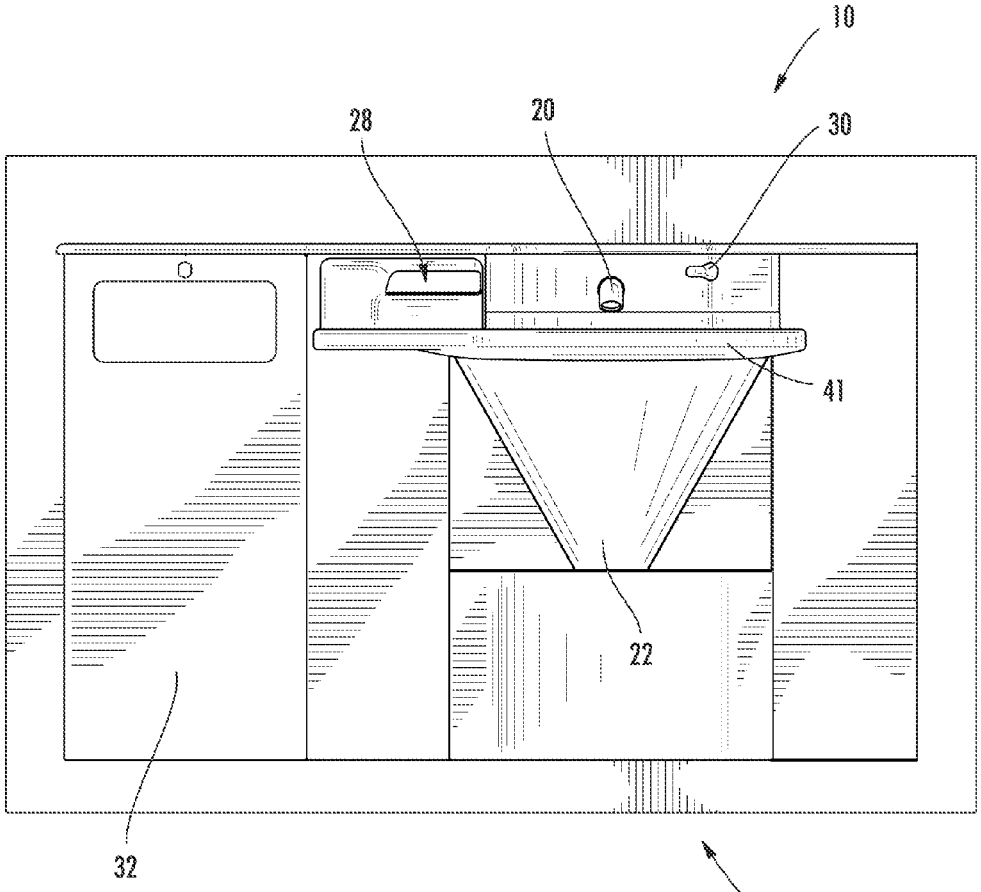
Figure 38:
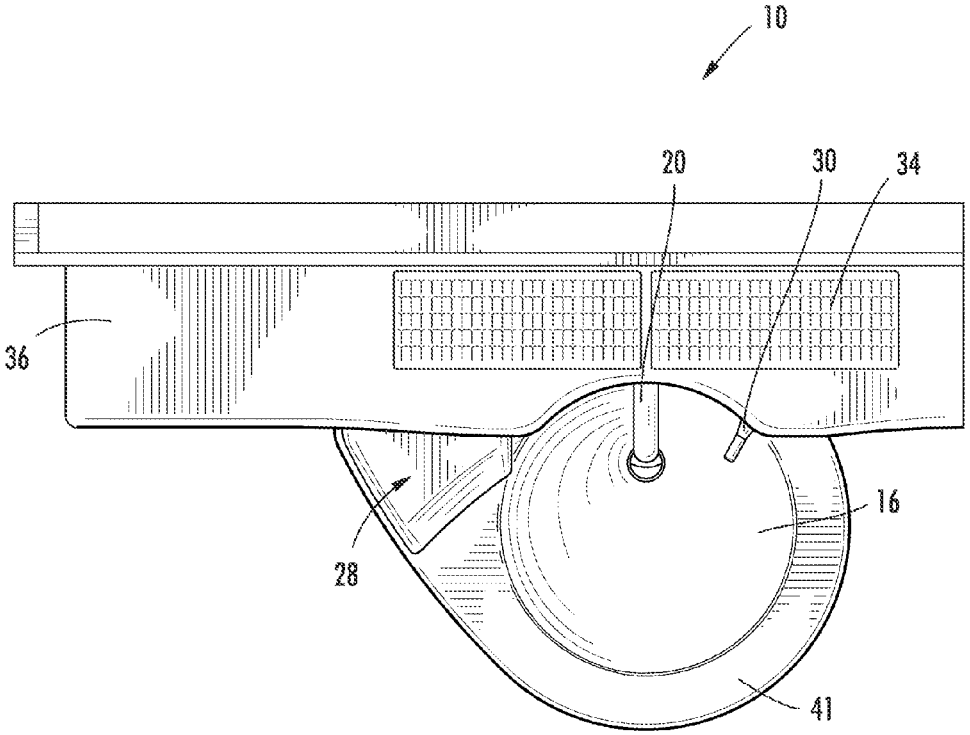
FIG. 38 is a top view of the lavatory system of FIG. 36.

Referring to FIG. 35, base member 69 includes a channel 71 (e.g., trough, cavity, funnel, etc.) extending in a longitudinal direction of base member 69. Channel 71 is configured to be in fluid communication with the reservoir and serves as a conduit between a person filling the reservoir and the reservoir. In use, a person would selectively slide base member 69 out from the stowed position to the fill position. Once in the fill position, the person would add (e.g., pour, dispense, etc.) soap into channel 71. The soap added to channel 71 would then pass to the reservoir where it would be retained until it is dispensed from soap dispenser 30. To facilitate the transfer of the soap from channel 71 to the reservoir, channel 71 may be inclined or angled to bias the soap towards the reservoir. Alternatively, the soap refill may be provided by a cartridge (e.g., removable, replaceable, reusable, disposable, etc.) that is coupled to soap dispenser 30 at/through the interface 65 (e.g., supported by channel).

To prevent unauthorized persons from accessing interface 65, interface 65 is shown as including a lock or latching device 73. According to the embodiment illustrated, latching device 73 is provided on face plate 67 and is configured to be moved between a locked position and an unlocked position by using a key. According to the various alternative embodiments, any of a number of locks or latching devices may be used to secure interface 65 and base member 69 in the stowed position.

Still referring to FIG. 35, face plate 67 is further shown as including a display 75 (e.g., indicator, gauge, etc.) that is configured to provide a user and/or a worker with an indication of the amount of soap within the reservoir and/or notice of when the reservoir is in need of refilling. According to the embodiment illustrated, display 75 includes a plurality of light bars that provide a visual indicator of the amount of soap within the reservoir. For example, if the reservoir is substantially full, all of the light bars may be illuminated. As the reservoir is depleted of soap, the number of light bars may decrease accordingly. The light bars may be illuminated using one or more light emitting diodes (LED) or any other suitable light source. The light bars extend in a substantially horizontal direction, but alternatively, may be provided at any orientation.

Such a system is intended to provide an accurate indication of the level of soap within the reservoir rather than simply providing an indication that the reservoir is either full or empty. Once all of the light bars are off, a user would know that it is time to refill the reservoir. For such an embodiment, a sensor and/or switch may be provided in the reservoir that provides an output signal representative of the soap level in the reservoir.

According to the various alternative embodiments, the illumination of the light bars may be reversed so that the light bars become illuminated as the reservoir becomes depleted of soap. Such a configuration may conserve power because the light bars would not have to be illuminated until the reservoir was close to being empty. According to further alternative embodiments, display 75 may be any type of device capable of providing an indication of the level of soap within the reservoir. For example, display 75 may be gauge having a pointer that moves between an area on the gauge marked "E" for empty and an area on the gauge marked "F" for full. Such a display may be an electronic and/or mechanical gauge. According to still further alternative embodiments, an audio indicator may be provided in addition to or in place of the visual indicator.

The exemplary embodiment illustrated in FIGS. 31 through 35 may be configured as a single unit or may be configured as separate modules that are configured to be reconfigured, arranged, rearranged or the like to provide any of a variety of arrangements depending on the particular application. According to the embodiment illustrated, the two washing stations 12, 14 are separate modular units that have been coupled together to provide a two station lavatory system 10. Likewise, waste receptacle 32 is another module that has been selectively added to the lavatory system.

Referring to FIGS. 36 through 40, a lavatory system 10 is shown according to another exemplary embodiment. The lavatory system illustrated in FIGS. 36 through 40 is substantially the same as the lavatory system illustrated in FIGS. 31 through 35 except that only one washing station module 12 has been used in combination with a waste receptacle module 32.

Referring to FIGS. 41 through 45, a lavatory system 10 is shown according to another exemplary embodiment. The lavatory system illustrated in FIGS. 41 through 45 is substantially the same as the lavatory system illustrated in FIGS. 36 through 40 except that hand dryer 28 and the waste receptacle 32 are provided on the opposite side of basin 16 (i.e., a right-hand side). Locations and orientations of hand dryer 28 and waste receptacle 32 may be altered, reconfigured, rearranged to provide any of a variety of use and design applications.

Referring to FIGS. 46 through 50, a lavatory system 10 is shown according to another exemplary embodiment. The lavatory system illustrated in FIGS. 46 through 50 is substantially the same as the lavatory system illustrated in FIGS. 31 through 35 except that three washing station modules 12, 14, 15 have been used in combination with two waste receptacle modules 32. According to the embodiment illustrated, the two outer washing stations 12, 15, are upper washing stations, while the middle station 14 is a lower washing station. Such an embodiment was illustrated to show the number of different configurations that can be obtained to meet the demands of a particular application. According to the various alternative embodiments, any number of washing station modules and/or waste receptacle modules may be provided in any arrangement to meet the demands of the particular application.

It is to be understood that the invention is not limited to the details of construction and the arrangement of the components set forth in the description or illustrated in the drawings. The invention is capable of other embodiments or being practiced or carried out in various ways. It is also to be understood that the phraseology and terminology employed herein is for the purpose of description and should not be regarded as limiting.

Also, the particular materials used to construct the exemplary embodiments are also illustrative. For example, the countertop may be made from any of a variety of solid surface materials, stainless steel, laminates, fiberglass, and the like. According to an exemplary embodiment, the countertop is made from a densified solid surface material composed of an acrylic modified polyester resin that complies with ANSI Z124.3 and Z124.6 as well as ANSI SS-1-2001, and/or other applicable regulations or standards. According to a particularly preferred embodiment, the surface material is of a type commercially available under the trade name TERREON-.RTM. from Bradley Corporation of Menomonee Falls, Wis. The countertop is intended to be resistant to chemicals, stains, burns, and impact such that surface damage can easily be repaired with everyday cleaners or fine grit abrasives. According to a preferred embodiment, the countertop or deck is molded from a mixture of resin, filler, pigment, and initiator (catalyst), which forms a liquid when combined. Also, other molding operations may be used to form these components.

Also, the terms are intended to be broad terms and not terms of limitation. These components may be used with any of a variety of hand washing locations and are not intended to be limited to use with washroom or restroom applications. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the multi height lavatory system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. For example, various embodiments are shown as two or three wash stations, but it should be understood that these are shown as examples and the invention is applicable to any of a variety of wash station configurations (e.g., one, two, three, four, etc. stations). Also, "ADA" standards for height of hand washing stations is provided by way of example, and is not intended to be limiting—any of a variety of heights may be used, (e.g., dictated by accessibility regulations or otherwise desired). Accordingly, all such modifications are intended to be included within the scope of the present invention as defined in the disclosed embodiments. The order or sequence of any process or method steps may be varied or re-sequenced according to alternative embodiments. In the disclosed embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention.

Various alternatives are contemplated as being within the scope of the following claims particularly pointing out and distinctly claiming the subject matter regarded as the invention.

We hereby claim:

1. A lavatory system comprising:

a first integrated hand washing station including a first basin, a first faucet, a first solenoid valve configured to control water flow to the first faucet, wherein the washing station is capable of receiving a waste receptacle;

a first electric hand dryer located adjacent the first basin and the first faucet so that the user of the first washing station may use the first faucet and the first electric hand dryer without leaving the first washing station;

the hand dryer includes a nozzle adjacent to the first basin and horizontally extending from a front panel of the lavatory to the left or right side of the of the first faucet with a nozzle air outlet angled downwardly, with respect to the front panel, toward the first faucet;

a control system configured to control activation of the first solenoid valve and the first electric hand dryer; wherein the control system is configured to control the first solenoid valve and the first hand dryer with a plurality of touch-less sensors providing a sensed zone for the first solenoid valve and a sensed zone for the first hand dryer wherein each respective zone does not overlap another zone.

2. The lavatory system of claim 1, wherein the control system prevents activation of the first solenoid valve when the first electric hand dryer has been activated.

3. The lavatory system of claim 1, wherein the first hand dryer air outlet is located on a first horizontal plane at or above the faucet; and wherein the control system prevents activation of the first electric hand dryer when the first solenoid valve has been activated.

4. The lavatory system of claim 1, wherein the control system activates the first solenoid valve and the first electric hand dryer when the touch-less sensors sense a presence of a user's hand and maintains activation regardless of continued sensing according to a predetermined timing and sequence.

5. The lavatory system of claim 1, wherein the control system prevents activation of the first electric hand dryer when the first solenoid valve has been activated; and prevents activation of the first solenoid valve when the first electric hand dryer has been activated.

6. The lavatory system of claim 1, wherein the plurality of touch-less sensors includes a single first sensor configured to sense the presence of a user's hands near the first hand washing station and a single second sensor configured to sense the presence of the user's hands near the first hand dryer.

7. The lavatory system of claim 6, further comprising an illuminated display configured to display an information regarding amount of soap in a soap dispenser.

8. The lavatory system of claim 1, further comprising a second hand dryer, wherein the first hand dryer is located on a first horizontal plane at or above the first faucet and the second hand dryer is located on a second horizontal plane below the first faucet.

9. The lavatory system of claim 7, further comprising a second integrated hand washing station including a second basin, a second faucet, a second solenoid valve configured to control water flow to the second faucet, and a second electric hand dryer located adjacent the second basin and the second faucet so that the user of the second hand washing station may use the second faucet and the second electric hand dryer without leaving the second washing station; wherein the control system prevents activation of the second solenoid valve when the second electric hand dryer has been activated; wherein the control system prevents activation of the second electric hand dryer when the second solenoid valve has been activated.

* * * * *